US005791543A

United States Patent [19]

Udagawa et al.

[11] Patent Number: 5,791,543

[45] Date of Patent: Aug. 11, 1998

[54] ELECTRIC STAPLER

[75] Inventors: Hiroshi Udagawa; Kazuo Higuchi; Toshiaki Kikuchi, all of Chuo-ku, Japan

[73] Assignee: Max Co., Ltd., Tokyo, Japan

[21] Appl. No.: 764,019

[22] Filed: Dec. 11, 1996

[30] Foreign Application Priority Data

| | | | |
|---|---|---|---|
| Dec. 11, 1995 | [JP] | Japan | 7-321474 |
| Dec. 13, 1995 | [JP] | Japan | 7-324517 |
| Dec. 15, 1995 | [JP] | Japan | 7-327163 |
| Dec. 20, 1995 | [JP] | Japan | 7-331359 |
| Jan. 18, 1996 | [JP] | Japan | 8-006505 |

[51] Int. Cl.[6] ..... B25C 5/02; B27F 7/21

[52] U.S. Cl. ..... 227/4; 227/131; 227/155

[58] Field of Search ..... 227/131, 4, 155, 227/154

[56] References Cited

U.S. PATENT DOCUMENTS

| | | | |
|---|---|---|---|
| 4,199,095 | 4/1980 | Yamanoi | 227/155 |
| 4,720,033 | 1/1988 | Olesen | 227/155 |
| 4,830,256 | 5/1989 | Kramer | 227/155 |
| 4,844,319 | 7/1989 | Kurosawa et al. | 227/155 |
| 5,005,751 | 4/1991 | Radtke et al. | 227/155 |
| 5,269,451 | 12/1993 | Udagawa et al. | 227/155 |
| 5,413,266 | 5/1995 | Jairam | 227/155 |

*Primary Examiner*—Scott A. Smith

*Attorney, Agent, or Firm*—Jacobson, Price, Holman & Stern, PLLC

[57] ABSTRACT

An electric stapler is provided which comprises a stapler body (10) having a driving-out portion (720) and a driver (321) for driving a staple from the driving-out portion (720) into, for example, sheets of paper while reciprocating. The stapler body (10) includes a table (100) which reciprocates in conjunction with a driving mechanism by which the driver (321) is reciprocated. The sheets of paper are held between the table (100) and the driving-out portion (720) when the table (100) reciprocates. Clinchers (401, 402) are disposed on the table (100). The clinchers (401, 402) clinch the ends of the staple which is driven by the driver (321) and has passed through the sheets. After the sheets of paper are held between the table (100) and the driving-out portion (720), the driver (321) drives the staple into the sheets, and the clinchers (401, 402) are then actuated.

4 Claims, 64 Drawing Sheets

ELECTRIC STAPLER

BACKGROUND OF THE INVENTION

1. Field of the Invention

This invention relates to an electric stapler to which a cartridge containing a pile of sheet-staples is attached, in which the sheet-staples in the cartridge are delivered to a driving position so that staples of the sheet-staples are driven from the driving position.

2. Description of the Prior Art

Conventionally, an electric stapler is known which comprises a magazine attached pivotably to a base frame, a cartridge attached to the magazine and containing a pile of sheet-staples each of which consists of staples arranged in rows, a delivering mechanism for delivering the sheet-staples in the cartridge to a driving position, a driver for driving a staple of the delivered sheet-staples from the driving position while reciprocating, and a table on which a clincher is disposed for bending and flattening the ends of the driven staple.

The conventional electric stapler is constructed such that the table is fixed and the magazine is moved up and down. According to the up-down movement of the magazine, sheets of paper are held between the driving position and the table and, at the same time, a staple is driven from the driving position into the sheets of paper by means of the driver, and the ends of the staple which has penetrated the sheets are bent and flattened by means of the clincher, and thereby stapling is completed.

In the electric stapler, however, the up-down movement of the magazine to which the cartridge is attached brings about a great impact on the cartridge. Accordingly, disadvantageously, a delivering operation of the sheet-staples to the driving position becomes unstable and, in addition, the noise accompanying the operation becomes larger.

There is another problem in that a motor of high power must be used because the driving and clinching of the staple by the driver and clincher are carried out simultaneously by a single motor.

There is still another problem in that the size of the table becomes larger because a motor and a gear train for running the clincher are disposed on the table.

There is still another problem in that the delivering of sheet-staples is unstable because the delivering mechanism is constructed such that the sheet-staples in the cartridge are delivered to the driving position by the frictional force of a roller.

There is still another problem in the following respect.

In the conventional electric stapler, a first detecting means detects that the magazine is in a home position.

As described above, according to the up-down movement of the magazine, sheets of paper are held between the driving position and the table and, at the same time, a staple is driven from the driving position into the sheets of paper by means of the driver, and the ends of the staple which has penetrated the sheets are bent and flattened by means of the clincher, and thereby stapling is completed. When the first detecting means detects that the magazine has returned to the home position, the first detecting means outputs a home signal. Based on the home signal, the next stapling operation is carried out.

However, if this electric stapler is used as an electric stapler attached to, for example, a copying machine, the copying machine must wait in a stopped state of a sheet processing operation until the first detecting means outputs the home signal. As a result, disadvantageously, the processing time of the copying machine becomes longer. An expected solution to this disadvantage is that the working speed of the electric stapler is increased. However, according to the solution, vibrations, impact, and noise become larger, and accordingly a harmful influence is exerted on the life of the electric stapler.

There is still another problem in the following respect.

The conventional electric stapler is constructed to move the magazine up and down. Thus, the cartridge must be tightly fixed to the magazine. Since a high-elastic spring is used to fix it, a great force is required to attach the cartridge thereto and remove it therefrom, thus rendering the attachment and removal difficult.

SUMMARY OF THE INVENTION

It is a first object of the present invention to provide an electric stapler in which sheet-staples are stably delivered to a driving position, a noise produced by the operation is abated, and a motor of low power can be used.

It is a second object of the present invention to provide an electric stapler in which a staple of the sheet-staples can be smoothly driven out.

It is a third object of the present invention to provide an electric stapler in which the processing time of a copying machine or the like can be shortened without increasing the working speed of the electric stapler.

It is a fourth object of the present invention to provide an electric stapler in which a table can be small-sized and lightened.

It is a fifth object of the present invention to provide an electric stapler in which the attachment and removal of the cartridge are easily carried out.

In order to achieve the objects, an electric stapler according to an aspect of the present invention comprises a stapler body having a driving-out portion; a driver mounted in the stapler body, for driving a staple from the driving-out portion to, for example, sheets of paper while reciprocating; a table mounted in the stapler body; and clinchers mounted on the table, for clinching ends of the staple which has been driven into the sheets by the driver and has passed through the sheets. The table reciprocates in conjunction with a driving mechanism by which the driver is reciprocated, and the sheets of paper to be fastened together are held between the table and the driving-out portion when the table reciprocates. In the electric stapler, after the sheets are held between the table and the driving-out portion, the staple is driven thereinto by the driver. The clinchers are then actuated. Preferably, the electric stapler further comprises a first detecting means for detecting that the table is in a home position, and a second detecting means for detecting when the table has returned to a position where the sheets are released from being held therebetween. Preferably, the first and second detecting means are constructed of a single detecting means.

In order to achieve the objects, an electric stapler according to another aspect of the present invention comprises a cartridge containing a pile of sheet-staples; a delivering mechanism for delivering the sheet-staples from the cartridge to a driving-out portion; and a driver for driving a staple of the sheet-staples delivered from the cartridge into, for example, sheets of paper while reciprocating. The delivering mechanism comprises a moving means. The moving means has a contact portion which comes in contact with a rear end of each sheet-staple contained in the cartridge and moves forward and backward in conjunction with a driving mechanism by which the driver is reciprocated. In the electric stapler, when the moving means moves forward, the contact portion of the moving means is brought into contact with the rear end of the sheet-staple so that the sheet-staple is delivered forward from the cartridge by a predetermined distance. If the sheet-staple cannot be delivered for the predetermined distance, the moving means is stopped from moving forward regardless of whether the driving mechanism is working. Preferably, the moving means comprises a delivering plate provided with the contact portion; and delivering levers for reciprocating the delivering plate forward and backward in conjunction with the driving mechanism. A slip portion is disposed between the delivering plate and the delivering levers. In the electric stapler, if the sheet-staple cannot be delivered for the predetermined distance, the slip portion slides to stop the delivering plate from moving forward.

DETAILED DESCRIPTION OF THE EMBODIMENTS

Figure 1:
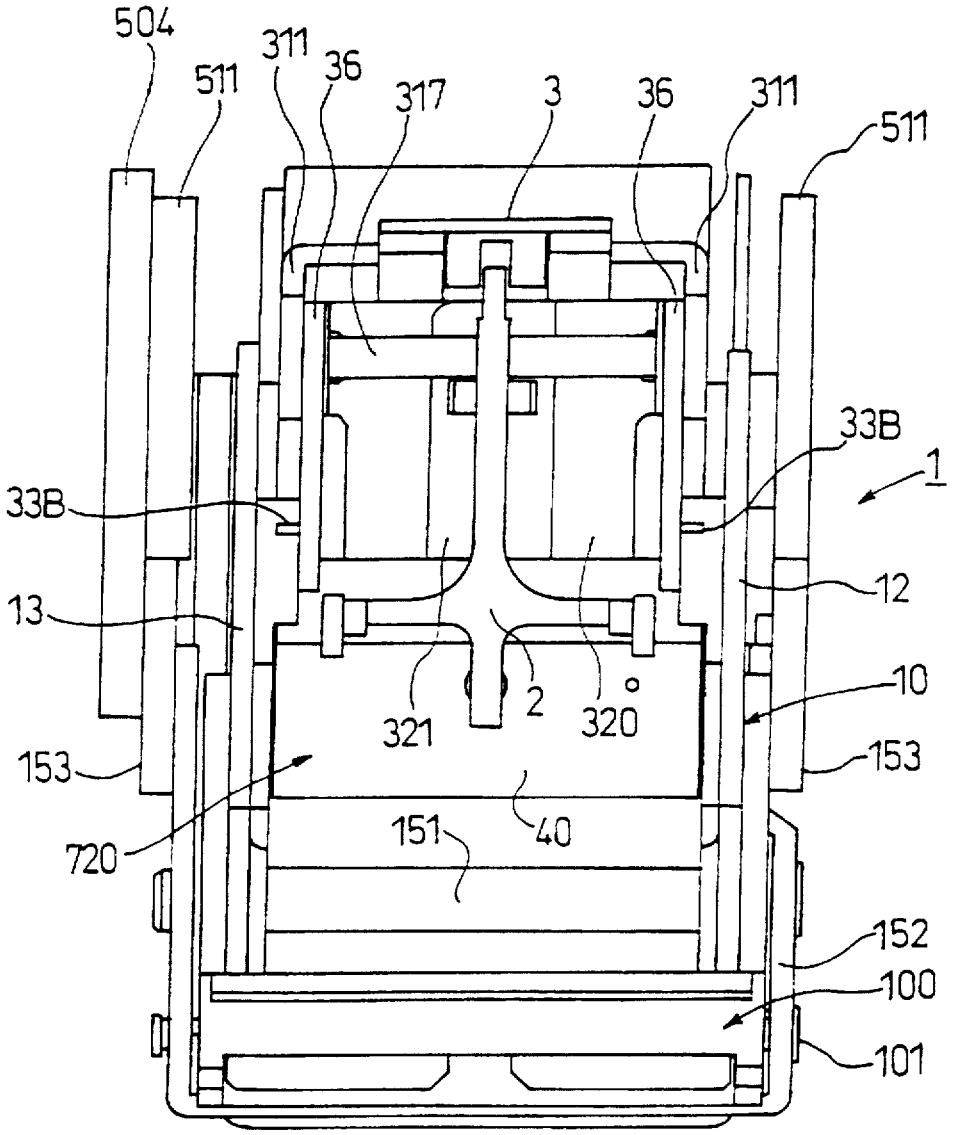
FIG. 1 is a front view showing the exterior appearance of an electric stapler according to the present invention.
Figure 2:
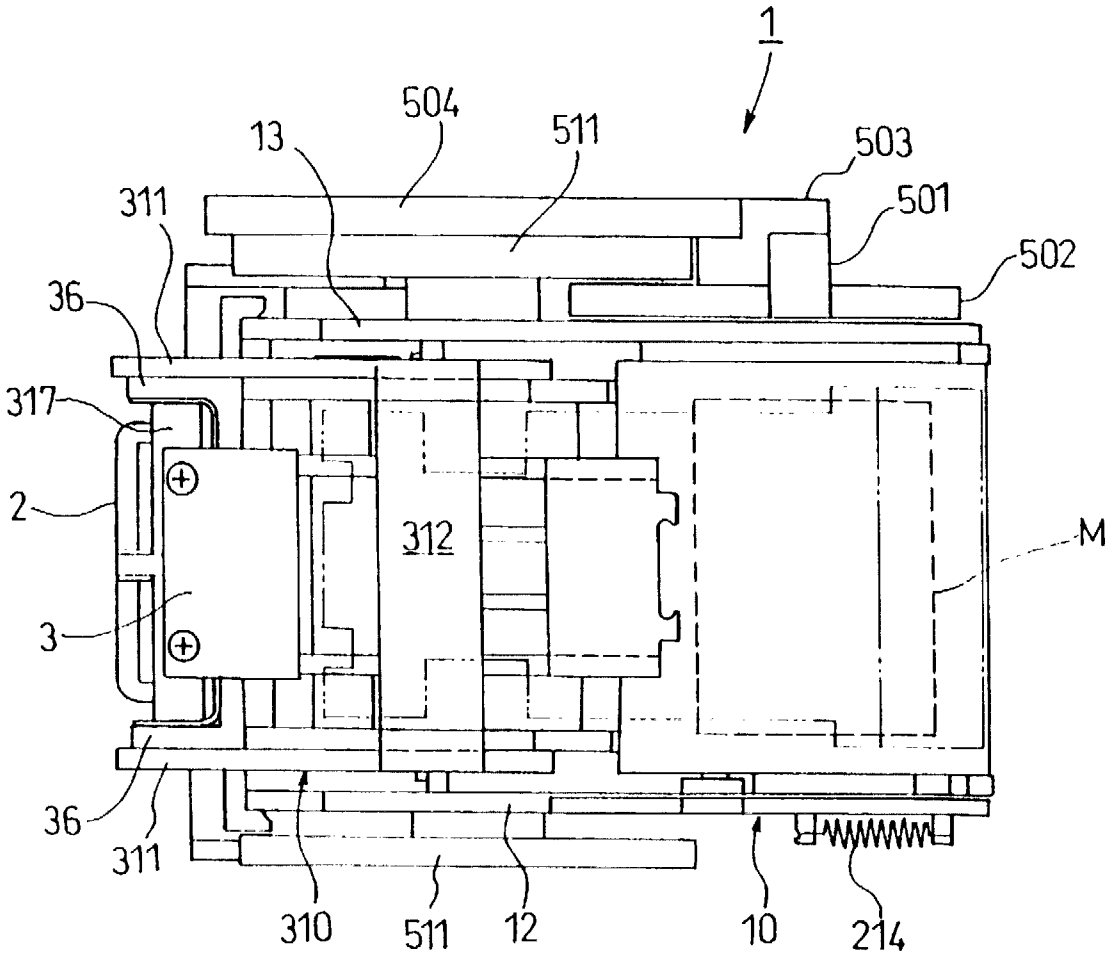
FIG. 2 is a plan view of the electric stapler shown in FIG. 1.

Embodiments of an electric stapler according to the present invention will be hereinafter described with reference to the accompanying drawings.

In FIGS. 1 to 5, reference numeral 1 designates an electric stapler attached to, for example, a copying machine or the like. The electric stapler 1 comprises a stapler body 10 and a cartridge 700 attached to a cartridge chamber 25 formed in the stapler body 10. The cartridge 700 is freely detachable therefrom.

Figure 38:
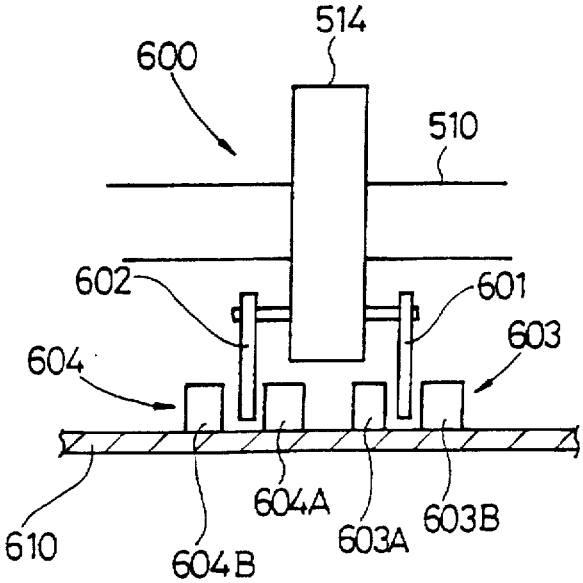
FIG. 38 is a front view showing the detecting mechanism.
Figure 39:
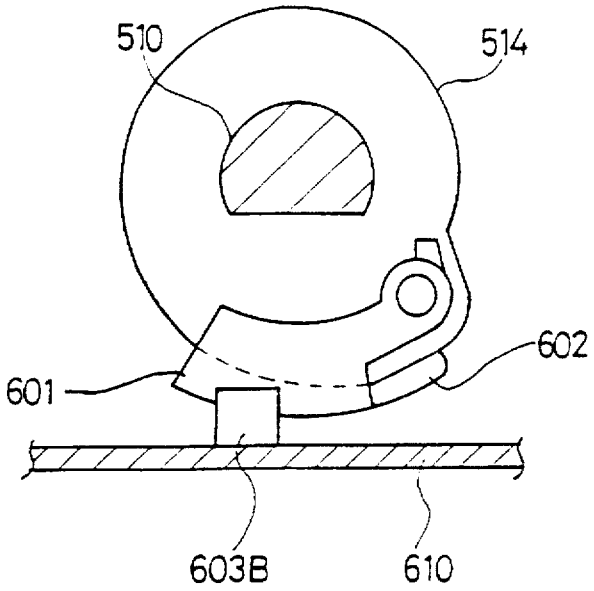
FIG. 39 is an enlarged view of FIG. 37.

In the stapler body 10, there are disposed a reciprocative table 100, a table mechanism 150 for reciprocating the table 100, a delivering mechanism 200 for delivering a pile of sheet-staples S contained in the cartridge 700 to a driving position 720 (see FIG. 31), a driving mechanism 300 for driving the sheet-staples S from the driving position 720, a clinching mechanism 400 for clinching the ends of the driven staple (see FIG. 22), a driving mechanism 500 for driving each of the mechanisms 150, 200, 300, and 400, and a detecting mechanism 600 for detecting the position of the table 100 (see FIG. 38). On the front side of the stapler body 10, there are disposed an actuator 2 for detecting that a U-shaped staple S1 is in an open space 725 (see FIG. 28) of the driving position 720, and a microswitch (not shown) for detecting that the staple S1 is in the open space 725 by the movement of the actuator 2. In this embodiment, the microswitch is mounted on a baseplate 3.

Figure 6:
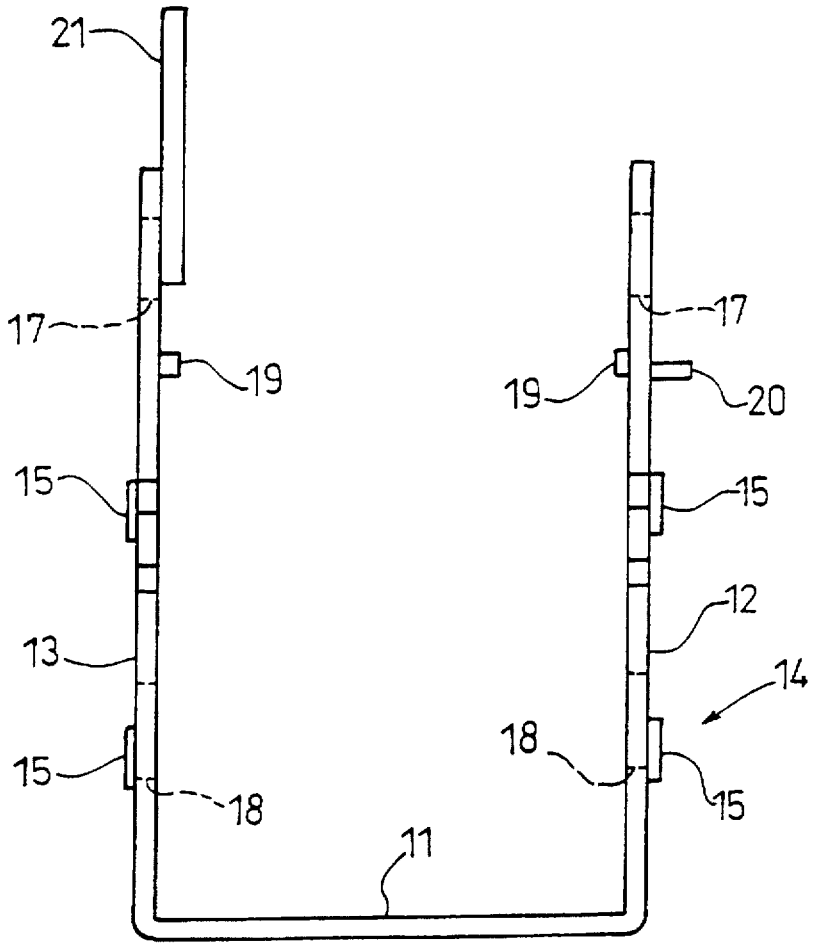
FIG. 6 is a front view showing a frame of a stapler body.
Figure 7:
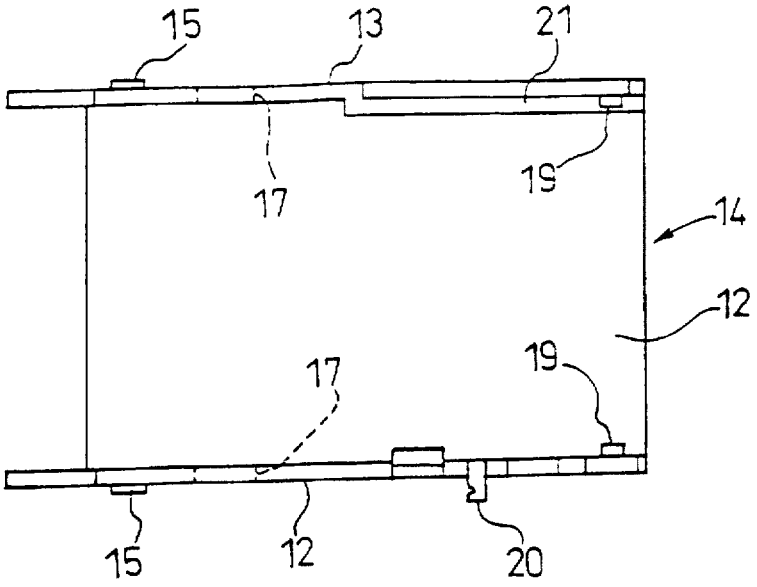
FIG. 7 is a plan view of the frame shown in FIG. 6.
Figure 8:
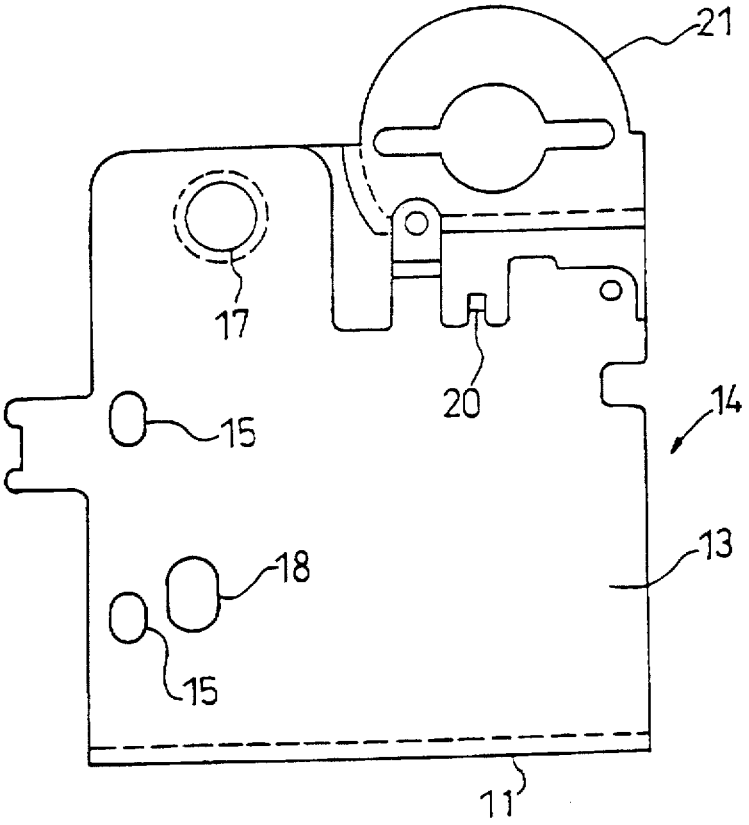
FIG. 8 is a right-hand side view of the frame shown in FIG. 6.
Figure 9:
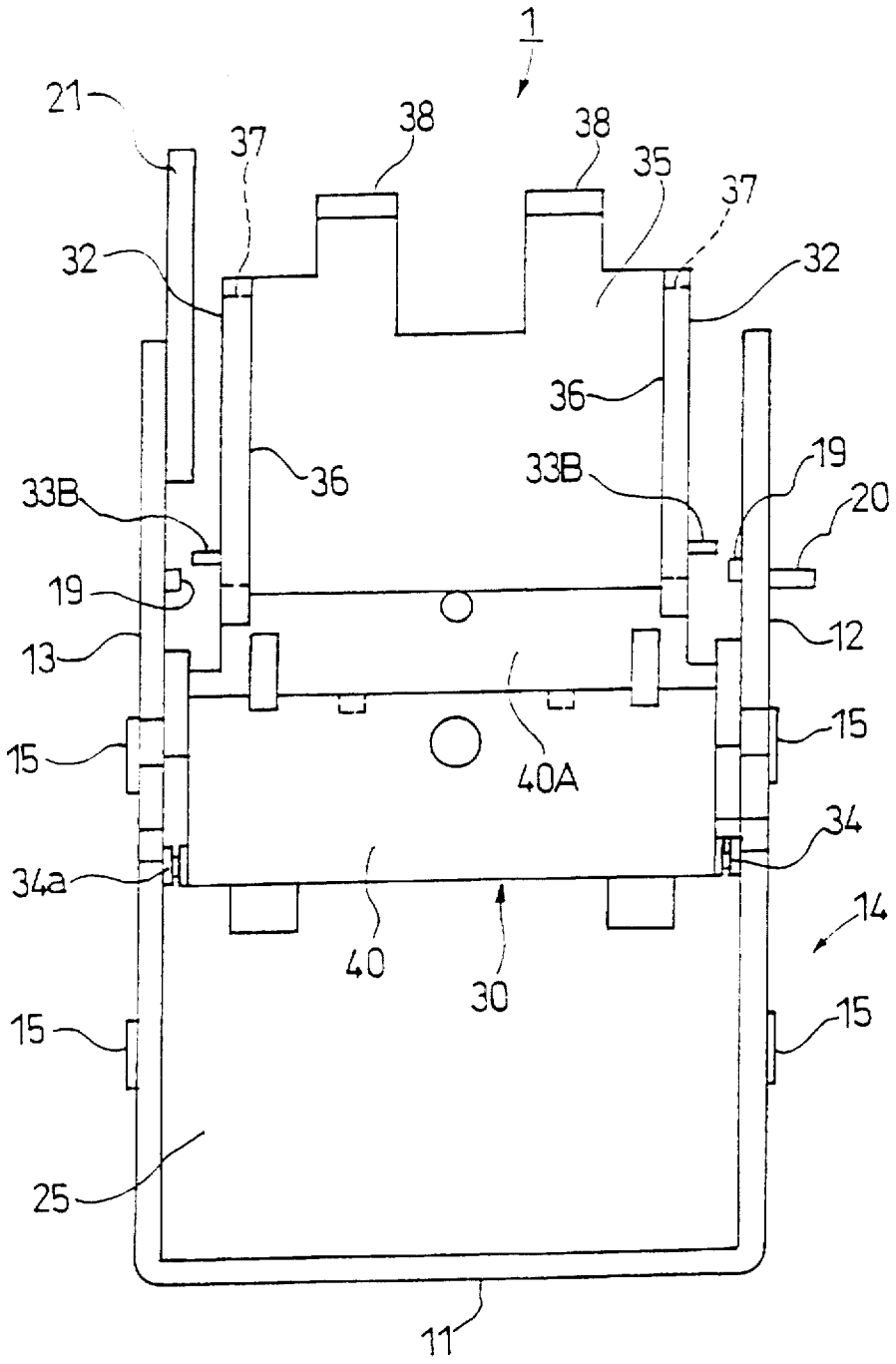
FIG. 9 is a front view of the frame of FIG. 6 and a magazine attached thereto.
Figure 10:
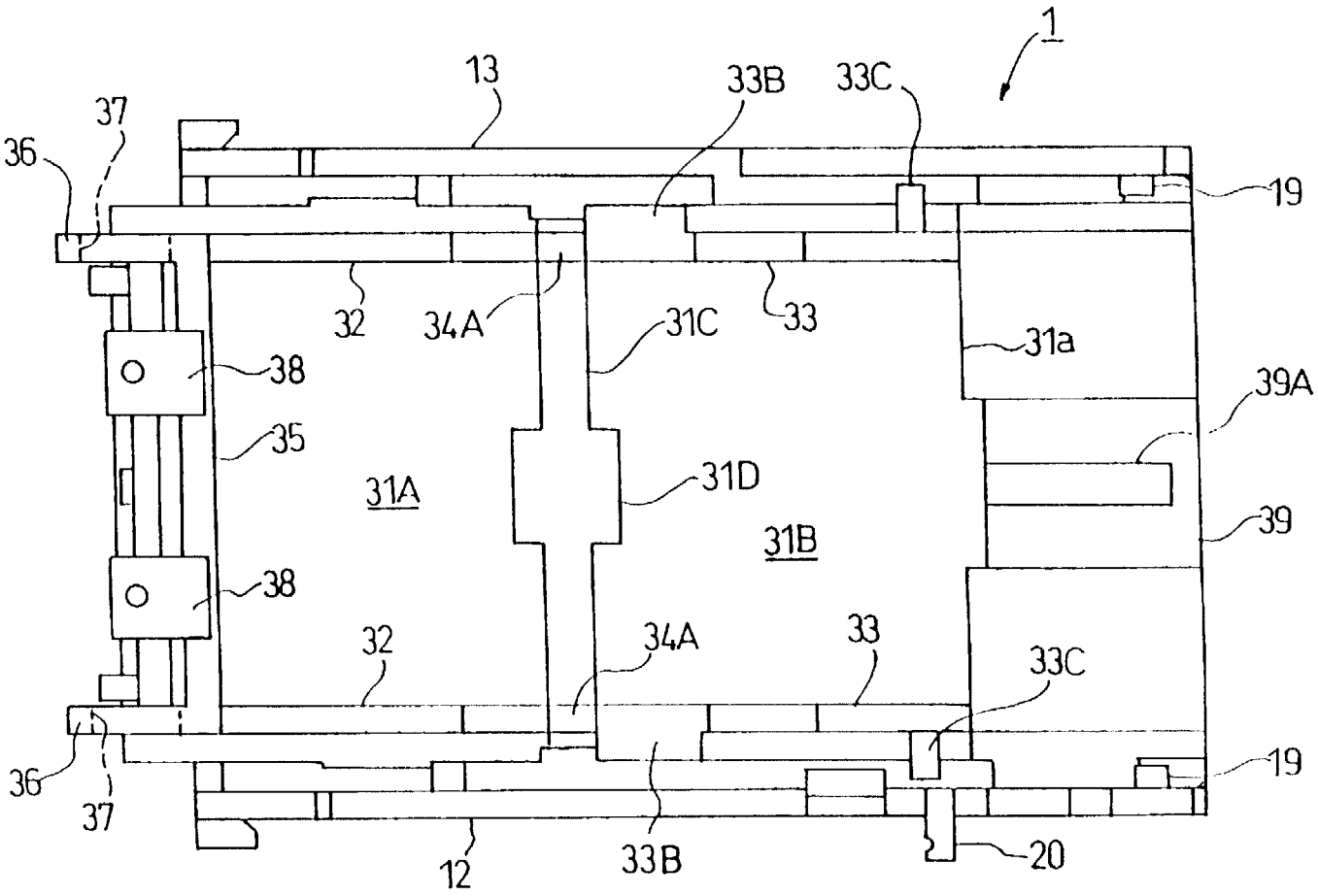
FIG. 10 is a plan view of the frame and the magazine which are shown in FIG. 9.
Figure 11:
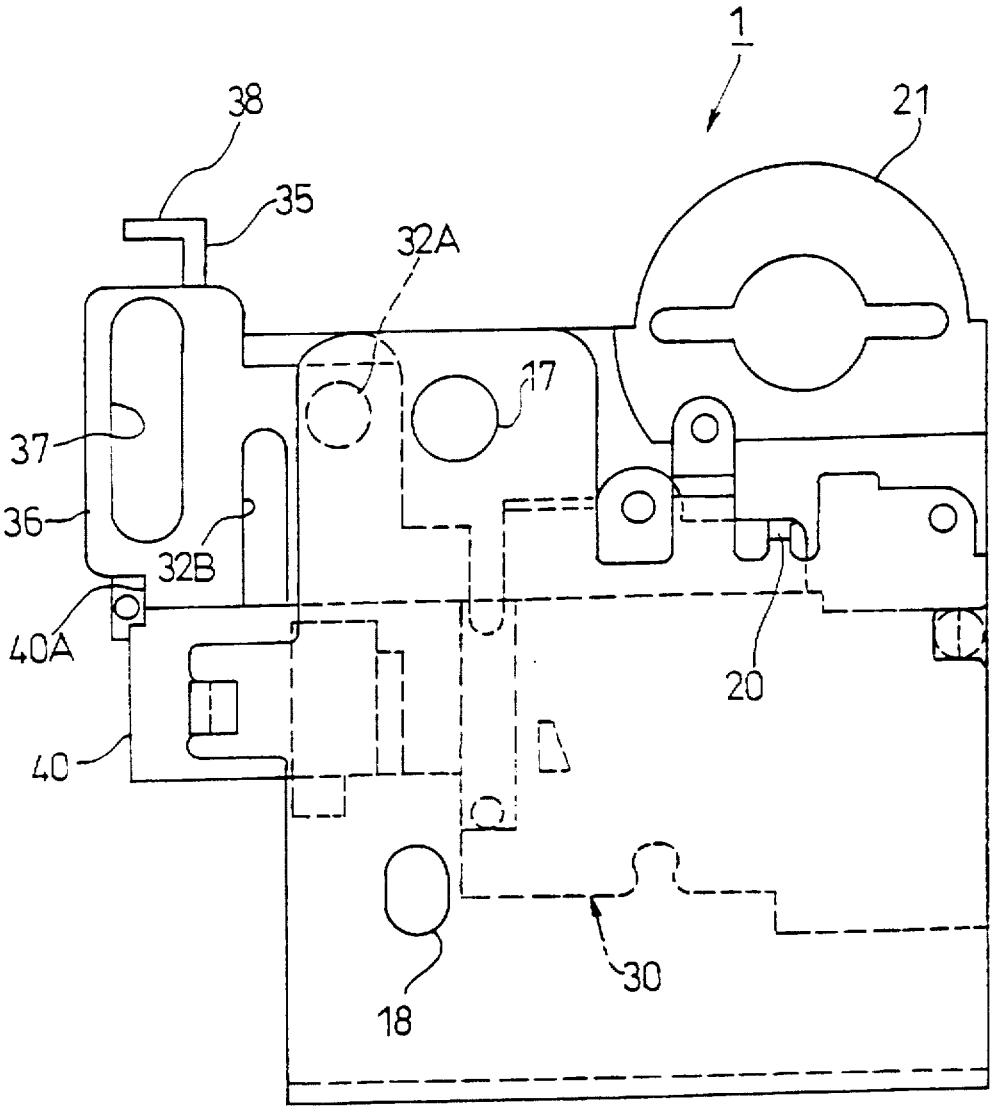
FIG. 11 is a right-hand side view of the frame and the magazine which are shown in FIG. 9.
Figure 12:
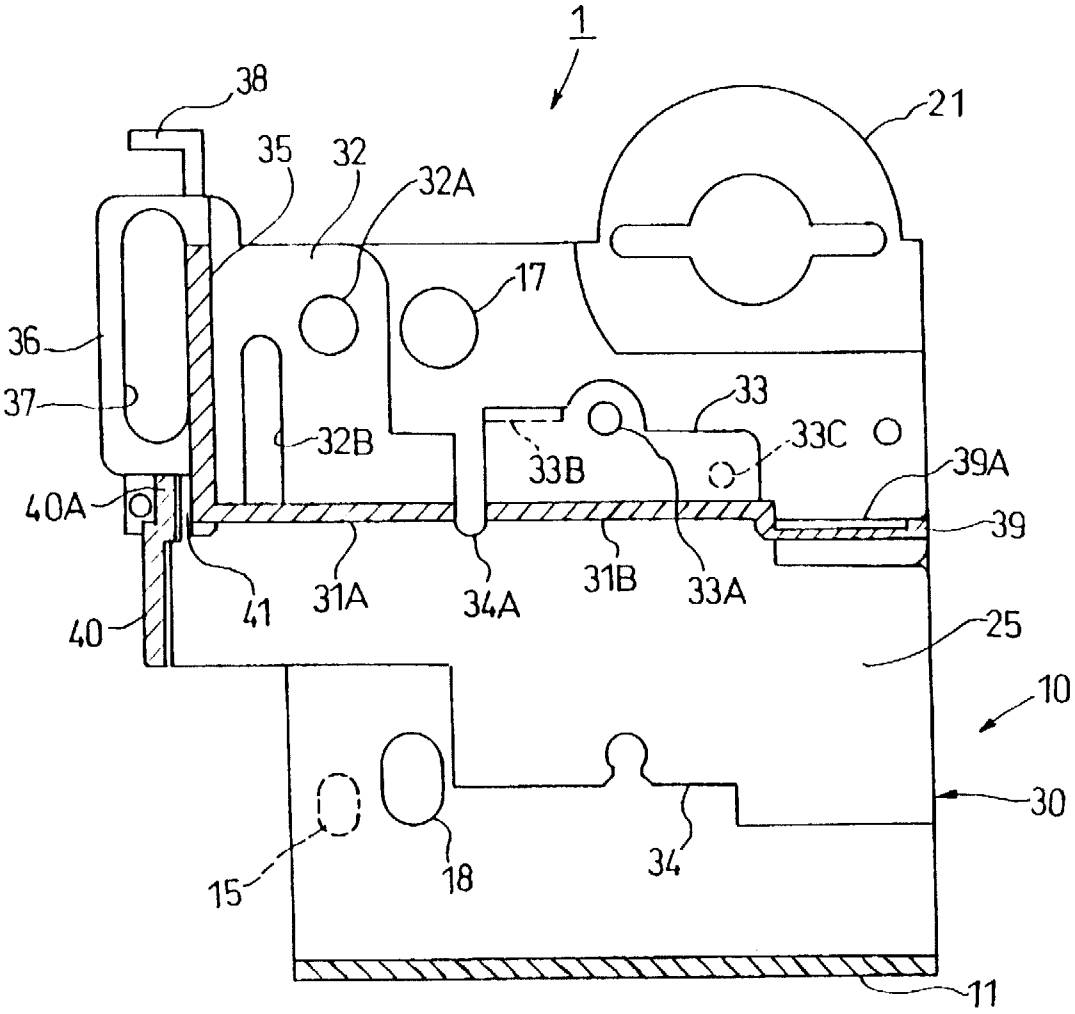
FIG. 12 is a sectional view of the frame and the magazine which are shown in FIG. 9.

The stapler body 10 is provided, as shown in FIGS. 6 to 8, with a metallic frame 14 which consists of a bottom plate 11 and side plates 12, 13 formed integrally with the bottom plate 11 at the each end of the bottom plate 11, respectively, and a resin-made magazine 30 attached to the frame 14 (see FIGS. 9 to 12).

Elliptic-cylindrical projections 15, 15 are formed parallel on a line of the upward and downward direction in the each outside surface of the side plates 12, 13 of the frame 14, respectively. A circular hole 17 for passing a drive shaft through is formed in the upper part of each of the side plates 12, 13, and a long hole 18 which extends in the upward and downward direction is formed at a lower position than the hole 17. A shaft 19 is formed in the right-hand and inside part of each of the side plates 12, 13. Further, a projection 20 for placing a spring on is formed in the right-hand side (the upper side in FIG. 6) of the side plate 12, and a plate portion 21 for attaching a motor M to is formed integrally in the rear side (the right-hand side in FIG. 8) and upper part of the side plate 13.

As shown in FIGS. 9 to 12, the magazine 30 has a pair of bottom walls 31A, 31B which define the cartridge chamber 25 in the frame 14. An open space 31C extends in the upward and downward direction (in FIG. 10) between the bottom walls 31A, 31B, and a square-shaped opening 31D is defined in the middle of the open space 31C. A pair of upper side walls 32 which are formed integrally with the bottom wall 31A extend in the upward direction (in FIG. 12) from the each side of the bottom wall 31A, respectively. Likewise, a pair of upper side walls 33 which are formed integrally with the bottom wall 31B extend in the upward direction from the each side of the bottom wall 31B, respectively. Open spaces with a predetermined width is defined between the upper side walls 32, 33 and the side plates 12, 13 of the frame 14. A circular hole 32A and a long hole 32B are formed in the each upper side wall 32, respectively. A circular hole 33A, a pressing portion 33B which projects outside, and a projection 33C are formed in the each upper side wall 33, respectively.

A pair of lower side walls 34, which are formed integrally with the bottom wall 31A, 31B at the each side thereof, respectively, extend in the downward direction to make a connection of the bottom walls 31A, 31B. Herein, the lower side walls 34 are in contact with the side plates 12, 13 of the frame 14 by the medium of contact portions 34*a*, respectively. In the upper part of the each lower side wall 34, a concave bearing 34A is formed between the bottom walls 31A, 31B, respectively.

In the front end (the left-hand end in FIG. 12) of the bottom wall 31A, an upper front wall 35 which extends in the upward direction is formed integrally therewith. A plate-like holding portion 36 is formed at the each end of the upper front wall 35, and a long hole 37 which extends in the upward and downward direction is formed in the each holding portion 36. Further, a flat baseplate-attaching portion 38 to which the baseplate 3 is attached is formed in the upper part of the upper front wall 35.

In the front side (the left-hand side in FIG. 12) of the each lower side wall 34, a lower front wall 40 is formed integrally therewith, and an open space 41 where a driver 321 and a forming plate 320 (mentioned later) are placed is defined between the upper part 40A of the lower front wall 40 and the lower part of the upper front wall 35. The lower front wall 40 comes in contact with a face plate 721 (mentioned later) of the cartridge 700, and thereby the positioning of the driving position 720 of the cartridge 700 is performed.

In the rear end 31*a* of the bottom wall 31*b*, a guiding plate 39 which extends in the backward direction is formed integrally therewith, and a guiding groove 39A which extends in the forward and backward direction is formed in the middle of the guiding plate 39.

[DRIVING MECHANISM 500]

Figure 13:
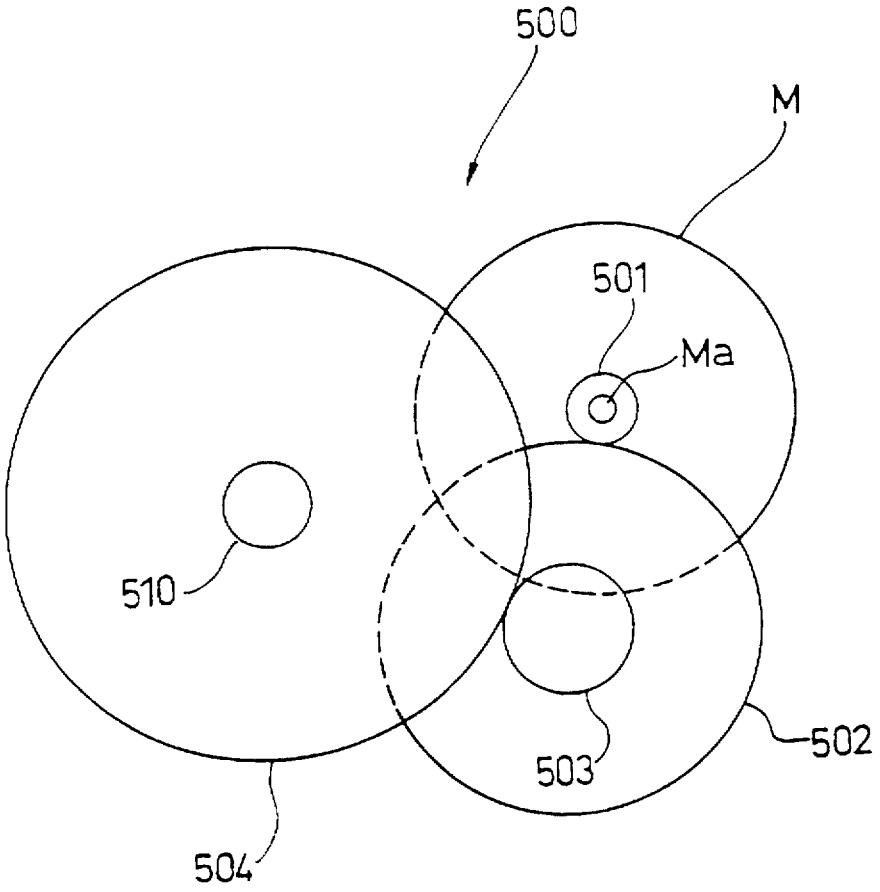
FIG. 13 is a descriptive drawing showing a driving mechanism.
Figure 14:
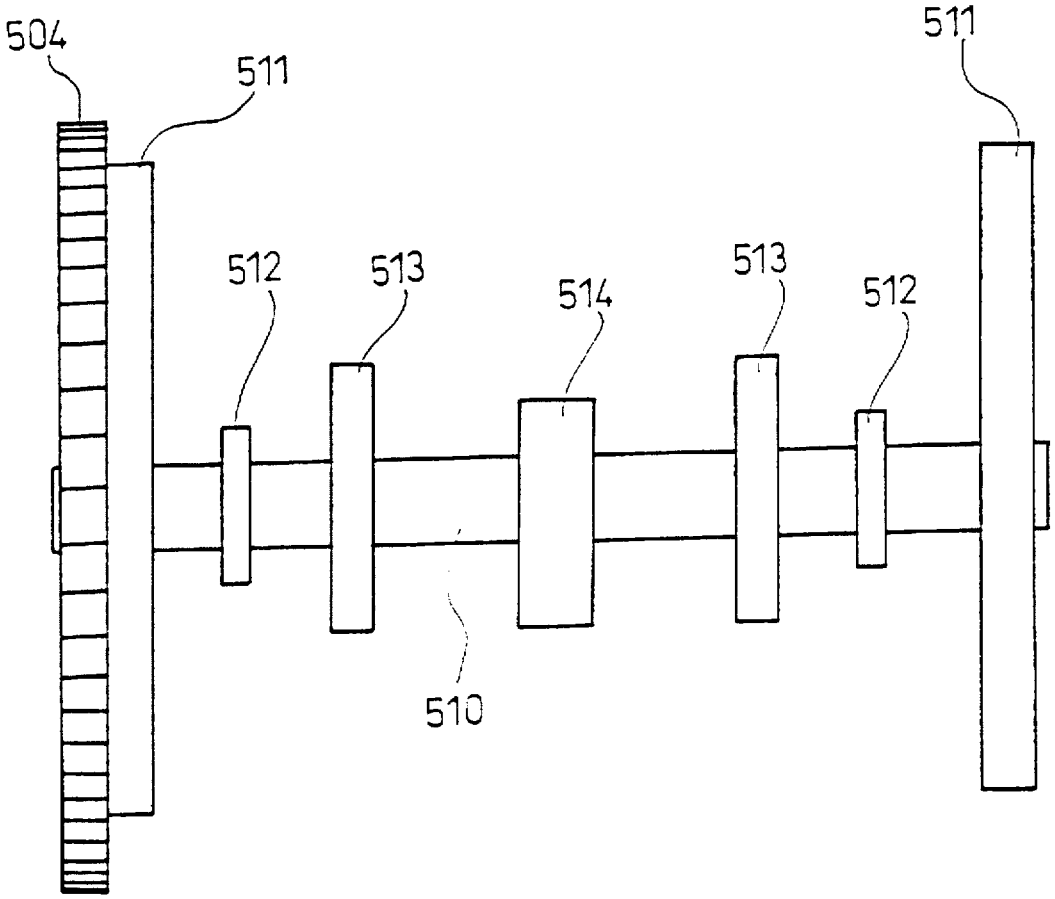
FIG. 14 is a descriptive drawing showing a cam attached to a cam driving shaft.

As shown in FIGS. 13 and 14, the driving mechanism 500 consists of the motor M attached to the body 10, a gear 501 attached to the driving shaft Ma of the motor M, intermediary gears 502, 503 engaged with the gear 501, a driving gear 504 engaged with the intermediary gear 503, and a cam driving shaft 510 rotated with the driving gear 504.

Figure 3:
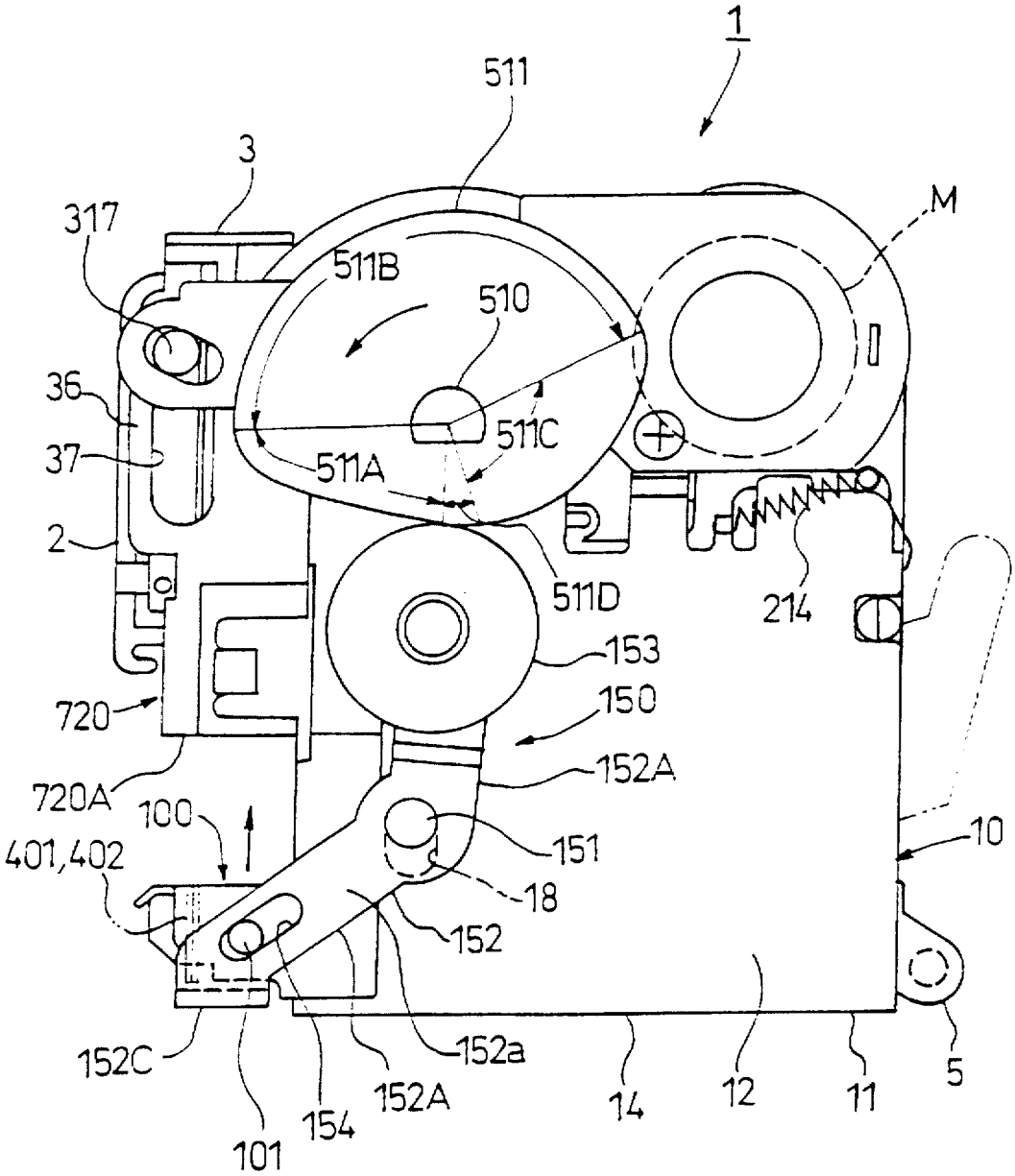
FIG. 3 is a right-hand side view of the electric stapler shown in FIG. 1.

The cam driving shaft 510 is rotated clockwise (in FIG. 4) by a drive of the motor M, which is transmitted through each of the gears 501 to 504 (being rotated counterclockwise in FIG. 3).

A pair of table cams 511, a pair of delivering cams 512, a pair of driving cams 513, and a clinching cam 514 are attached to the cam driving shaft 510.

Figure 15:
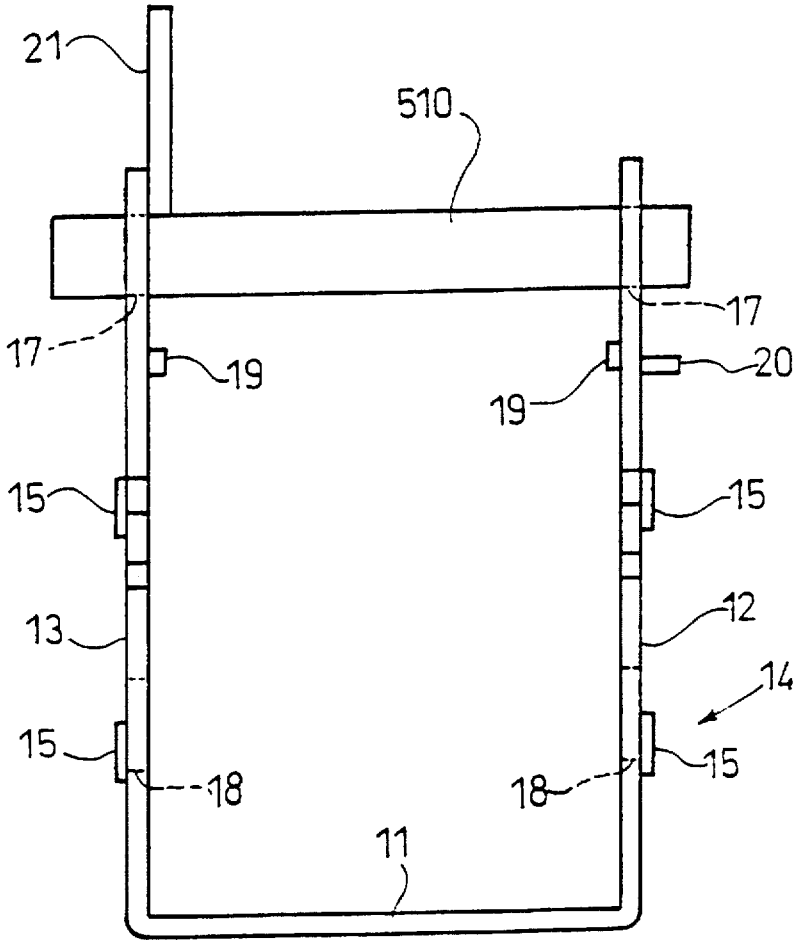
FIG. 15 is a front view showing the attachment of the cam driving shaft to the frame.
Figure 16:
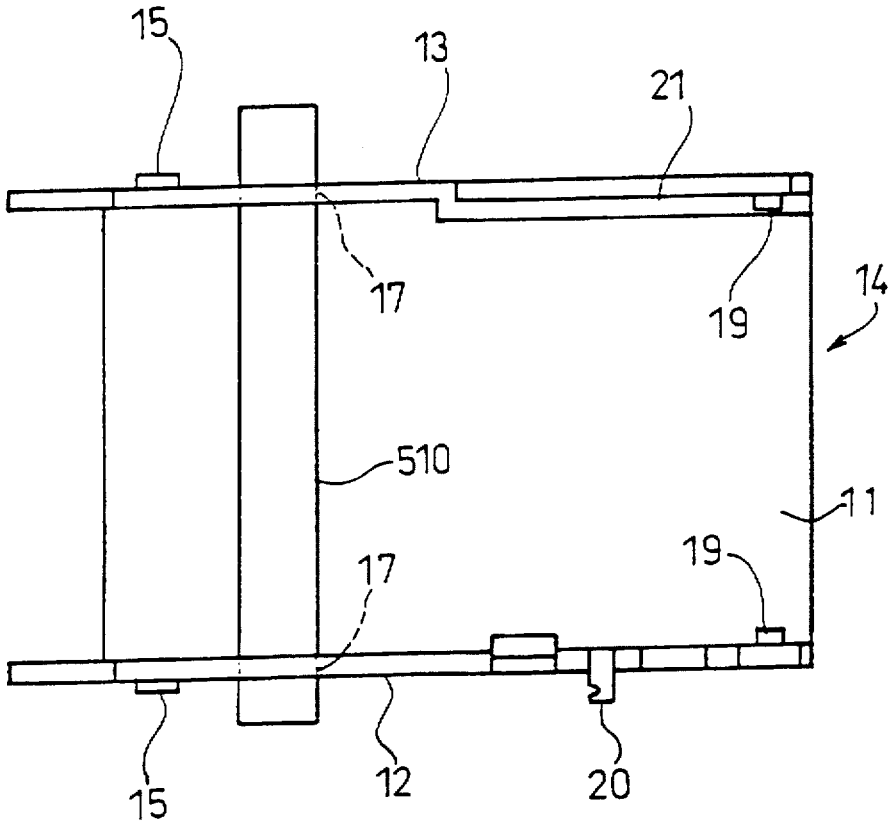
FIG. 16 is a plan view of FIG. 15.

As shown in FIGS. 15 and 16, both end parts of the cam driving shaft 510 are inserted through the holes 17 which are formed in the side plates 12, 13 of the frame 14, and thereby the cam driving shaft 510 is rotatably held. The intermediary gears 502, 503 are attached rotatably to the side plate 13 of the frame 14 (see FIG. 4).

Figure 4:
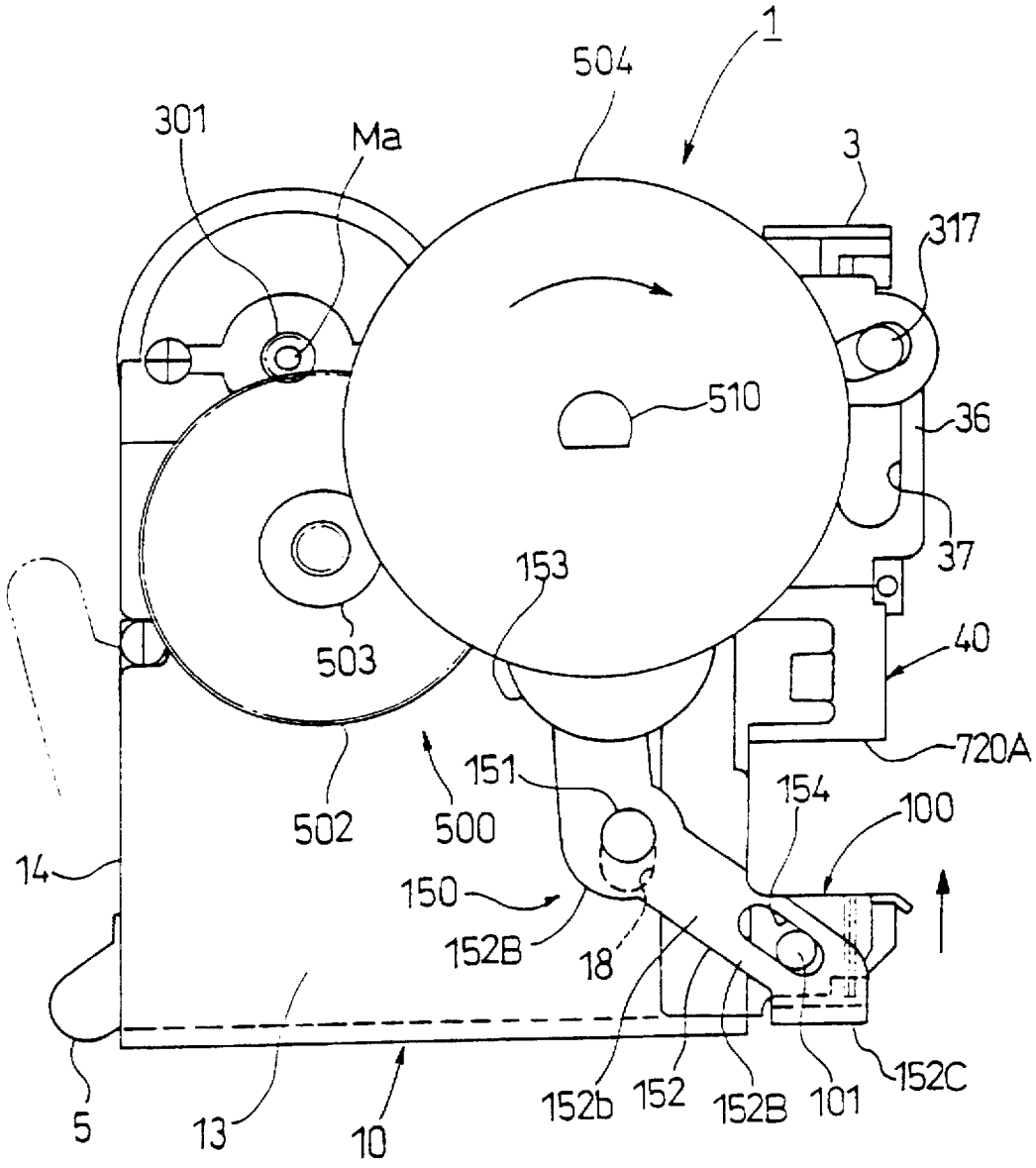
FIG. 4 is a left-hand side view of the electric stapler shown in FIG. 1.
Figure 17:
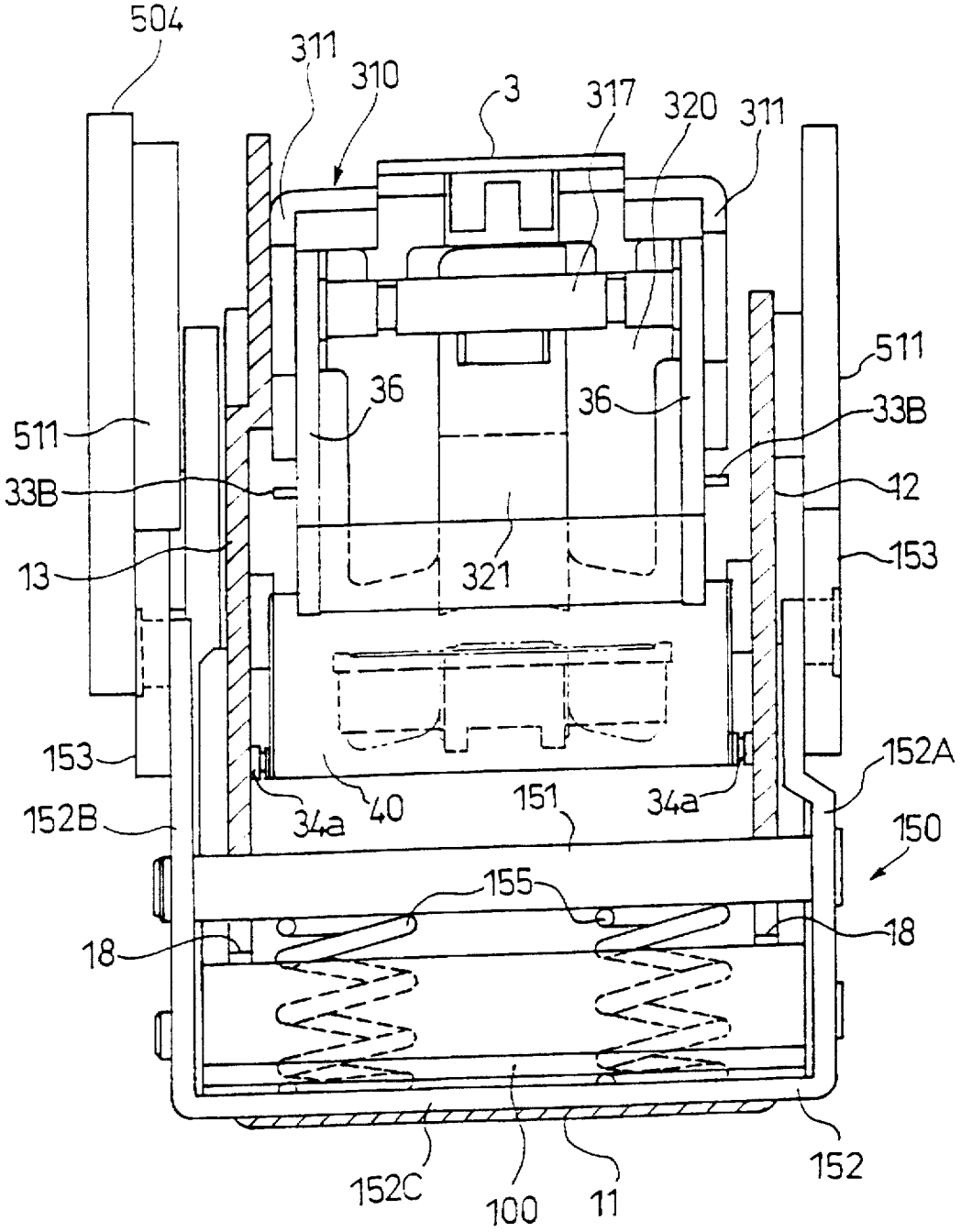
FIG. 17 is a front view of the stapler body partly omitted.
Figure 18:
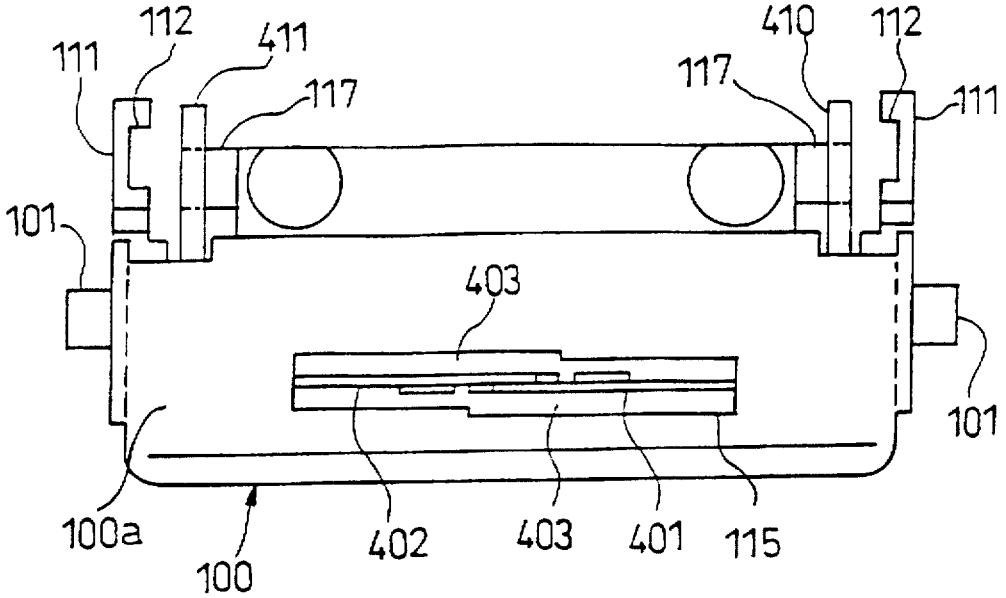
FIG. 18 is a plan view of a table.
Figure 19:
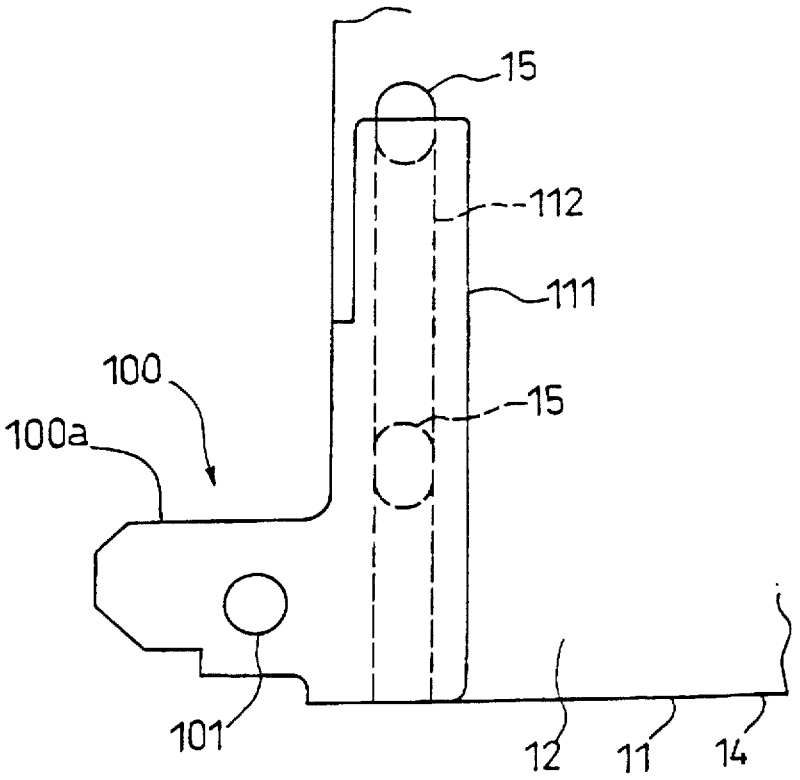
FIG. 19 is a side view of the table shown in FIG. 18.

The table 100 is attached reciprocatably to the stapler body 10, as shown in FIGS. 3, 4 and 17, so as to reciprocate (an up-and-down motion in FIGS. 3, 4 and 17) by the table mechanism 150.

[TABLE MECHANISM 150]

The table mechanism 150 consists of a linking shaft 151 which is inserted through the long holes 18 of the side plates 12, 13 of the frame 14 so as to move up and down, a linking member 152 which is pivoted on the linking shaft 151, the table can 511, and a roller 153 which is in contact with the circumferential surface of the table cam 511 and is attached rotatably to the upper part of the linking member 152 (in FIGS. 3 and 4). The linking member 152 is pressed counterclockwise (in FIG. 3) by a spring (not shown) such that the roller 153 comes in contact with the circumferential surface of the table cam 511.

As shown in FIG. 3, the table cam 511 has an enlarging portion 511A whose radius becomes larger, a large-radius portion 511B whose radius becomes maximum and constant, a reducing portion 511C whose radius becomes smaller, and a small-radius portion 511D whose radius becomes minimum, as rotating counterclockwise.

The linking member 152 is constituted by side plate portions 152A, 152B which hold fixedly both ends of the linking shaft 151, and a connecting plate portion 152C which is connected with both lower ends of the side plate portions 152A, 152B. Arm portions 152*a*, 152*b* which extend toward the table 100 in the forward and oblique direction of the side plate portions 152A, 152B are formed in the lower parts of the side plate portions 152A, 152B than the linking shaft 151. A long hole 154 which extends along the arm portions 152*a*, 152*b* is formed in each of the arm portions 152*a*, 152*b*. A shaft 101 attached to the table 100 is inserted rotatably through the long holes 154, and the linking member 152 is pivoted clockwise (in FIG. 3) on the linking shaft 151, and thereby the table 100 rises in the direction of an arrow.

The table 100 is in a home position (an initial position) shown in FIGS. 3 and 4 when the roller 153 is in contact with the circumferential surface of the small-radius portion 511D of the table cam 511, and then the table 100 rises as the roller 153 comes in contact with the circumferential surface of the enlarging portion 511A of the table cam 511. Next, the table 100 comes in contact with an under surface of the driving position 720 as the roller 153 comes in contact with the circumferential surface of the large-radius portion 511B, and thereafter the table 100 lowers as the roller 153 comes in contact with the circumferential surface of the reducing portion 511C.

The linking shaft 151 is always pressed upward (in FIG. 17) by the force of a spring 155 so as to be positioned in the upper part of the long holes 18. The linking shaft 151 is brought downward along the long holes 18 against the force of the spring 155 in the case where sheets T of paper to be fastened together is thick. Thereby, the table cam 511 is rotated smoothly regardless of a thickness of the sheets T.

[TABLE 100]

As shown in FIGS. 18 to 21, an upper surface 100*a* of the table 100 is formed flat, and guiding portions 111 which extend upward are disposed on both sides behind the table 100. A guiding groove 112 which extends upward is formed in the guiding portion 111, and the projection 15 formed in each of the side plates 12, 13 of the frame 14 is engaged with the guiding groove 112. The engagement of the guiding groove 112 with the projection 15 allows the table 100 to move up and down without changing a predetermined position.

Inside the table 100, clinchers 401, 402 are disposed through the intermediary of a holder 403. The clinchers 401, 402 are pivoted in the direction of an arrow (in FIG. 20) on shafts 404, 405, and thereby the end parts of a staple which come into openings 115 formed in the upper surface 100*a* of the table 100 are bent into a flat shape.

[CLINCHING MECHANISM 400]

Figure 20:
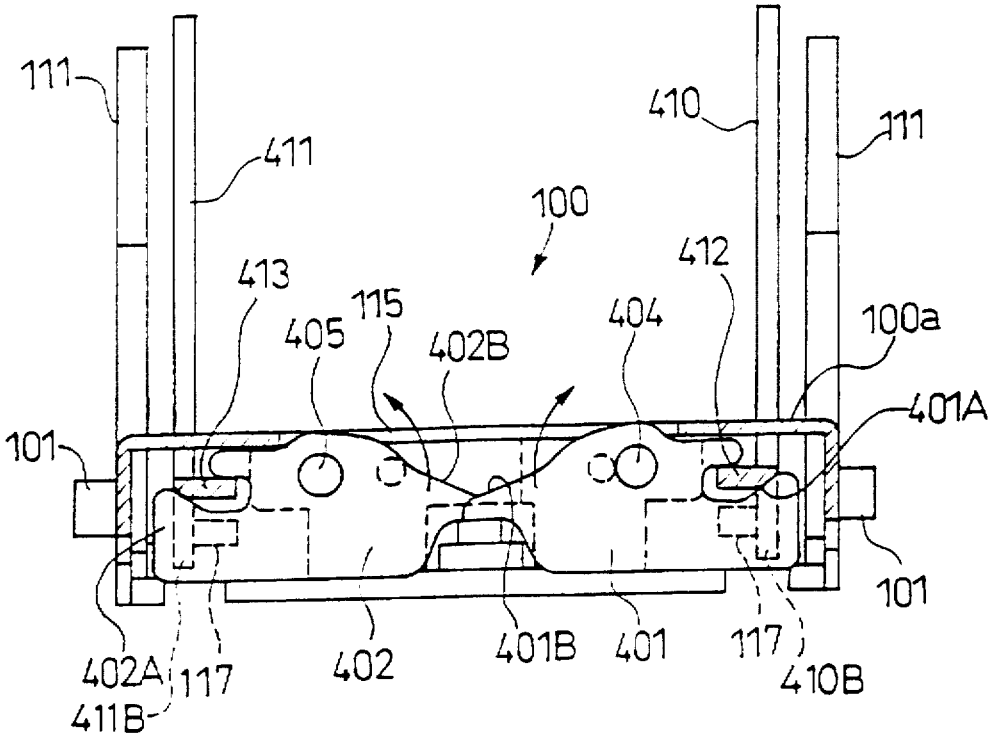
FIG. 20 is a longitudinal sectional view of the table shown in FIG. 18.
Figure 21:
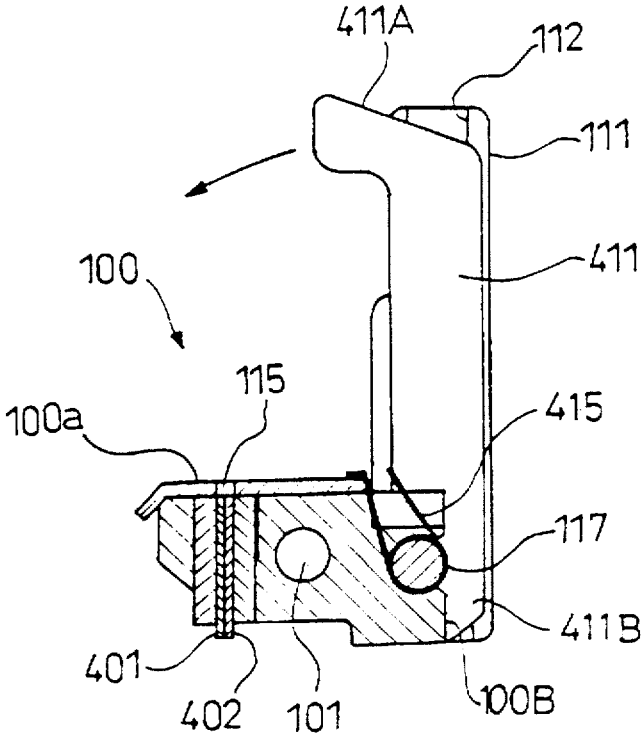
FIG. 21 is a transverse sectional view of the table shown in FIG. 18.
Figure 22:
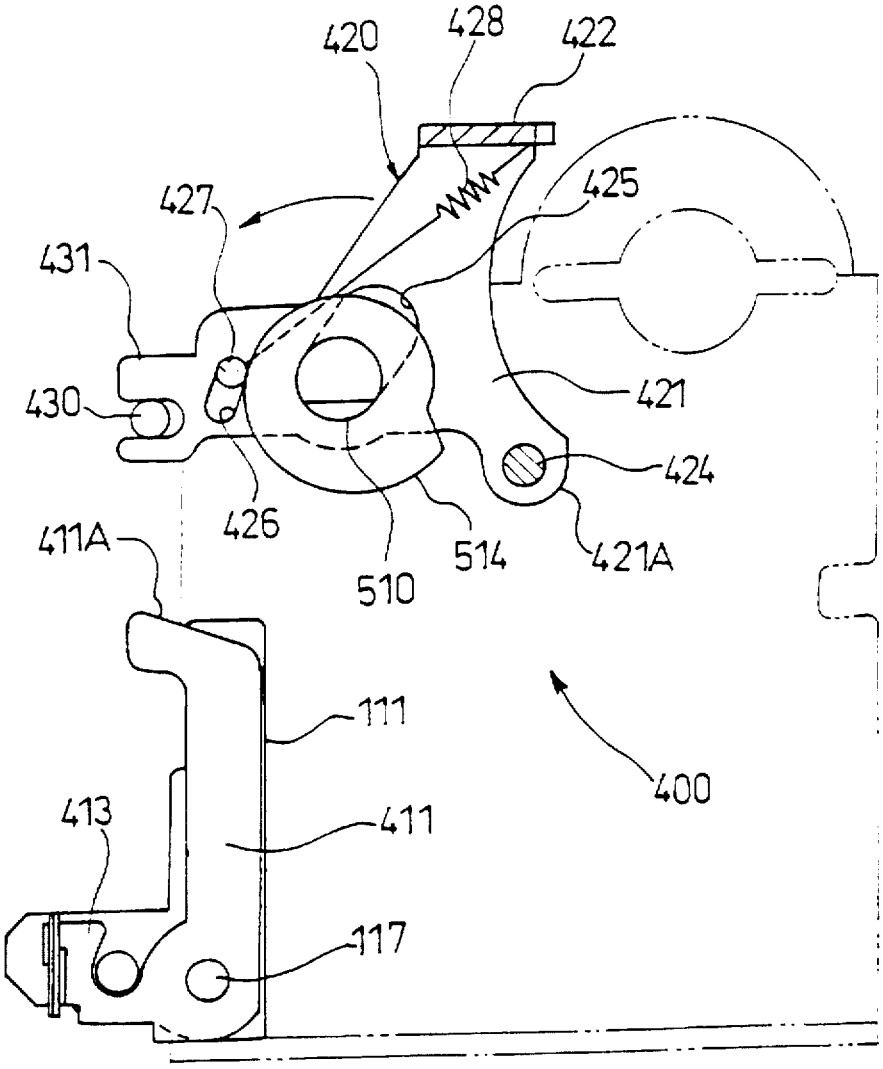
FIG. 22 is a descriptive drawing showing a clinching mechanism.

Reference numerals 410, 411 shown in FIGS. 20 to 22 designates clinching operation members which extend in the upward and downward directions, and in the lower part thereof there are formed pressing portions 412, 413. The pressing portions 412, 413 are in contact with the rear parts 401A, 402A of the clinchers 401, 402, respectively. The clinching operation members 410, 411 are pivoted in the direction of an arrow (in FIG. 21) on a shaft 117 which is disposed in the rear part of the table 100. The lower end portions 410B, 411B of the clinching operation members 410, 411 are in contact with the rear surface 100B of the table 100, so that the clinching operation members 410, 411 are controlled not to be pivoted clockwise (in FIG. 21). Since pressed clockwise (in FIG. 21) by the force of a twisted coil spring 415, the clinching operation members 410, 411 are always in an erected state.

The rear parts 401A, 402A of the clinchers 401, 402 are pressed down by the pressing portions 412, 413 of the clinching operation members 410, 411 when the clinching operation members 410, 411 are pivoted counterclockwise (in the direction of an arrow in FIG. 21) against the twisted coil spring 415. Thereby, the clinchers 401, 402 are pivoted in the direction of an arrow shown in FIG. 20 on the shafts 404, 405 so that the end parts of a staple are clinched by clinching portions 401B, 402B.

The clinching operation members 410, 411 moves upward and downward in an erected state by an up-and-down motion of the table 100, and in the upper end part of the clinching operation members 410, 411, there are formed inclined surfaces 410A, 411A.

Figure 23:
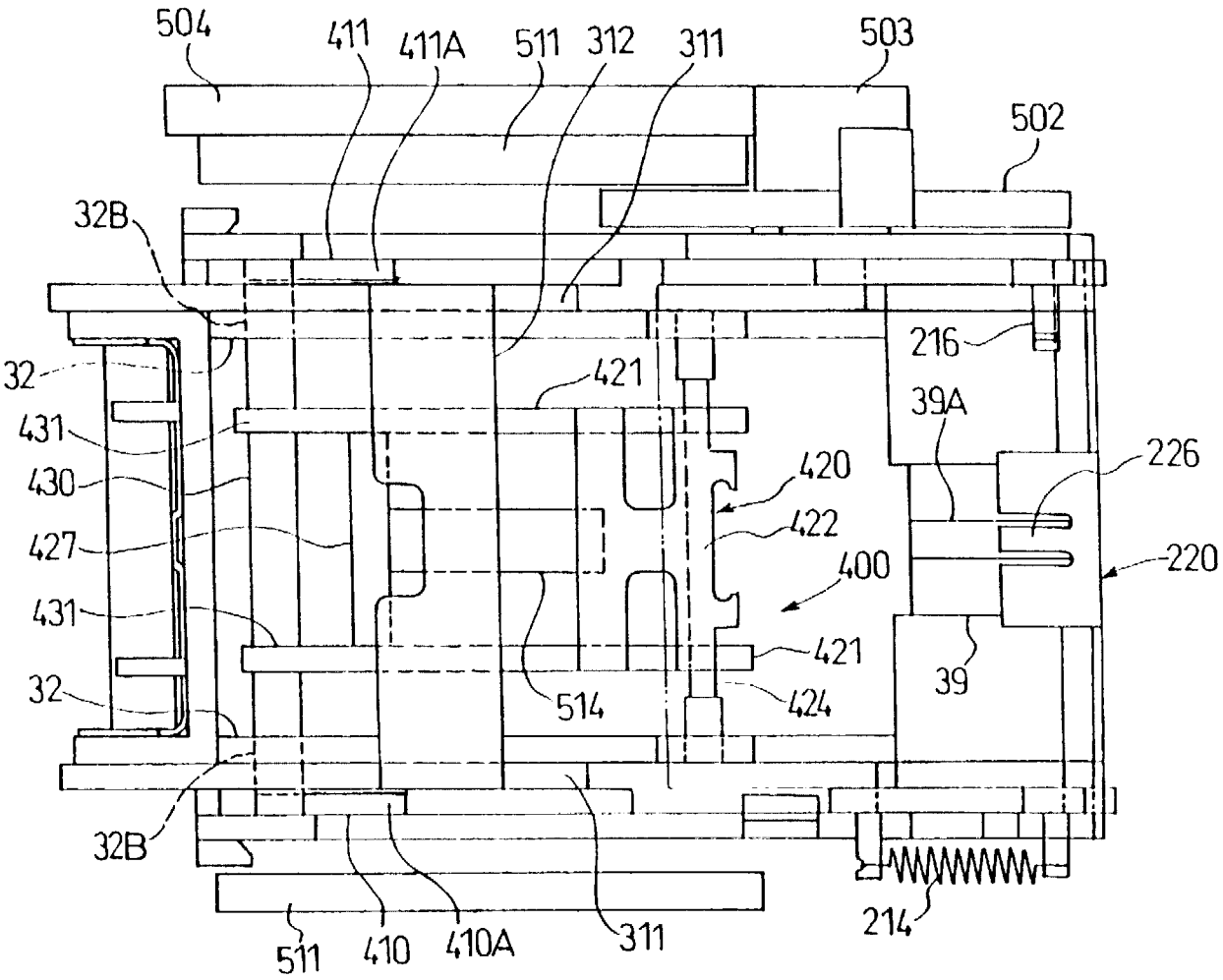
FIG. 23 is a plan view showing a clinching mechanism.

As shown in FIGS. 22 and 23, the clinching mechanism 400 consists of the clinching cam 514, a clinching link 420, the clinching operation members 410, 411, the clinchers 401, 402, etc. The clinching link 420 is rotated clockwise (in FIG. 22) by the force of a spring (not shown) such that a shaft 427 mentioned later always comes in contact with the circumferential surface of the clinching cam 514.

The clinching link 420 has a pair of side plate portions 421, and a connecting plate portion 422 with which the upper parts of the pair of side plate portions 421 are connected, respectively.

The rear portions 421A of the side plate portions 421 are put on a shaft 424 which is inserted through the holes 33A of the upper side walls 33 of the magazine 30. Long holes 425 which are inserted through the driving shaft 510 are formed in both side plate portions 421, and the clinching link 420 can be pivoted in the direction of an arrow on the shaft 424 due to the long holes 425.

In the side plate portions 421, long holes 426 are formed in front of the long holes 425. As shown in FIG. 23, the end parts of a shaft 427 are inserted through the long holes 426, and the shaft 427 is in contact with the circumferential surface of the clinching cam 514 attached to the driving shaft 510. Springs 428 are laid between the shaft 427 and the connecting plate portion 422 so as to press the shaft 427 to the upper parts of the long holes 426.

In the end parts of the side plate portions 421, there are formed nipping portions 431 between which a shaft 430 is held, and the end parts of the shaft 430 penetrates and projects through the long holes 32B outward from the upper side walls 32 of the magazine 30. Herein, the end parts of the shaft 430 are disposed above the upper surfaces 410A, 411A of the clinching operation members 410, 411 (see FIG. 23).

Figure 24:
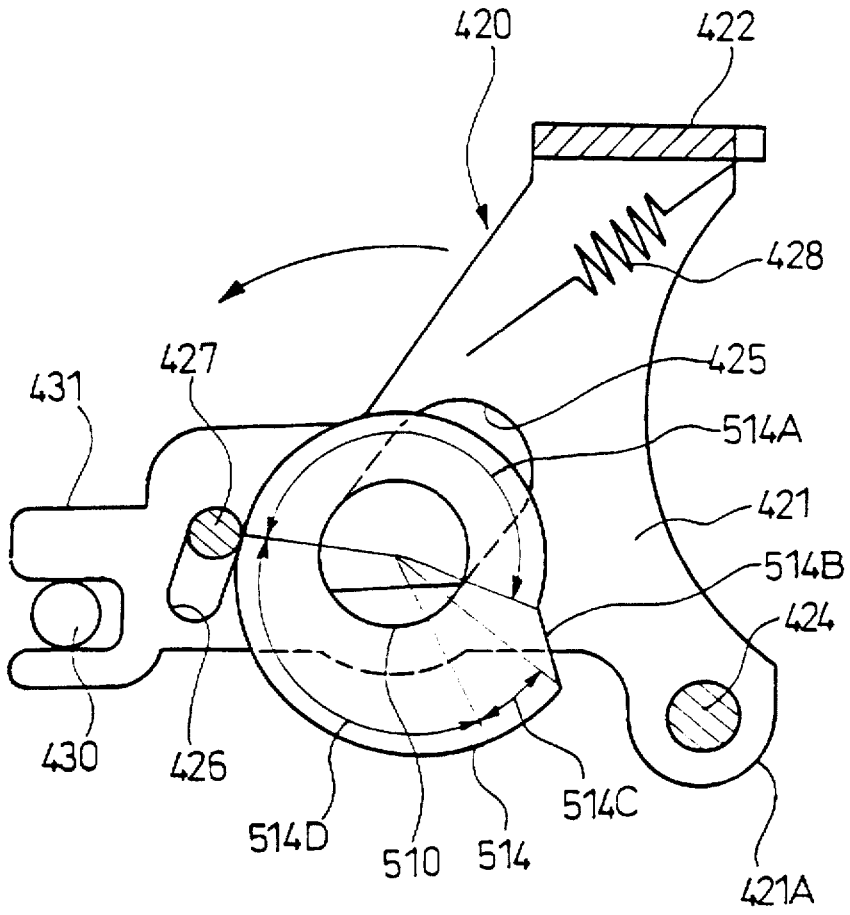
FIG. 24 is a descriptive drawing showing a clinching link and a clinching cam.
Figure 25:
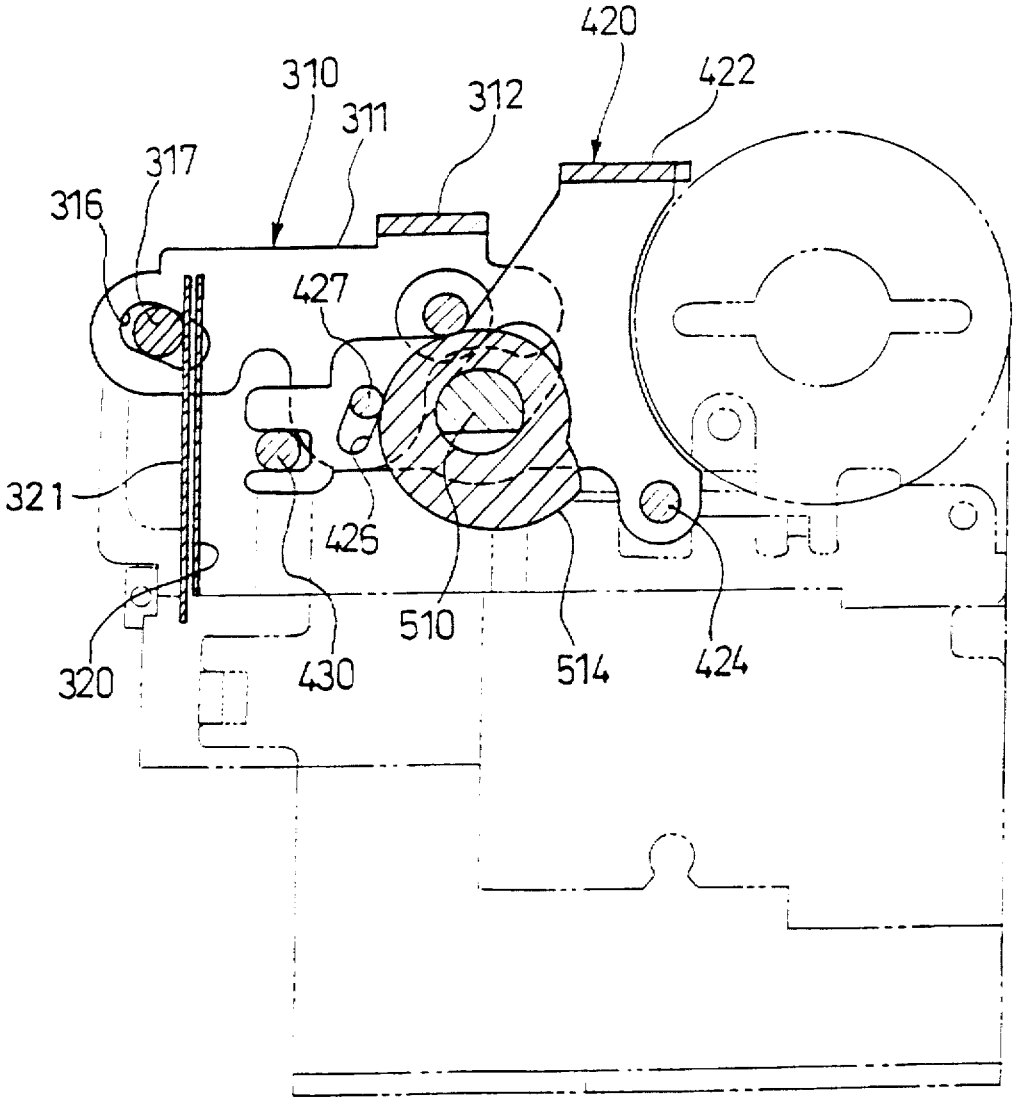
FIG. 25 is a descriptive drawing showing the positional relationship between the clinching link and a driving link.
Figure 26:
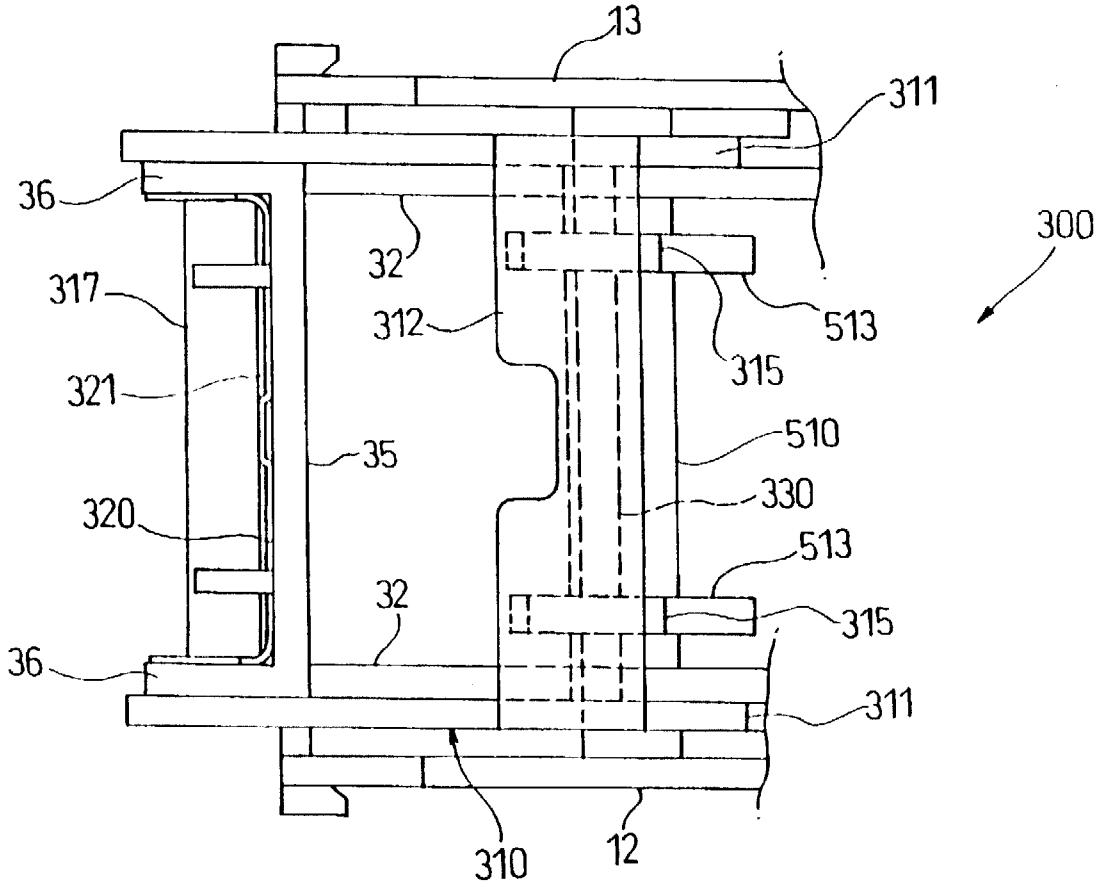
FIG. 26 is a plan view showing a driving mechanism.
Figure 27:
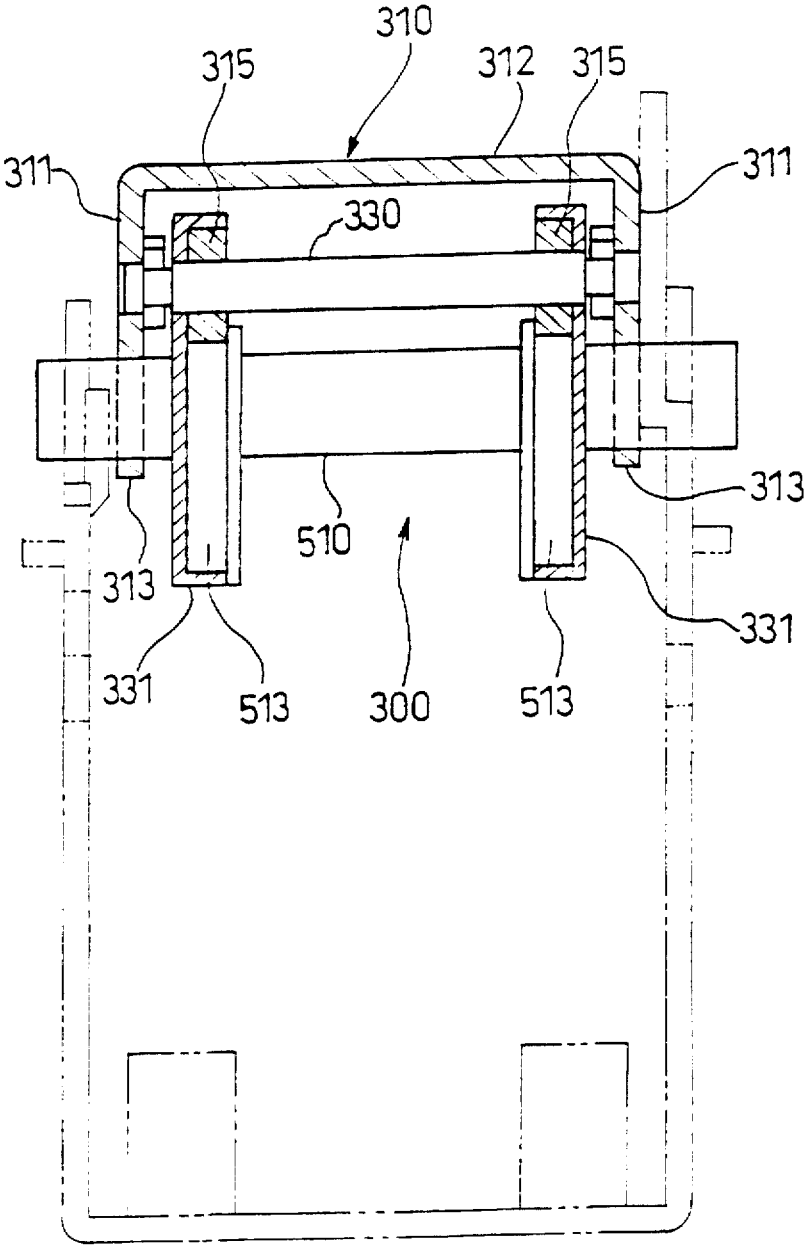
FIG. 27 is a rear view showing the driving mechanism.

As shown in FIG. 24, the clinching cam 514 has a small-radius portion 514A whose radius becomes minimum, a difference-in-level portion 514B, a large-radius portion 514C whose radius becomes maximum, a reducing portion 514D whose radius becomes smaller. The clinching link 420 is pivoted in the direction of an arrow (counterclockwise) on the shaft 424 along with the rotation of the clinching cam 514 when the clinching cam 514 is rotated counterclockwise and the difference-in-level portion 514B comes in contact with the shaft 427.

The shaft 430 held on the nipping portions 431 moves downward along the long holes 32B of the upper side walls 32 of the magazine 30 as the clinching link 420 is pivoted counterclockwise. The inclined surfaces 410A, 411A of the clinching operation members 410, 411 are pressed downward when the shaft 430 moves downward. Thereby, the clinching operation members 410, 411 are pivoted counterclockwise on the shaft 117 so that the clinchers 401, 402 are pivoted to clinch a stapler.

[DRIVING-OUT MECHANISM 300]

As shown in FIGS. 25 to 29, the driving-out mechanism 300 is constructed of the driving cams 513 which are attached to the driving shaft 510, and driving links 310. The driving link 310 is returned forcibly by a cam cover 331. A roller 315, mentioned later, is in contact with the circumferential surface of the driving cam 513.

The driving cam 513 has a small-radius portion 513A whose radius becomes minimum, an enlarging portion 513B whose radius becomes larger, a large-radius portion 513C whose radius becomes maximum, and a reducing portion 513D whose radius becomes smaller.

The driving link 310 has a pair of side plate portions 311, and a connecting plate portion 312 with which the upper part of the each side plate portions 311 is connected. A pivoted portion 313 which projects downward is formed in the lower part of the each side plate portion 311, and the pivoted portion 313 is pivoted on a shaft 314 which is inserted through the holes 32A of the upper side walls 32 of the magazine 30. Thus, the driving link 310 can be rotated on the shaft 314.

A shaft 330 is disposed between and behind the side plate portions 311, and the roller 315 in contact with the circumferential surface of the driving cam 513 is disposed rotatably on the shaft 330. A long hole 316 is formed in the front part of the each side plate portion 311. The each end part of a driving shaft 317 which is inserted through the long holes 37 of the holding portions 36 of the magazine 30 is inserted into each of the long holes 316, and thus the driving shaft 317 is held by the side plate portions 311 such that the driving shaft 317 reciprocates along the long holes 37 by the pivotal movement of the driving link 310. Reference numeral 331 designates a cover which covers the roller 315 and the driving cam 513.

Figure 30:
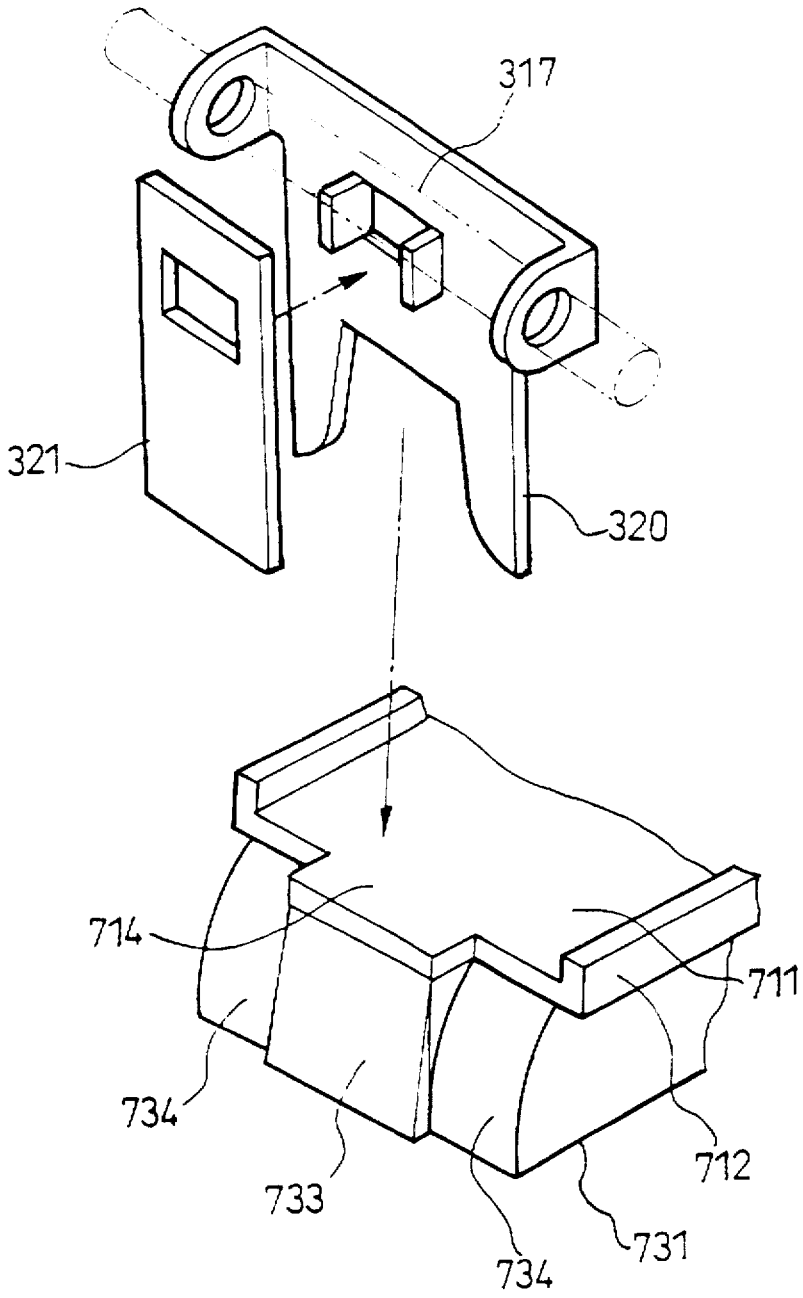
FIG. 30 is a perspective view for explaining how a staple is formed U-shaped by a forming plate.

As shown in FIG. 30, a forming plate 320 is attached to the driving shaft 317, and a driver 321 is attached to the forming plate 320. The forming plate 320 and the driver 321 reciprocate along with the driving shaft 317.

The forming plate 320 moves downward in a state of straddling a projected portion which is formed in the front end of a staple guide mentioned later. A staple which is delivered to the projected portion is shaped like the letter U by the downward movement of the forming plate 320, and the U-shaped staple is driven by the driver 321.

[DELIVERING MECHANISM 200]

Figure 31:
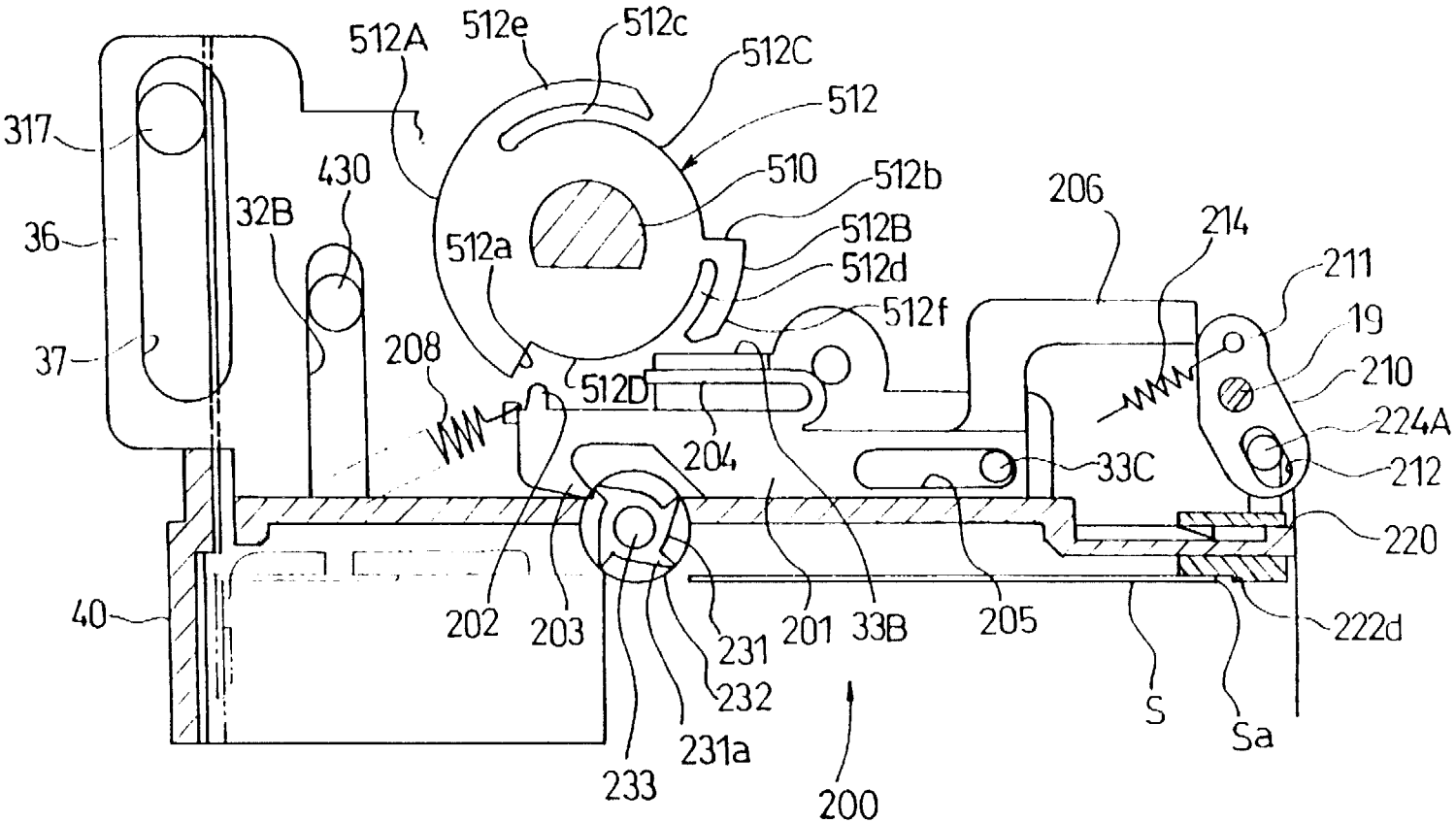
FIG. 31 is a descriptive drawing showing the construction of a delivering mechanism.
Figure 32:
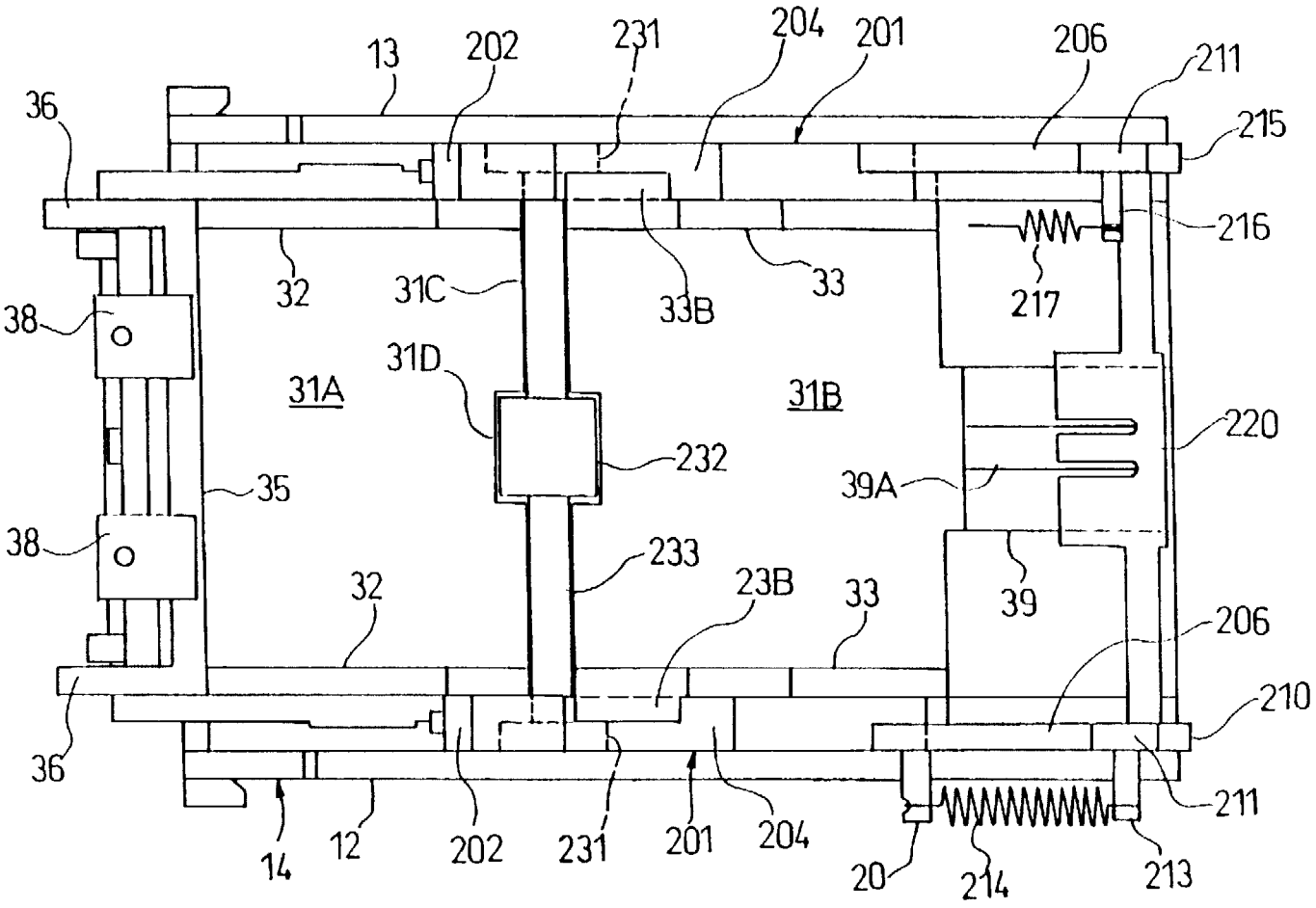
FIG. 32 is a plan view showing the positional relationship of the delivering mechanism.
Figure 33:
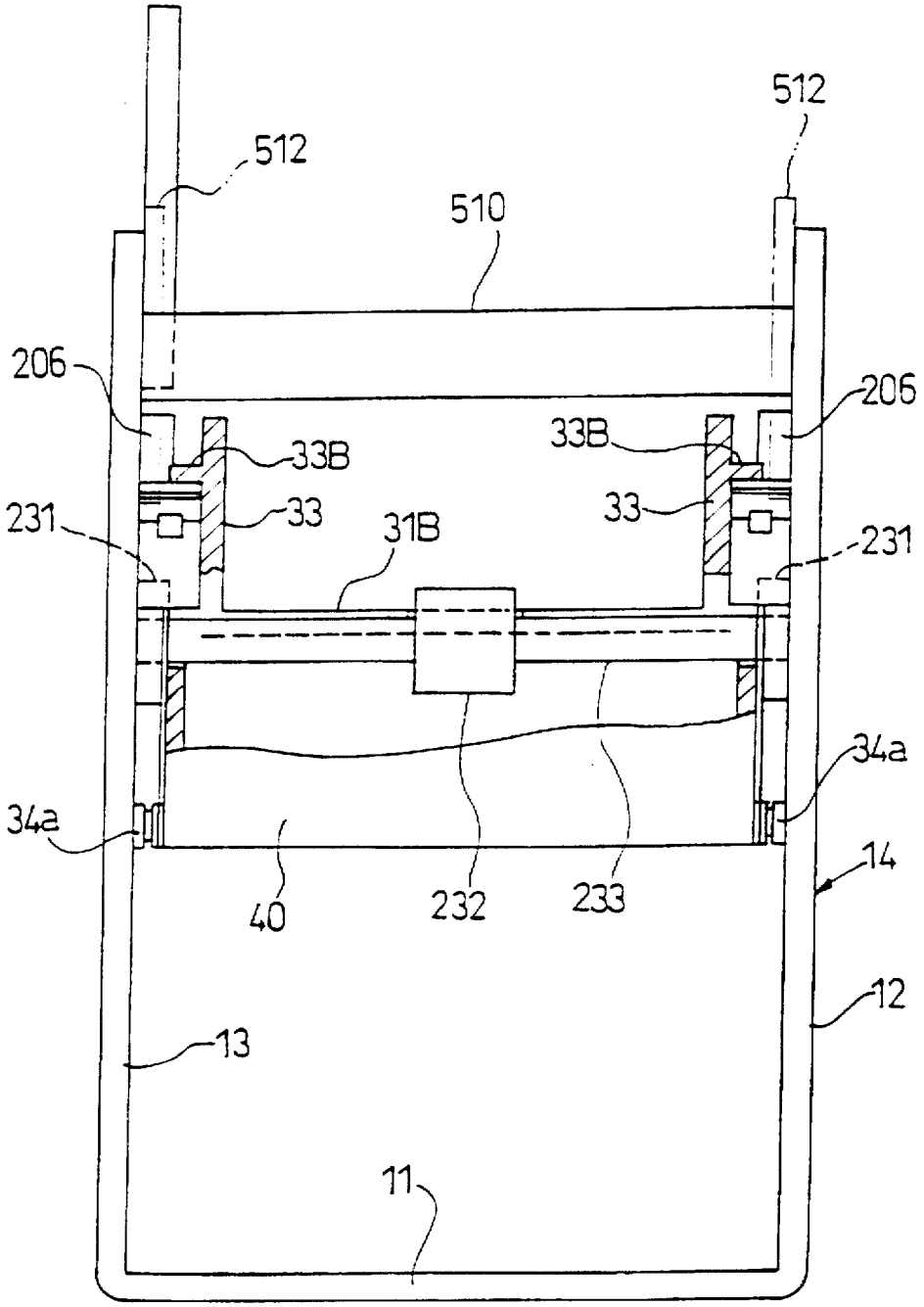
FIG. 33 is a descriptive drawing showing the positional relationship between the delivering mechanism and the frame.

As shown in FIGS. 31 to 33, the delivering mechanism 200 consists of the delivering cam 512 which is attached to the driving shaft 510, a first delivering lever 201 which is disposed on the bottom walls 31A, 31B of the magazine 30 and along the inside of the side plates 12 and 13 of the frame 14, second delivering levers 210, 215, a delivering plate body 220, a ratchet 231, and a roller 232, etc.

Herein, the ratchet 231 and the roller 232 are attached to a shaft 233, and the shaft 233 is attached rotatably to the bearings 34A disposed in the lower side walls 34 of the magazine 30 such that the ratchet 231 and the roller 232 are rotated with the shaft 233.

The delivering cam 512 has a first large-radius portion 512A with a first difference-in-level portion 512*a* and a second large-radius portion 512B with a second difference-in-level portion 512*b*, small-radius portions 512C, 512D, etc. Cut openings 512*c*, 512*d* are formed in the first and second large-radius portions 512A, 512B, respectively such that the rear parts 512*e*, 512*f* of the first and second large-radius portions 512A, 512B are elastic.

In the upper part of the front end of the first delivering lever 201, there is formed a projection 202 which comes in contact with the first and second difference-in-level portions 512*a*, 512*b* of the delivering cam 512. In the lower part thereof, there is formed a hook 203 which is engaged with one of hooks 231*a* of the ratchet 231. Further, in the middle and upper part of the first delivering lever 201, there is formed a folded portion 204 which is folded back forward to be elastic, and the folded portion 204 is in a state of being pressed by the pressing portion 33B of the magazine 30.

In the rear and side part of the first delivering lever 201, there is formed a long hole 205 extending in the forward and backward direction. The projection 33C formed in the side wall 33 of the magazine 30 is slidably inserted in the long hole 205. In the upper part of the rear end of the first delivering lever 201, there is formed a rod portion 206 extending in the backward direction, which is in contact with the upper part 211 of the second delivering lever 210.

The front end of the first delivering lever 201 is connected with an end of a spring 208, and the other end of the spring 208 is fixed to the magazine 30. The first delivering lever 201 is always pulled forward by the force of the spring 208 such that the first delivering lever 201 is located in an initial position shown in FIG. 31.

The upper parts 211 of the second delivering levers 210, 215 are formed round, and the middle parts thereof are pivoted on the shaft 19 which is attached to the side plates 12 and 13 of the frame 14 such that the second delivering levers 210, 215 can be pivoted. Further, a long hole 212 is formed in the lower part of each of the second delivering levers 210, 215.

A projection 213 which projects outward is formed in the upper and side part of the second delivering lever 210, and a spring 214 is laid between the projection 213 and the projection 20 which is formed in the side plate 12 of the frame 14. A projection 216 which projects inward is formed in the upper and side part of the second delivering lever 215, and a spring 217 is laid between the projection 216 and a projection (not shown) which is formed in the magazine 30. The second delivering lever 210 is pivoted counterclockwise by the force of the springs 214, 217.

Figure 34:
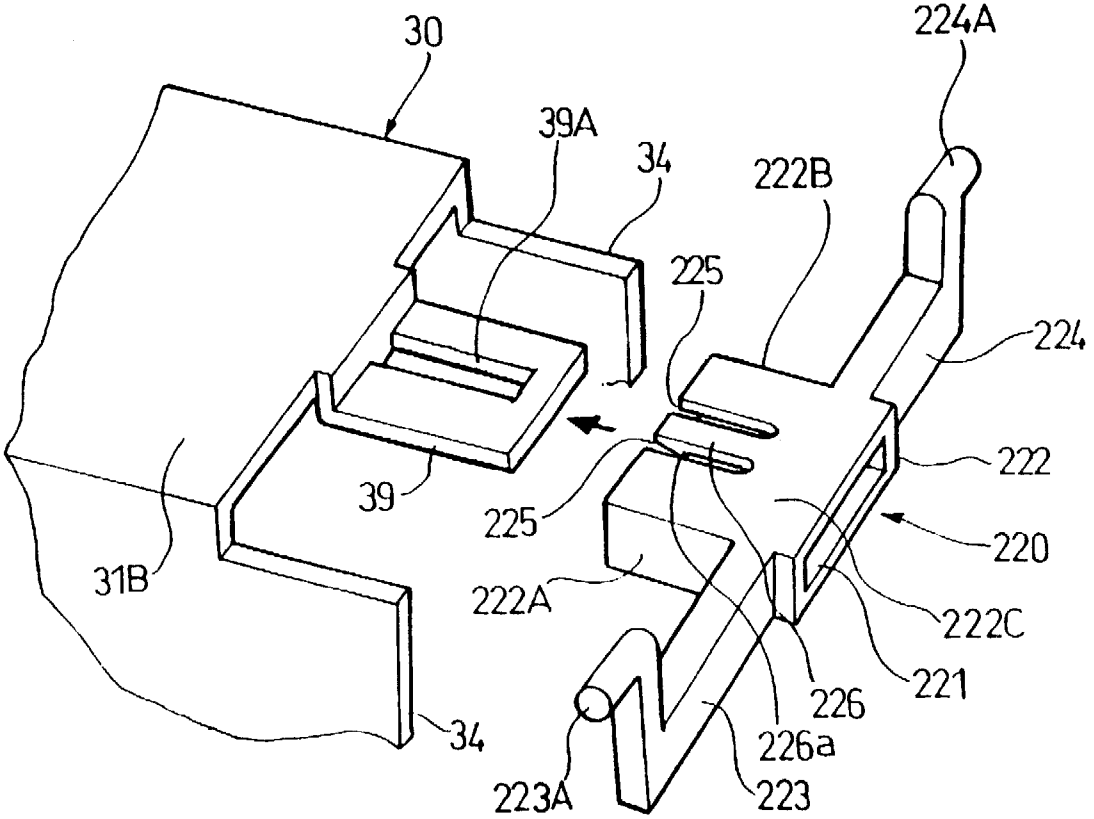
FIG. 34 is a perspective view showing a delivering plate body.
Figure 35:
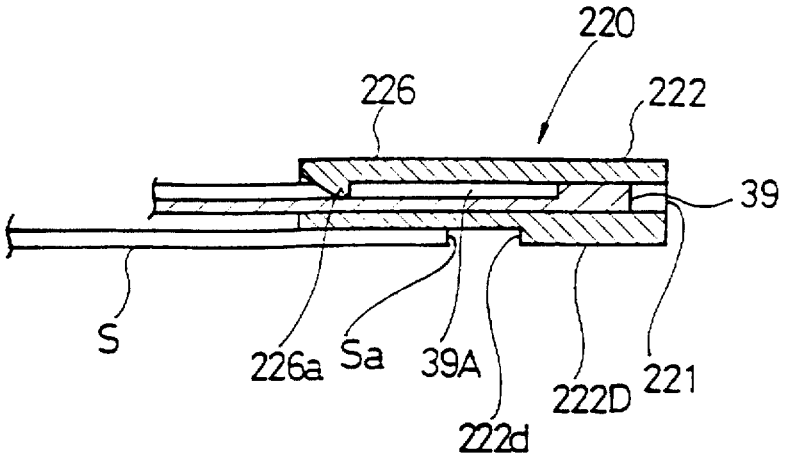
FIG. 35 is a sectional view showing the delivering plate body.
Figure 36:
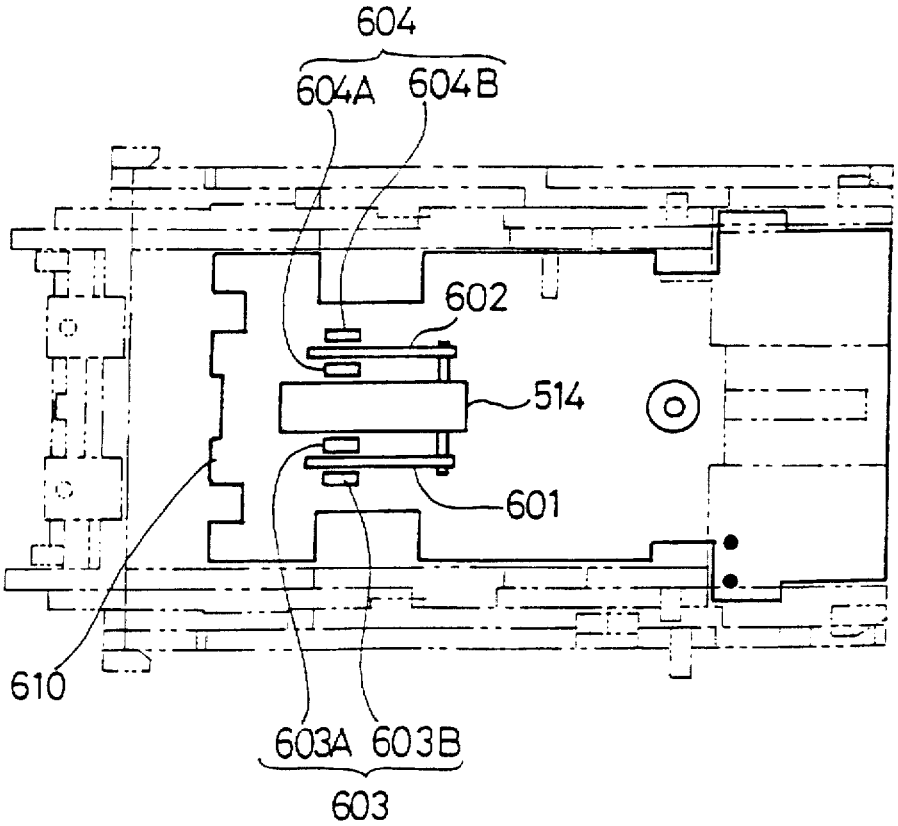
FIG. 36 is a plan view showing a detecting mechanism.
Figure 37:
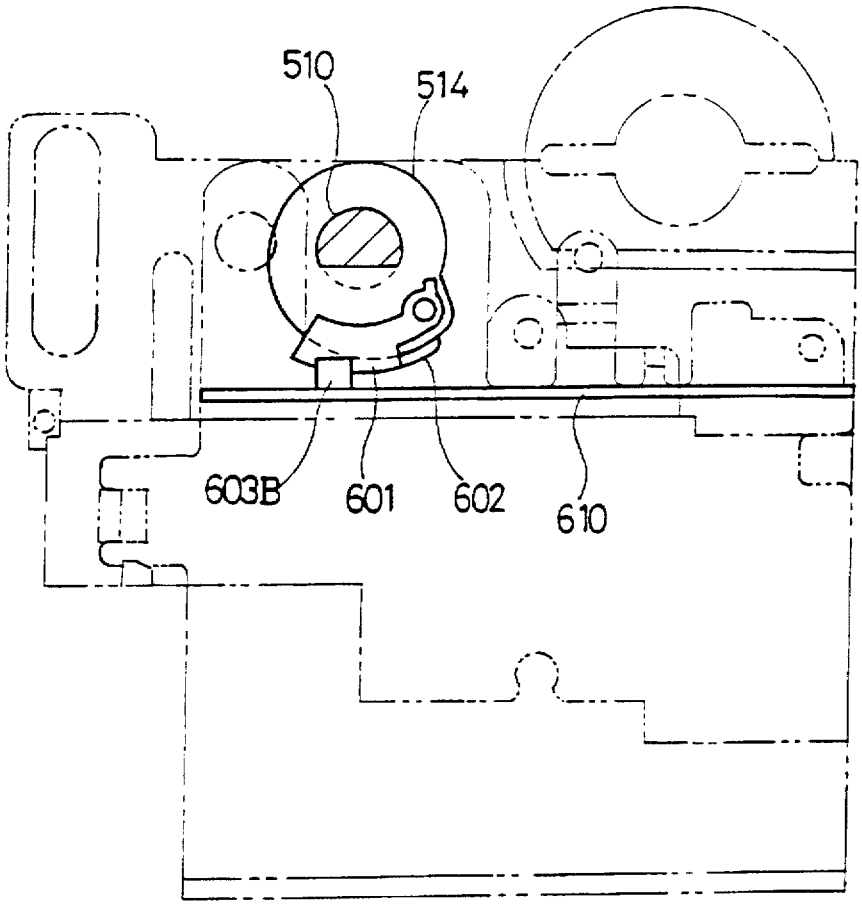
FIG. 37 is a side view showing the detecting mechanism.

As shown in FIGS. 34 and 35, the delivering plate body 220 has a box-shaped portion 222 with a through hole 221 into which the guiding plate 39 is inserted, and arm portions 223, 224 which extend from side walls 222A, 222B of the box-shaped portion 222 toward the side walls 34, 34 of the magazine 30. Two slits 225 are formed in an upper plate 222C of the box-shaped portion 222, and an elastic piece 226 is formed by the two slits 225. A projection **226*a* which is engaged with a guiding groove 39A of the guiding plate 39 is formed in the elastic piece 226. A step portion 222*d* which comes in contact with a rear end Sa of the sheet-staple S is formed in a delivering plate 222D, the bottom wall of the box-shaped portion 222**.

Shafts 223A, 224A which are inserted into the long holes 212, 212 of the second delivering levers 210, 215 are formed in the arm portions 223, 224, respectively. When the second delivering levers 210, 215 are pivoted clockwise, the delivering plate body 220 is moved forward so that the step portion **222*d* of the delivering plate 222D comes in contact with the rear end Sa of the sheet-staple S which is piled on the uppermost layer inside the cartridge 700**, and thereby the sheet-staple S can be delivered forward.

[DETECTING MECHANISM 600]

As shown in FIGS. 36 to 39, the detecting mechanism 600 is constituted by plates 601, 602 which are attached to both sides of the clinching cam 514 disposed on the driving shaft 510, and plate-detecting members 603, 604 for detecting the plates 601, 602. Herein, the plates 601, 602 have a circular-arc shape, and the plate 602 is longer than the plate 601.

The plate-detecting member 603 has a light emitting diode 603A and a light receiving sensor 603B comprising a photodiode, both of which are disposed with the plate 601 therebetween. A beam of light which has been emitted by the light emitting diode 603A is received by the light receiving sensor 603B and then is intercepted by the plate 601, and thereby it can be detected that the plate 601 lies. Similarly, the plate-detecting member 604 has a light emitting diode 604A, and a light receiving sensor 604B which is formed by a photodiode, both of which are disposed with the plate 602 therebetween. A beam of light which has been emitted by the light emitting diode 604A is received by the light receiving sensor 604B and then is intercepted by the plate 602, and thereby it can be detected that the plate 601 lies.

The beam of light emitted by the light emitting diode 603A is designed to be intercepted by the plate 601 when the table 100 lies in the home position. The beam of light emitted by the light emitting diode 604A is designed to be intercepted by the plate 602 when the table 100 lies between a position of moving downward from a top dead point to release completely its hold on the sheets of paper and the home position.

The plate-detecting member 603 detects that the table 100 lies in the home position, on the other hand, the plate-detecting member 604 detects that the table 100 has reached the position of releasing its hold on the sheets of paper.

In addition, a single plate-detecting member may detect that the table 100 has reached the position of releasing its hold on the sheets of paper and the home position. In this case, for example, the plate 601 has a first intercepting portion with a small area and a second intercepting portion with a large area. The second intercepting portion intercepts a beam of light emitted by the light emitting diode 603A when the table 100 lies in the home position, and then setting-up is made such that the quantity of light received by the light receiving sensor 603B becomes 0. On the other hand, the first intercepting portion intercepts the beam of light emitted by the light emitting diode 603A when the table 100 lies between a position of moving downward from the top dead point to release completely its hold on the sheets of paper and the home position, and then setting-up is made such that the quantity of light received by the light receiving sensor 603B becomes ½. According to this construction, only a single light receiving sensor 603B can detect it by variations in the quantity of received light that the table 100 has reached the position of releasing its hold on the sheets of paper and the home position.

Reference numeral 610 designates a circuit base which is disposed above the bottom walls 31A, 31B of the magazine 30, and the light emitting diode 603A, 604A and the light receiving sensor 603B, 604B are mounted in the circuit base 610. Further, a control circuit (not shown) which drives the motor M by receiving a stapling signal from a copying machine (not shown) is mounted in the circuit base 610.

[CARTRIDGE 700]

Figure 40:
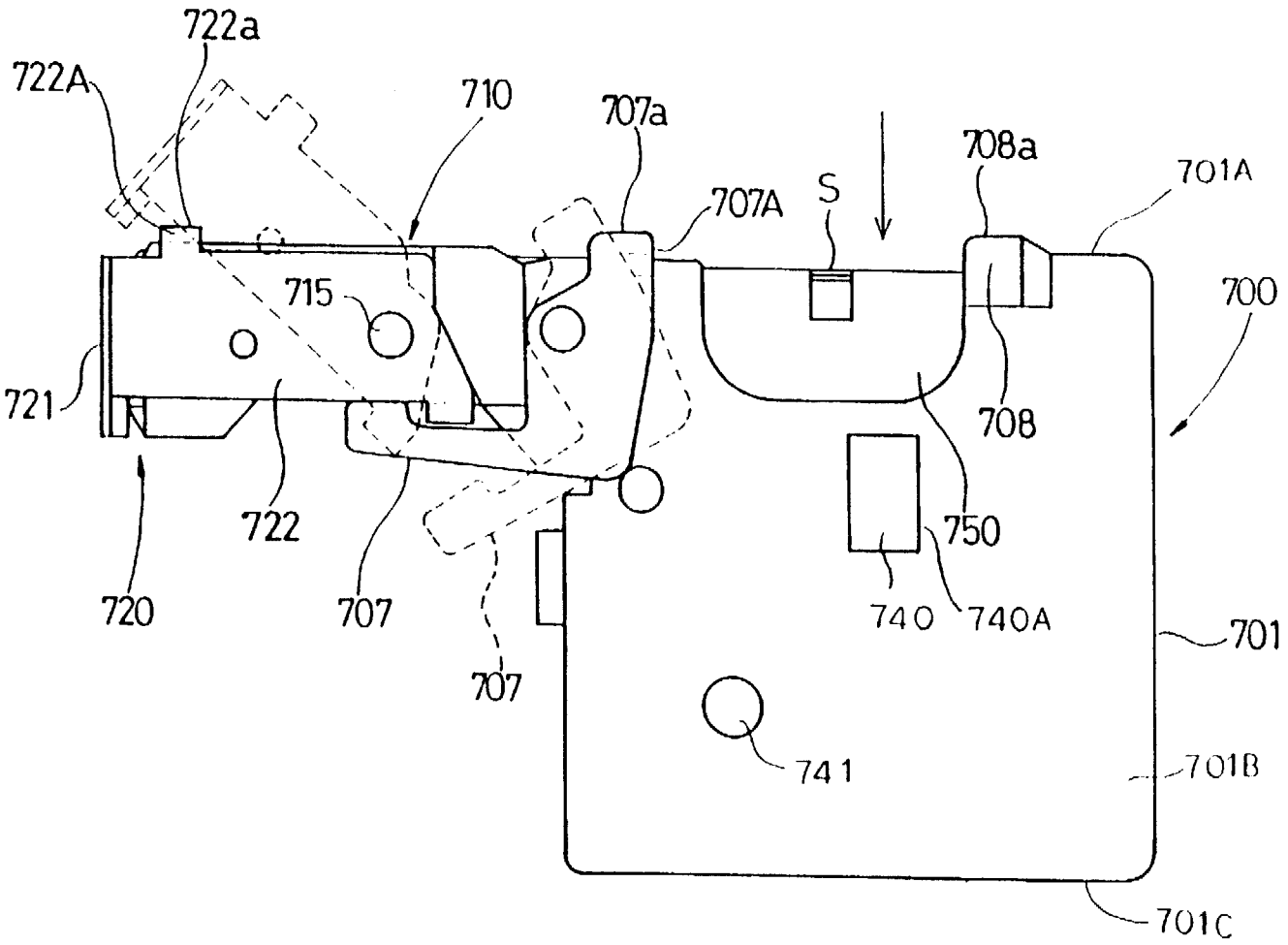
FIG. 40 is a side view showing a cartridge.
Figure 41:
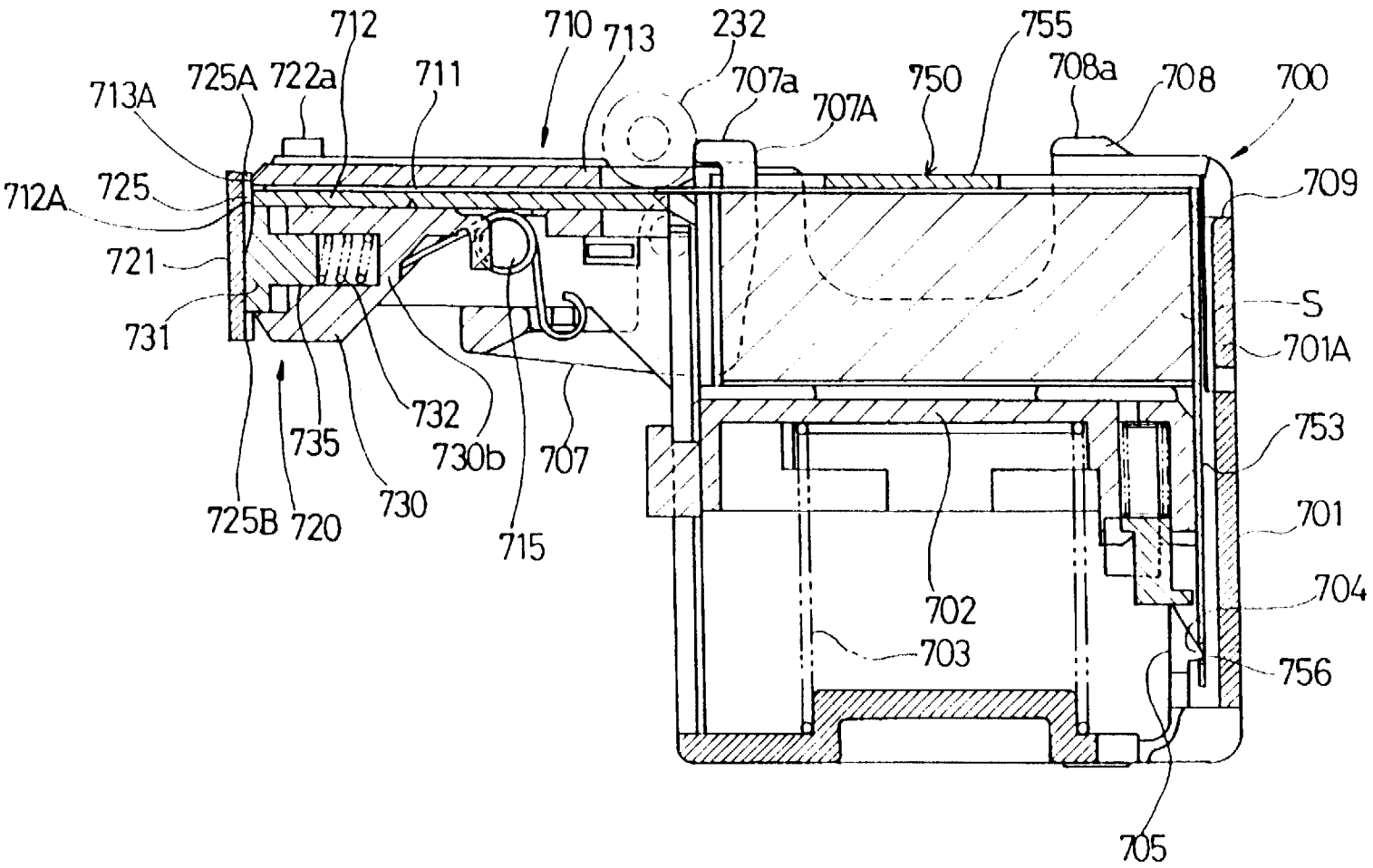
FIG. 41 is a sectional view showing the cartridge.
Figure 42:
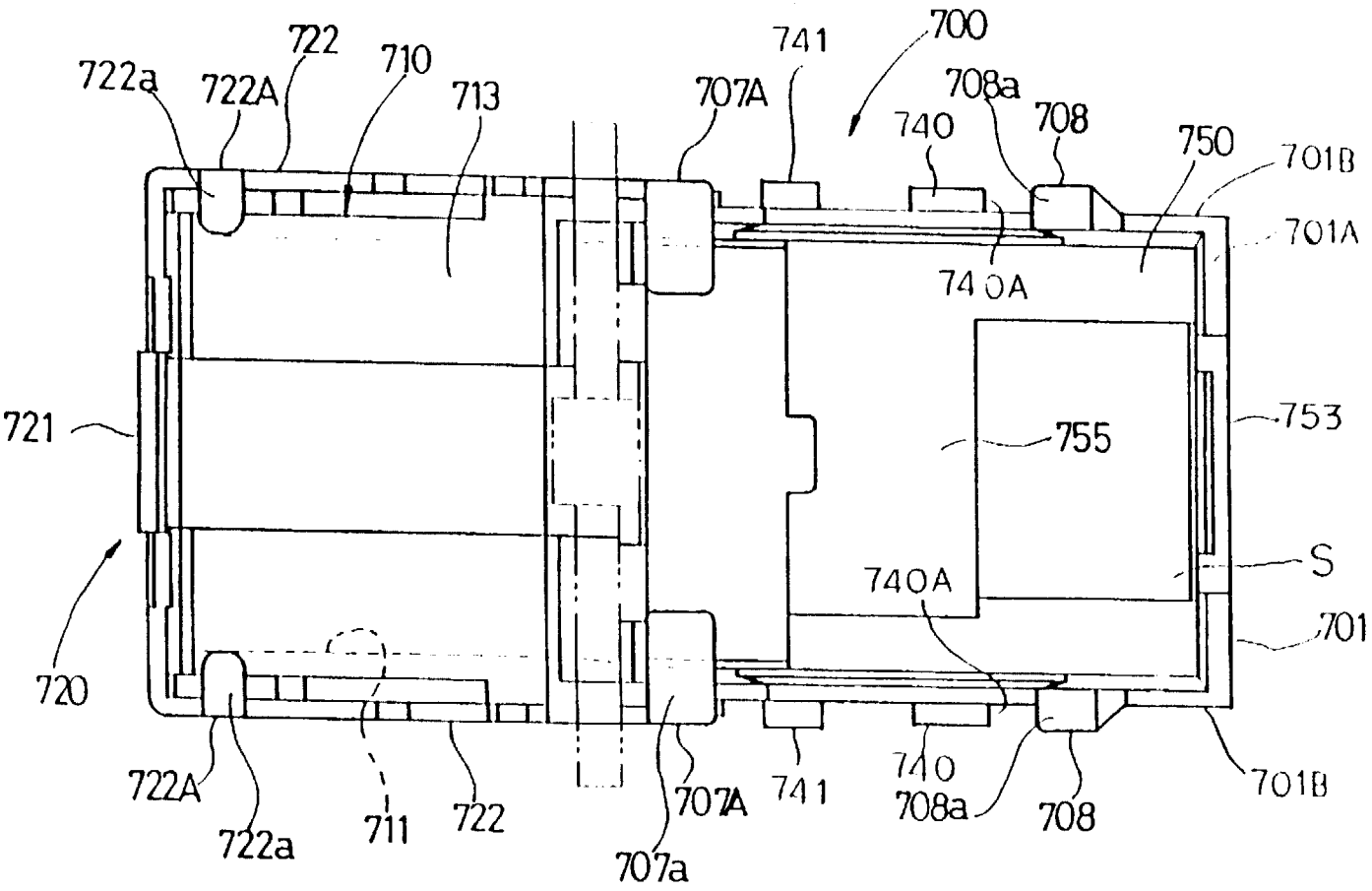
FIG. 42 is a plan view showing the cartridge.

As shown in FIGS. 40 to 42, the cartridge 700 consists of a cartridge body 701, a delivering portion 710 which extends forward (in a leftward direction in FIGS. 40 to 42) from the body 701, and a driving-out portion 720 which is formed in the end part of the delivering portion 710. A delivery path 711 through which the sheet-staple is delivered to the driving-out portion 720 is formed in the delivering portion 710.

A holder 702 movable upward and downward, a spring 703 by which the holder 702 is pressed upward, and the like are disposed in the cartridge body 701. The holder 702 holds the piled sheet-staples S wrapped by an inner cartridge 750.

A hooking portion 740 having a hooking surface 740A which is perpendicular to the direction of insertion and removal of the cartridge 700, and a boss 741 is formed in each side wall 701B of the cartridge body 701.

A staple holder 707 is disposed pivotably, as shown by a dashed line in FIG. 40, in the cartridge body 701, and the surface of the sheet-staple S which is the uppermost one of the piled sheet-staples is pressed by a pressing portion 707A of the staple holder 707 and a connecting portion 755 of the inner cartridge 750. The sheet-staples S are thrown from the direction of an arrow shown in FIG. 40 into the cartridge body 701 in a state of having been placed inside the inner cartridge 750 after the staple holder 707 has been pivoted and kept at a position shown by the dashed line in FIG. 40.

Figure 43:
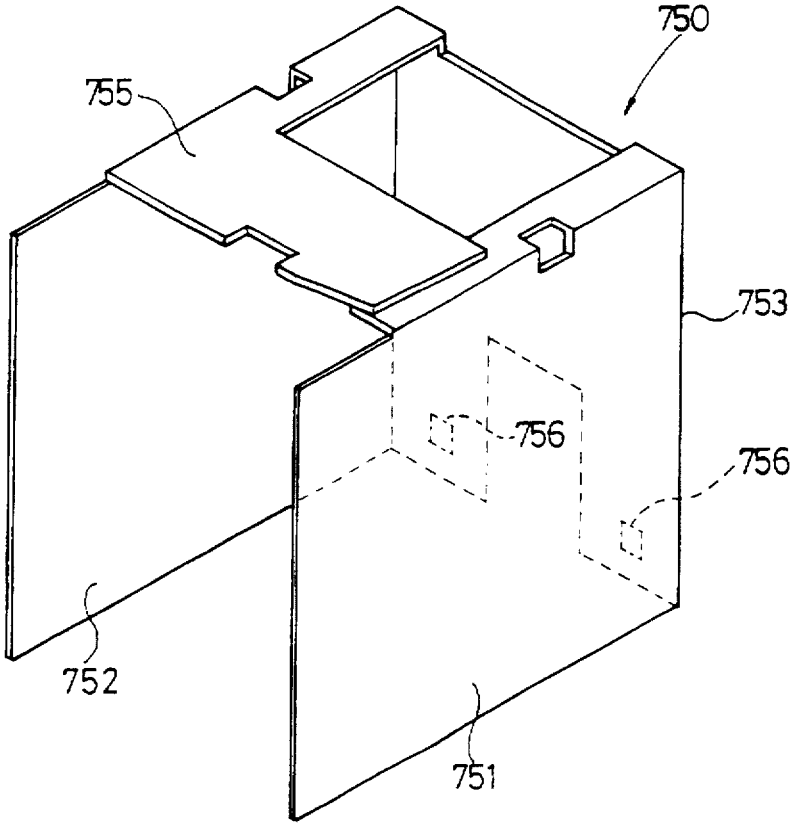
FIG. 43 is a perspective view showing an inner cartridge.

As shown in FIG. 43, the inner cartridge 750 has side wall portions 751, 752, a back wall 753, and a connecting portion 755 which is connected with the upper parts of the side wall portions 751, 752, respectively. Engagement holes 756 which are engaged with claws 704 of a hooking piece 705 are formed in the back wall 753, and the engagement between the engagement holes 756 and the claws 704 enables the inner cartridge 750 to be fixed to the cartridge body 701.

The driving-out portion 720 has a face plate 721, a pusher 731 which is held by a holding member 730 on the lower surface of the staple guide 711, etc.

In the each side of the face plate 721, a side plate portion 722 is formed integrally therewith, and the side plate portion 722 is pivoted on a shaft 715 in the side portion 730*b* of the holding member 730 so as to pivot, as shown by the dashed line in FIG. 40. The face plate 721 is moved at a position shown by the dashed line when the side plate portion 722 is pivoted. Thereby, staples lodging in an open space 725 of the driving-out portion 720 can be removed.

An upper plane 701A of the cartridge body 701 is designed to be on the same level with an upper plane 710A of the delivering portion 710. Further, an upper plane 722*a* of a bent piece 722A formed in the upper part of the side plate portion 722 of the face plate 721, an upper plane 707*a* of the pressing portion 707A of the staple holder 707, and an upper plane 708*a* of a projection 708 formed in the upper part of the side wall of the cartridge body 701, are designed to be on the same level.

Figure 5:
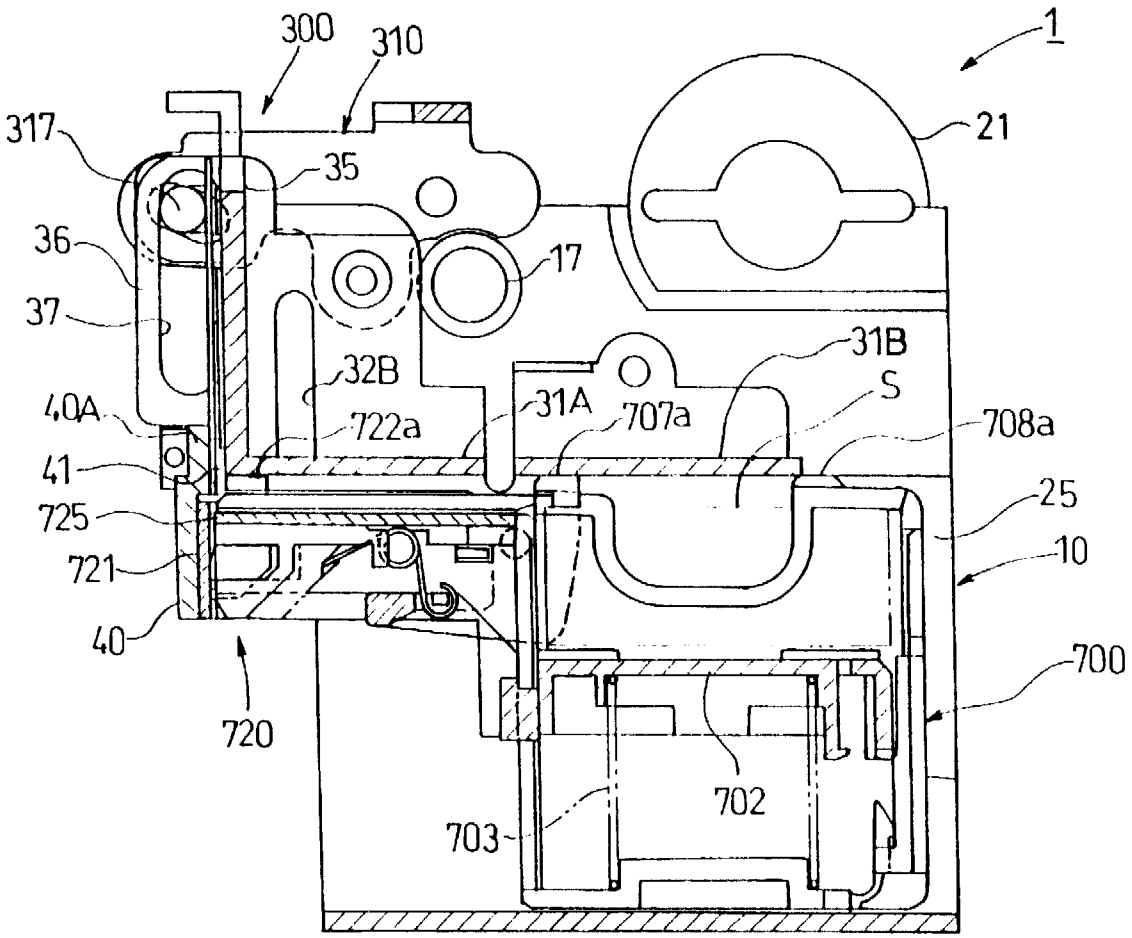
FIG. 5 is a sectional view of the electric stapler shown in FIG. 1.

The upper plane 722*a* of the bent piece 722A, the upper plane 707*a* of the pressing portion 707A, and the upper plane 708*a* of the projection 708 come in contact with the lower plane of the bottom walls 31A, 31B of the magazine 30 (see FIG. 5). An bottom surface 701C of the cartridge body 701 come in contact with the upper surface of the bottom plate 11 of the frame 14 of the stapler body 10. The cartridge 700 is inserted from the back part of the stapler body 10, as shown in FIG. 5, so as to be attached to the cartridge chamber 25.

[CARTRIDGE CHAMBER 25]

Figure 44:
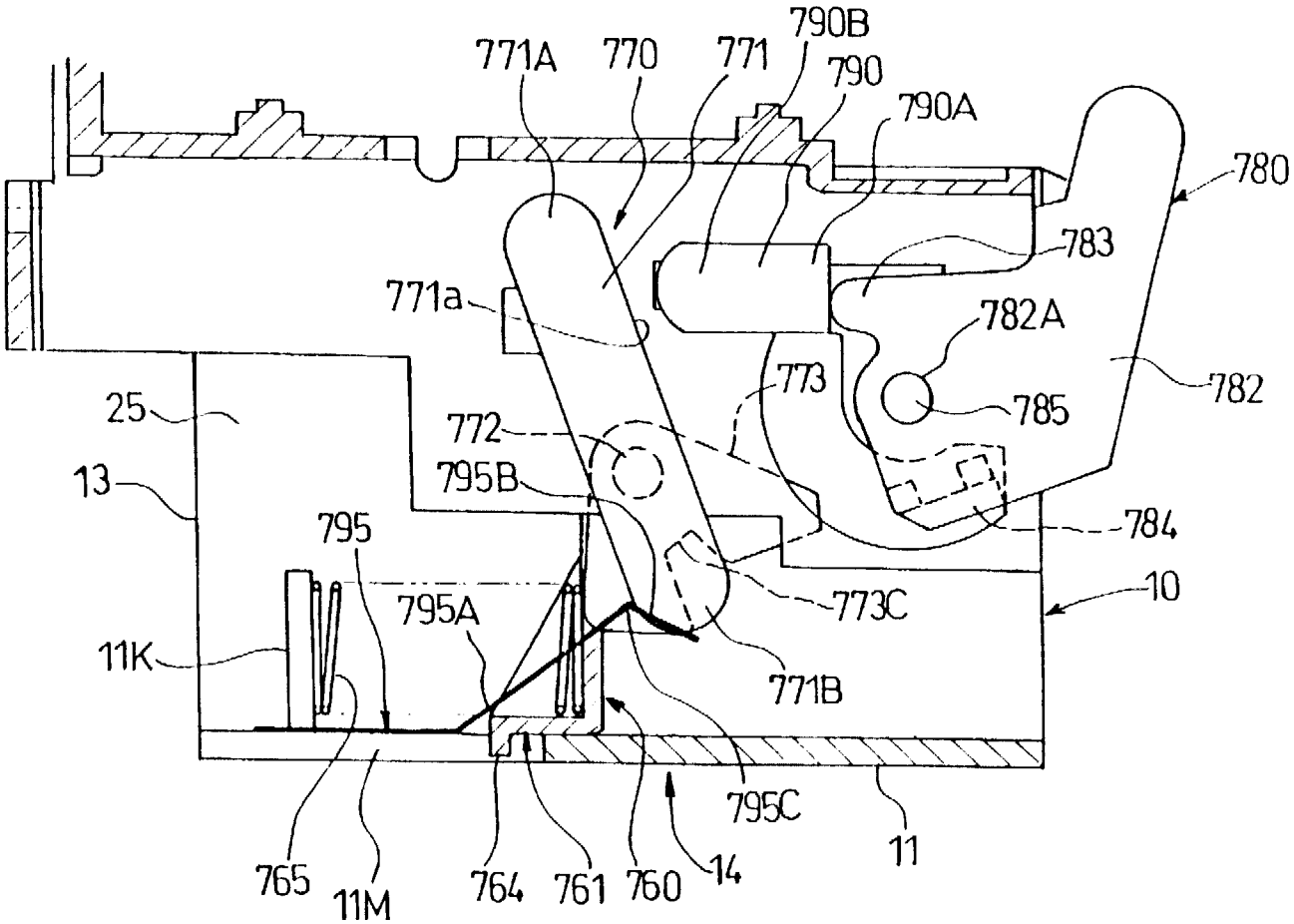
FIG. 44 is a descriptive drawing showing an attaching-and-removing mechanism of the cartridge.

As shown in FIG. 44, a cartridge guide 760 is disposed moveably in the forward and backward direction in the cartridge chamber 25.

Figure 45:
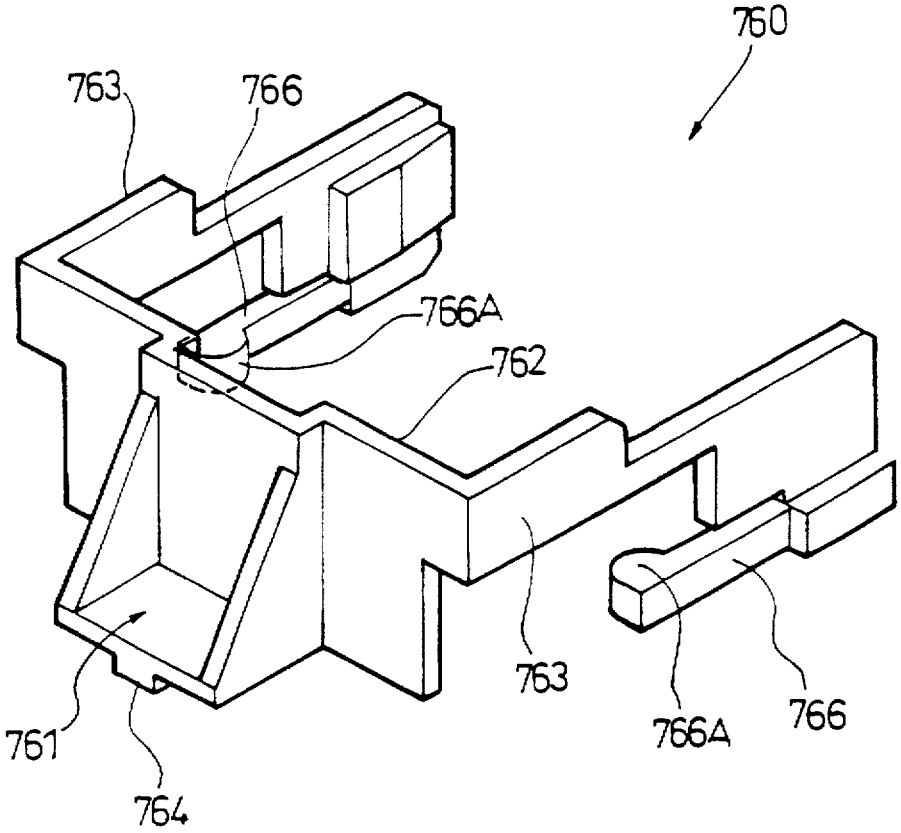
FIG. 45 is a perspective view showing a cartridge guide.

As shown in FIG. 45, the cartridge guide 760 has side plates 763 which extend backward from the both end of a front plate 762 with a spring-receiving portion 761, and holding pieces 766 having projections 766A for holding the cartridge body 701 are formed in the side plates 763. A projection 764 is formed in the bottom part of the spring-receiving portion 761, and the projection 764 is inserted into a guiding groove 11M which is formed in the bottom plate 11 of the frame 14. A hooking portion 11K is disposed in the bottom plate 11 of the frame 14, and a spring (a first elastic member) 765 is laid between the hooking portion 11K and the spring-receiving portion 761 of the cartridge guide 760 such that the cartridge guide 760 is pressed backward.

Figure 46:
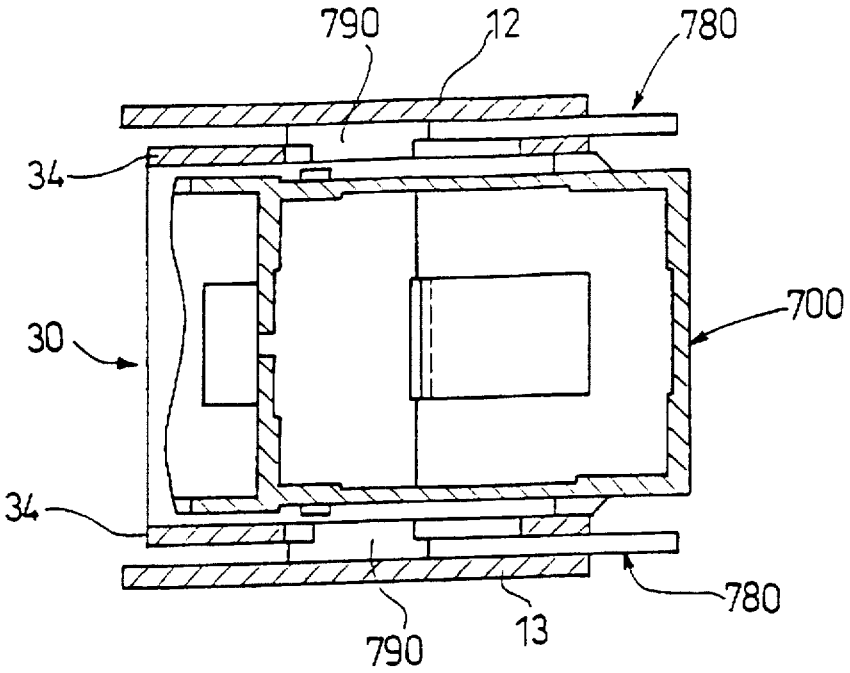
FIG. 46 is a plan sectional view showing a cartridge chamber.
Figure 47:
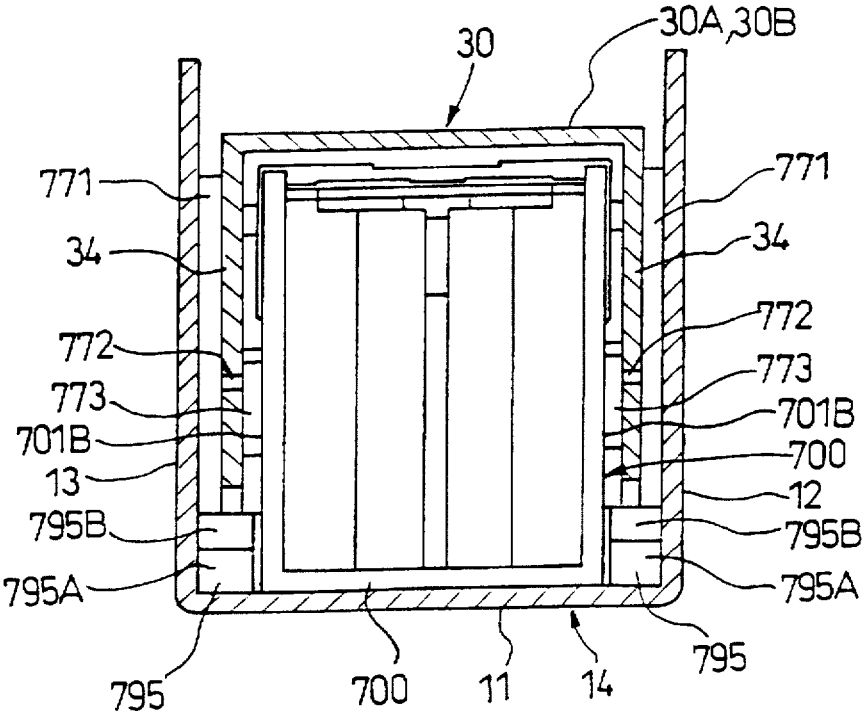
FIG. 47 is a side sectional view showing the cartridge chamber.

In the cartridge chamber 25 and the like, as shown in FIGS. 44, 46 and 47, there are disposed a stopper 770, a main lever (a lever) 780, a sublever 790, and a plate spring (a second elastic member) 795.

Figure 48:
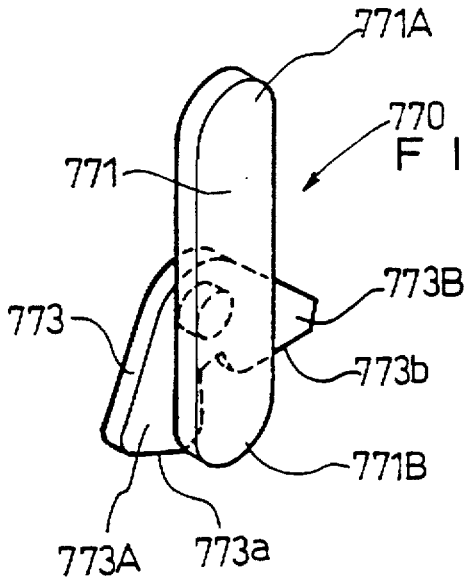
FIG. 48(A) is a perspective view showing a stopper.
FIG. 48(B) is a side view showing the stopper.
FIG. 48(C) is a front view showing the stopper.
FIG. 48(D) is a rear view showing the stopper.
Figure 48:
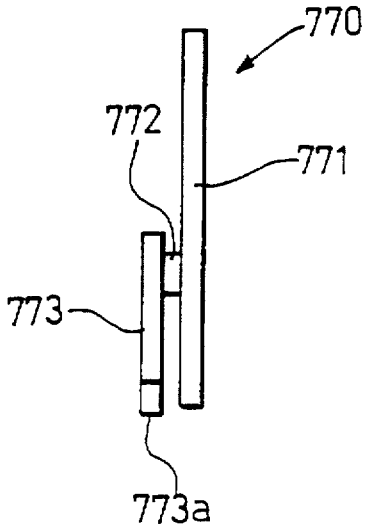
Figure 48:
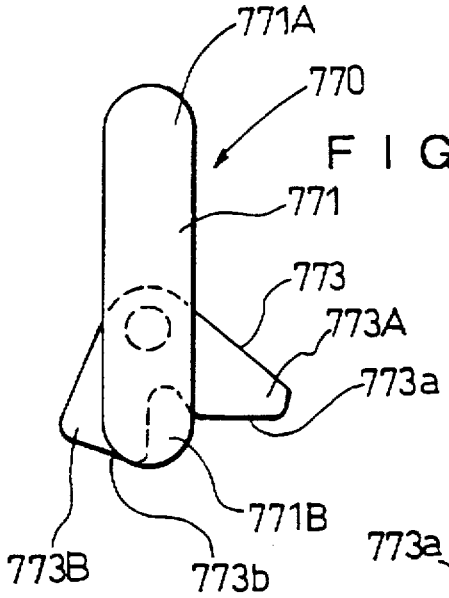
Figure 48:
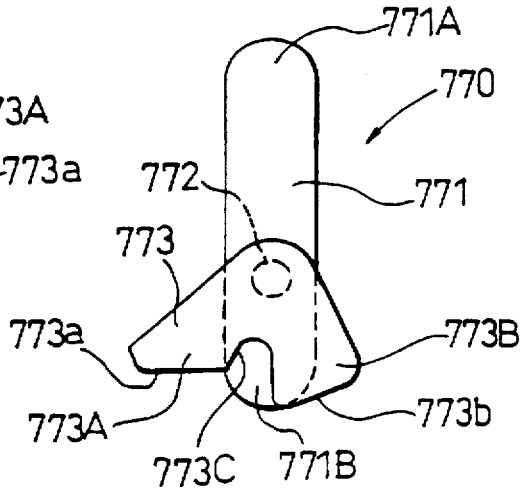

As shown in FIG. 48, the stopper 770 which extends in the upward and downward direction has a platelike stopper member 771 whose upper and lower end portion 771A, 771B are formed round, and a hooking member 773 which is connected with the back side of the stopper member 771 by a shaft portion 772.

The hooking member 773 has forked leg portions 773A, 773B between which an engagement concave portion 773C that is engaged with a boss 741 attached to the cartridge body 701 is formed. Herein, the lower end 773*a* of the leg portion 773A is positioned above the boss 741, and the lower end 773*b* of the leg portion 773B is positioned below the boss 741.

The hooking member 773 is disposed inside the lower side walls 34 of the magazine 30, and the stopper member 771 is disposed outside the lower side walls 34 thereof. The shaft portion 772 is pivoted rotatably on the lower side walls 34 thereof. Thereby, the stopper 770 can be rotated on the shaft portion 772.

Figure 49:
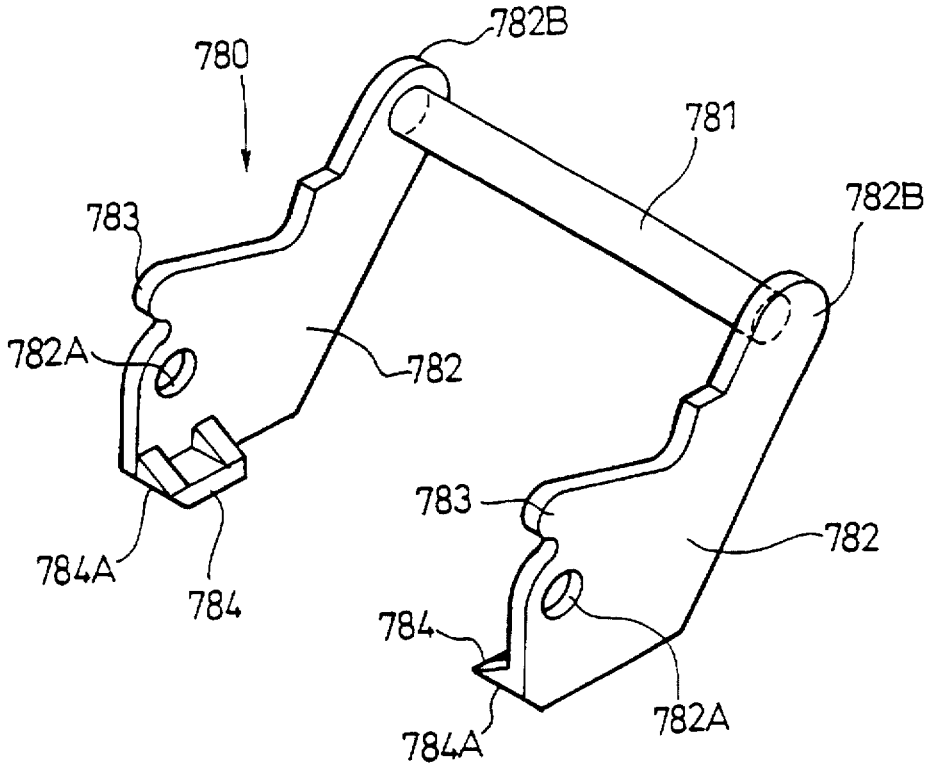
FIG. 49 is a perspective view showing a main lever.
Figure 50:
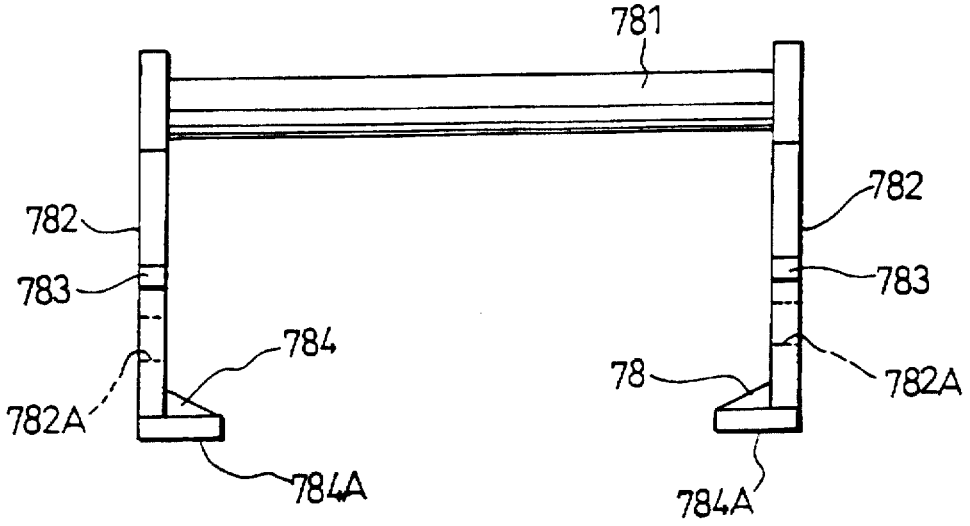
FIG. 50 is a front view showing the main lever.

As shown in FIGS. 49 and 50, the main lever 780 has side plate portions 782 which are attached to both ends of a connecting member 781, projections 783 formed in the side plate portions 782 which project forward (leftward in FIG. 49), and engagement portions 784 inside the side plate portions 782. In the engagement portions 784, there are formed flat engagement surfaces 784A which are engaged with the hooking surface 740A of the hooking portion 740 disposed in the cartridge body 701.

Engagement holes 782A are formed in the side plate portions 782, and a shaft 785 (see FIG. 44) which is disposed in the lower side walls 34 of the magazine 30 is inserted into the engagement holes 782A. Further, the side plate portions 782 are disposed between the lower side walls 34 of the magazine 30 and the side plates 12, 13 of the frame 14 such that the main lever 780 can be rotated on the shaft 785. Herein, the shaft 785 is designed to be positioned in the direction perpendicular to the hooking surface 740A of the hooking portion 740 disposed in the cartridge body 701 (see FIG. 53).

The sublever 790 which can move in the forward and backward direction is disposed outside the lower side walls 34 of the magazine 30. The rear portion 790A of the sublever 790 is in contact with the projection 783 of the main lever 780. On the other hand, the front end portion 790B of the sublever 790 is opposite to a side plane 771*a* of the stopper member 771, which is above the shaft portion 772.

The plate spring 795 is placed inside the side plates 12, 13 on the bottom plate 11 of the frame 14, and the plate spring 795 has a first plate spring portion 795A which extends in the oblique upward and backward direction, and a second plate spring portion 795B which extends from the rear part of the plate spring 795 in the oblique downward direction. A top portion 795C is the boundary between the first plate spring portion 795A and the second plate spring portion 795B.

When the cartridge 700 is not attached to the cartridge chamber 25, the second plate spring portion 795B is in contact with the lower portion 771B of the stopper member 771, and thereby the stopper 770 is pressed counterclockwise on the shaft portion 772. Herein, the stopper 770 is controlled not to rotate counterclockwise still more than a position shown FIG. 51. In this state, the cartridge guide 760 is in a position shown in FIG. 44.

[ATTACHMENT OF CARTRIDGE 700]

Figure 51:
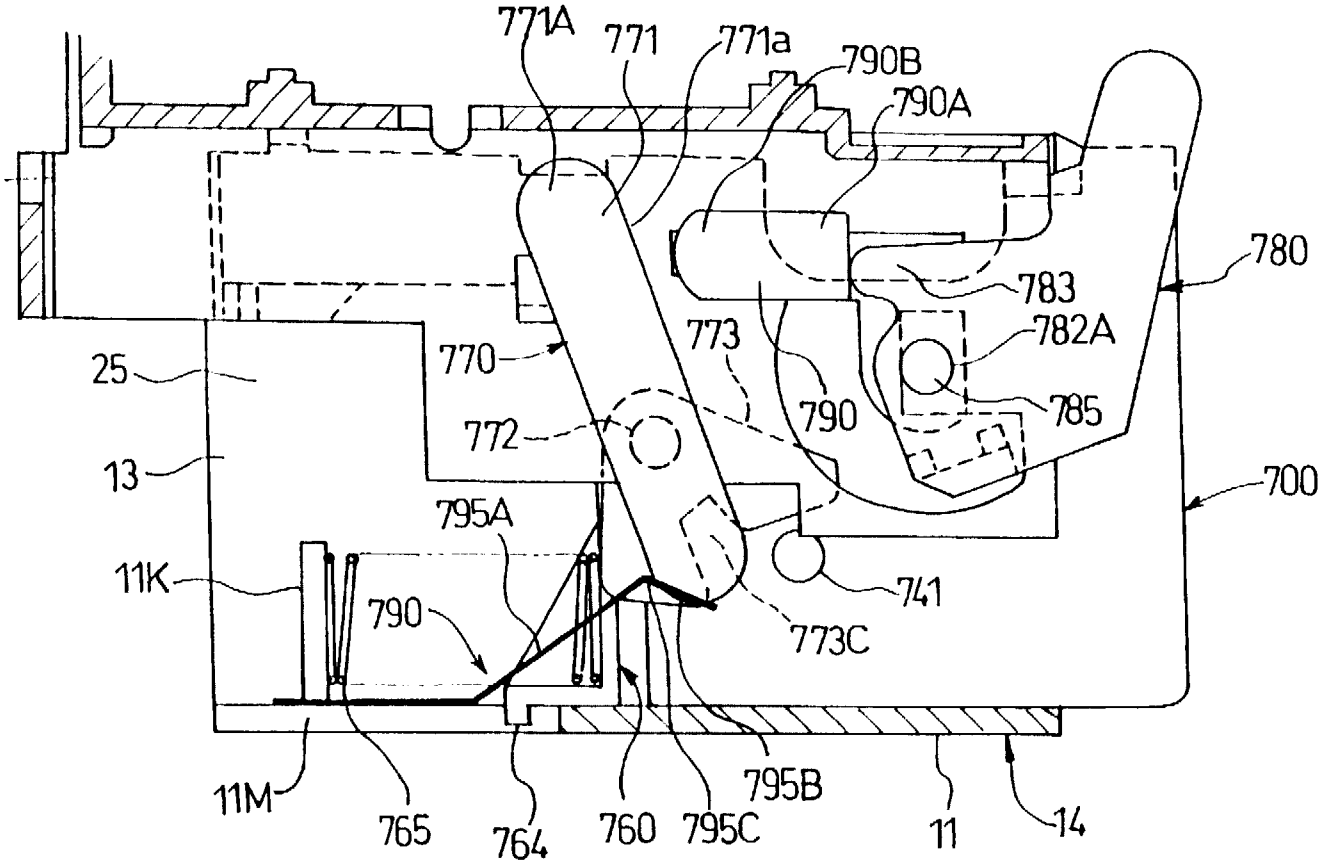
FIG. 51 is a descriptive drawing for explaining how the cartridge is inserted into the cartridge chamber.

In order to attach the cartridge 700 to the stapler body 10, the cartridge 700 is first inserted into the cartridge chamber 25 from the rear part of the stapler body 10, as shown in FIG. 51. Thereby, the cartridge body 701 is held by and between the projections 766A of the holding pieces 766 of the cartridge guide 760.

Figure 52:
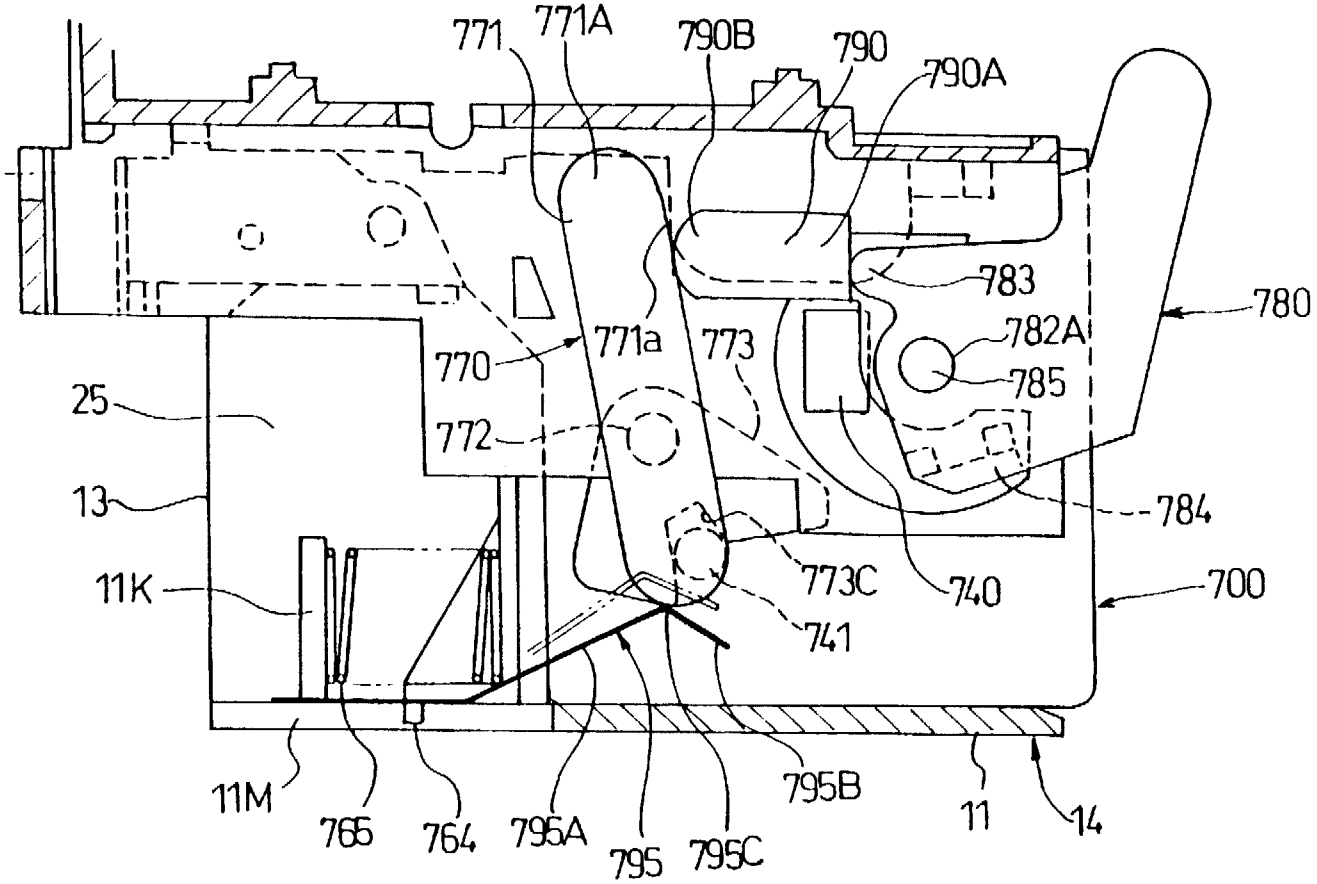
FIG. 52 is a descriptive drawing for explaining how the cartridge is inserted into an insertion position.

The boss 741 of the cartridge 700 is then engaged with the engagement concave portion 773C of the hooking member 773 when the cartridge 700 is pushed forward along with the cartridge guide 760 against the force of the spring 765 up to a position shown in FIG. 52.

Figure 53:
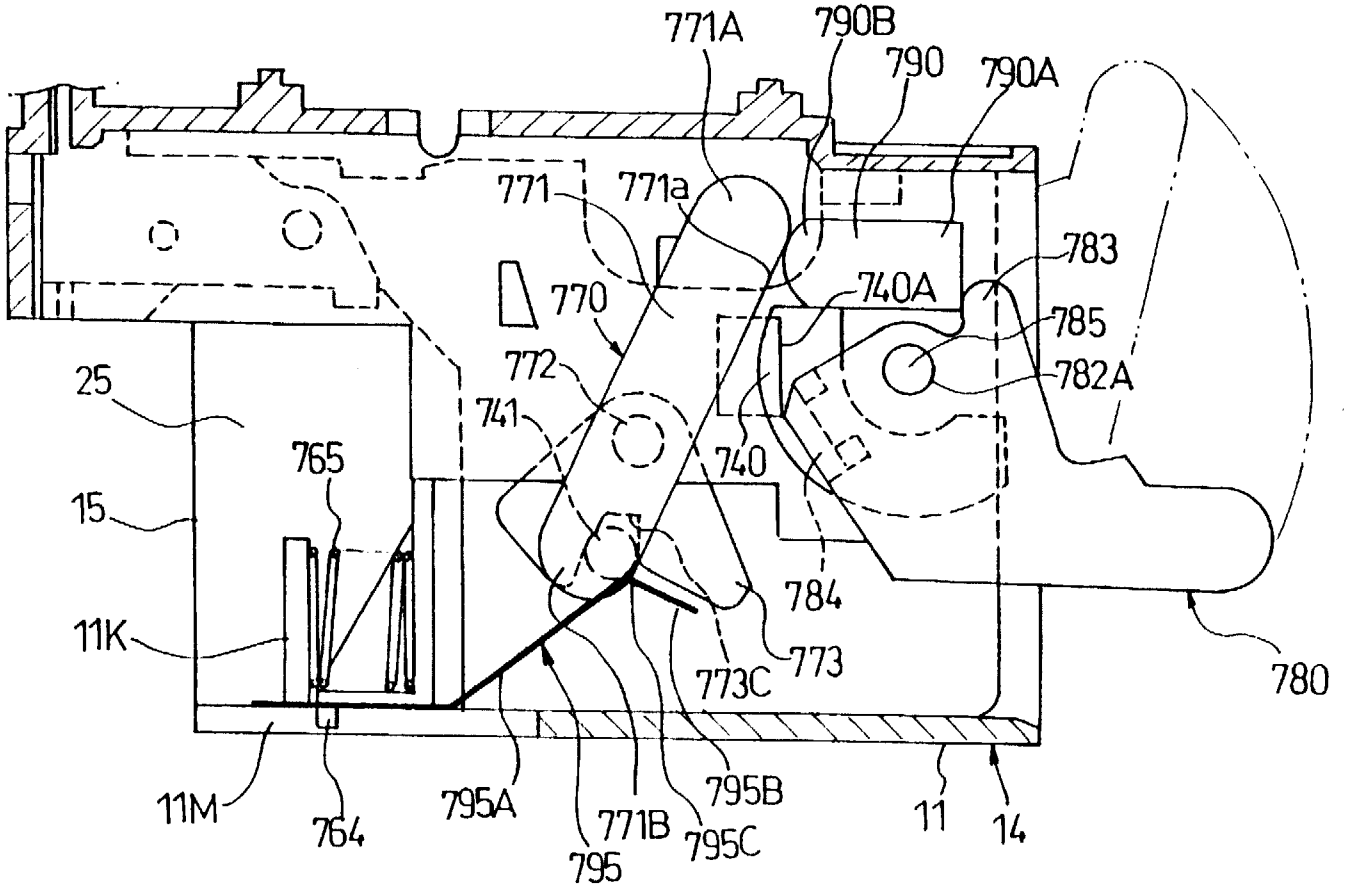
FIG. 53 is a descriptive drawing of the cartridge inserted in the insertion position.

When the cartridge 700 is inserted even more, the lower end 771B of the stopper member 771 goes beyond the top portion 795C of the plate spring 795, and then the plate spring portion 795A of the plate spring 795 comes in contact with the lower portion 771B of the stopper member 771, and thereby the stopper member 771 is pivoted clockwise by the force of the plate spring portion 795A. Due to the engagement of the boss 741 with the engagement concave portion 773C of the hooking member 773, as shown in FIG. 53, the cartridge 700 is pressed forward even more and is moved to an attachment position when the stopper member 771 is pivoted clockwise.

The sublever 790 is moved backward when the stopper member 771 is pivoted clockwise, and then the main lever 780 is pivoted clockwise by the backward movement of the sublever 790.

Figure 54:
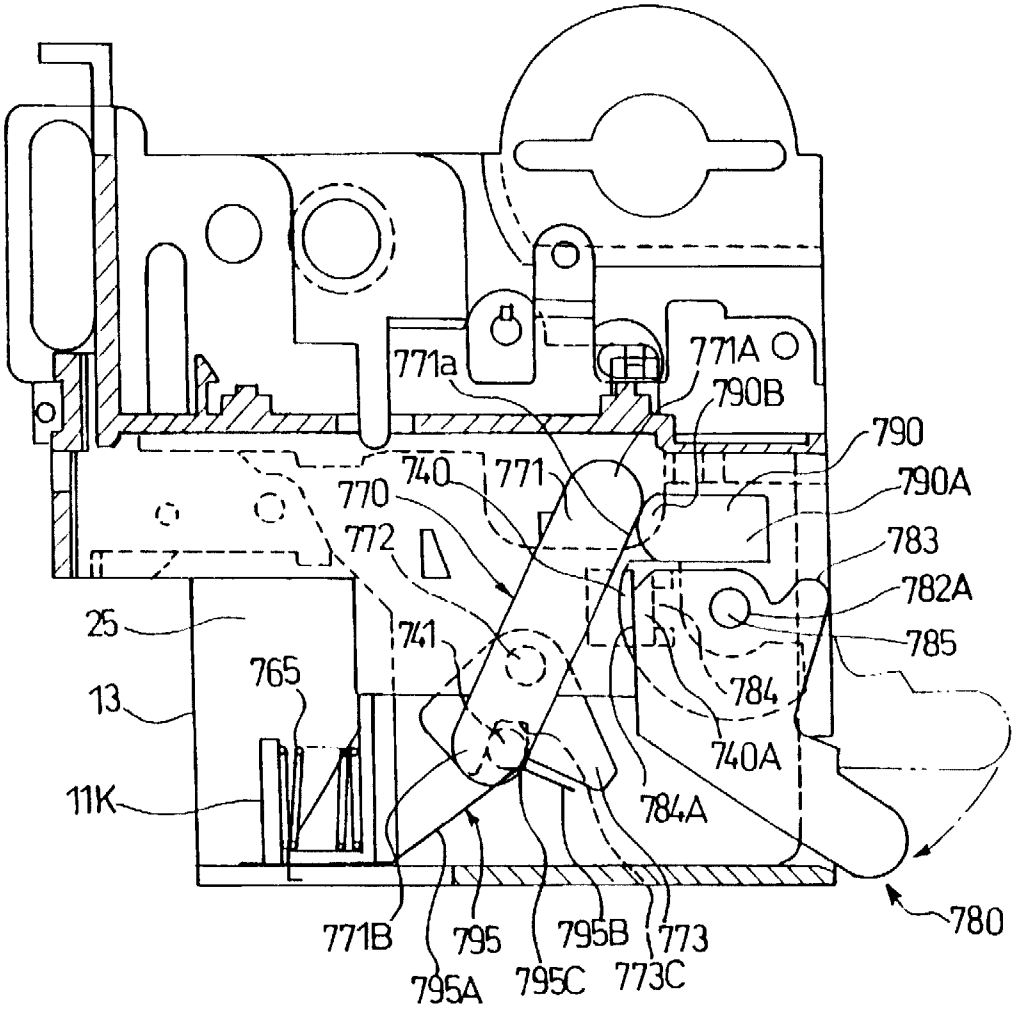
FIG. 54 is a descriptive drawing of the cartridge fixed in the insertion position.
Figure 55:
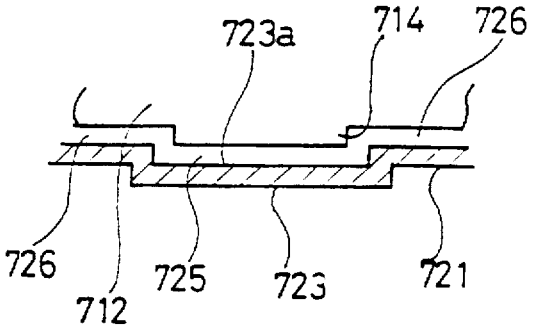
FIG. 55 is a partially enlarged view showing the driving position.

As shown in FIG. 54, when the main lever 780 is manually pivoted clockwise even more, the engagement surface 784A of the engagement portion 784 of the main lever 780 is engaged with the hooking surface 740A of the hooking portion 740 which is mounted in the cartridge body 701, and thereby the cartridge 700 is locked in the attachment position.

The shaft 785 of the main lever 780 is positioned in the direction in which the hooking surface 740A of the hooking portion 740 is perpendicular to the direction in which the cartridge 700 is attached and removed and is perpendicular to the hooking portion 740. Thereby, the engagement surface 784A of the engagement portion 784 of the main lever 780 does not disengage from the hooking surface 740A of the hooking portion 740 even though a strong impact which can move the cartridge 700 backward is made.

In short, the cartridge 700 does not disengage from its attachment position even though the elastic force of the plate spring 795 is small.

As shown in FIG. 54, the cartridge 700 can be removed by pivoting counterclockwise the main lever 780. In detail, when the main lever 780 is pivoted counterclockwise, the engagement surface 784A of the engagement portion 784 cones out of contact with the hooking surface 740A of the hooking portion 740 of the cartridge body 701, and the projection 783 of the main lever 780 comes in contact with the rear portion 790A of the sublever 790. Thereby, the sublever 790 is moved forward.

The forward movement of the sublever 790 enables the stopper member 771 to be pivoted counterclockwise because the front end portion 790B of the sublever 790 is in contact with a side surface 771*a* of the stopper member 771.

According to the counterclockwise rotation of the stopper member 771, the lower portion 771B of the stopper member 771 presses downward the plate spring portion 795A of the plate spring 795, and then the lower portion 771B moves beyond the top portion 795C of the plate spring 795 and comes in contact with the plate spring portion 795B. When the lower portion 771B of the stopper member 771 comes in contact with the plate spring portion 795B, the stopper member 771 is pivoted counterclockwise even more by the force of the plate spring 795, and the boss 741 of the cartridge 700 which is engaged with the engagement concave portion 773C of the hooking member 773 disengages from the engagement concave portion 773C.

Thereafter, the cartridge 700 is pushed out backward from the attachment position by the force of the spring 765 and, as a result, the cartridge 700 is removed from the stapler body 10.

The elastic force of the plate spring 795 is designed to be larger than that of the spring 765. However, the elastic force of the plate spring 795 is not used to fix the cartridge 700 in the attachment position. For this reason, the elastic force of the plate spring 795 can be designed to be small. Therefore, the force by which the lower portion 771B of the stopper member 771 presses down the plate spring portions 795A, 795B may be small. This facilitates the attachment and removal of the cartridge 700.

Moreover, the distance between the shaft 785 and the upper part 782B of the side plate portions 782 is designed to be longer than the distance between the shaft 785 and the projection 783 of the main lever 780, and the distance between the shaft 785 and the engagement surface 784A. Accordingly, upon the principles of the lever and the fulcrum, the main lever 780 can be easily pivoted.

[OPERATION OF ELECTRIC STAPLER]

There will now be described an operation of the electric stapler 1 having the aforementioned construction.

A case will be described in which the electric stapler 1 is attached to a copying machine such that the table 100 is situated lower than the driving-out portion 720, as shown in FIG. 3.

Figure 56:
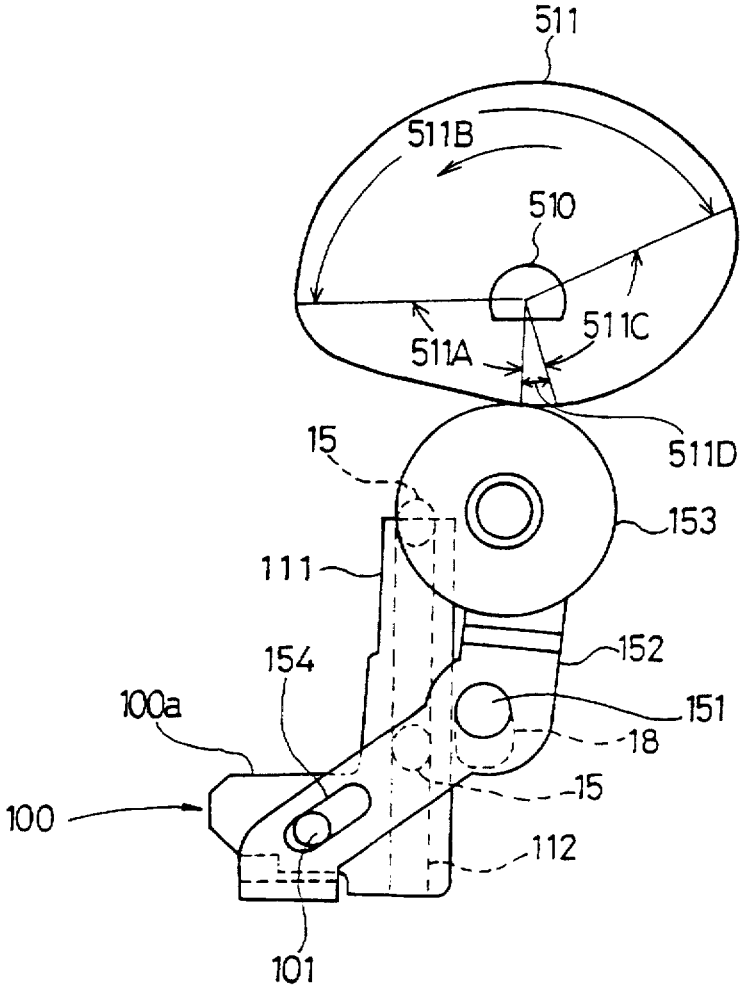
FIG. 56 is a descriptive drawing showing the relationship between the table and the table cam.

First, the cartridge 700 containing a pile of sheet-staples S is attached to the stapler body 700. When the motor M is not running, the table 100 is in an initial position shown in FIGS. 3 and 56, and the table cam 511 is in an initial position shown in FIGS. 3 and 56 such that the small-radius portion 511D of the table cam 511 is in contact with the roller 153.

When the motor M is driven by a stapling signal from a copying machine, the cam-driving shaft 510 is rotated counterclockwise (in FIG. 3) through the gears 501 to 504, and the cams 511 to 514 are rotated by the rotation of the cam-driving shaft 510.

Figure 57:
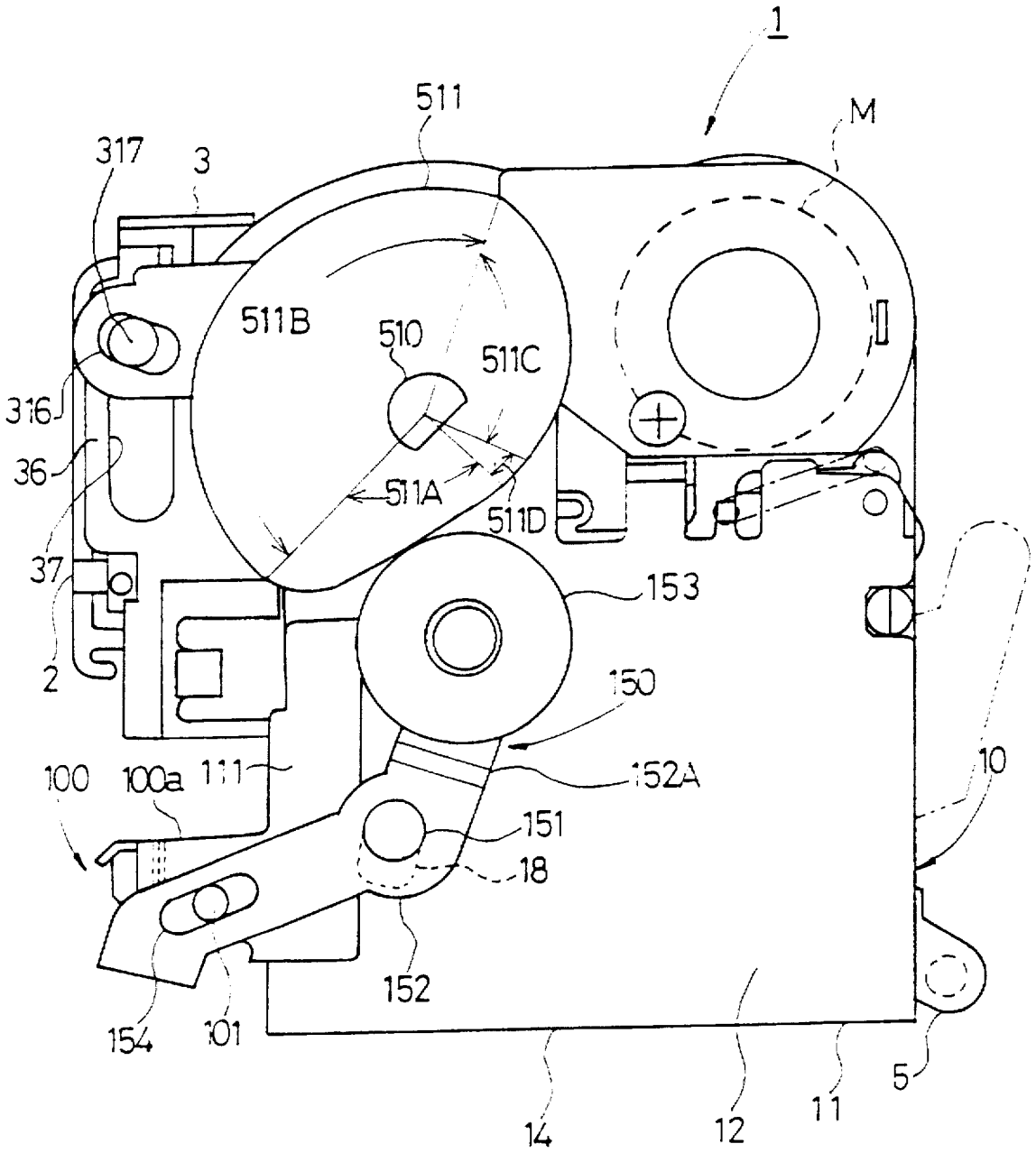
FIG. 57 is a descriptive drawing showing a state in which the table moves upward.

The linking member 152 is pivoted clockwise on the linking shaft 151 when the roller 153 begins to come in contact with the circumferential surface of the enlarging portion 511A from that of the small-radius portion 511D of the table cam 511 by the rotation of the table cam 511. Since the projection 15 of the side plates 12, 13 of the frame 14 is engaged with the guiding groove 112 of the guiding portion 111, the table 100 moves upward and downward without changing the predetermined position, as shown in FIG. 57, when the linking member 152 is pivoted.

Figure 28:
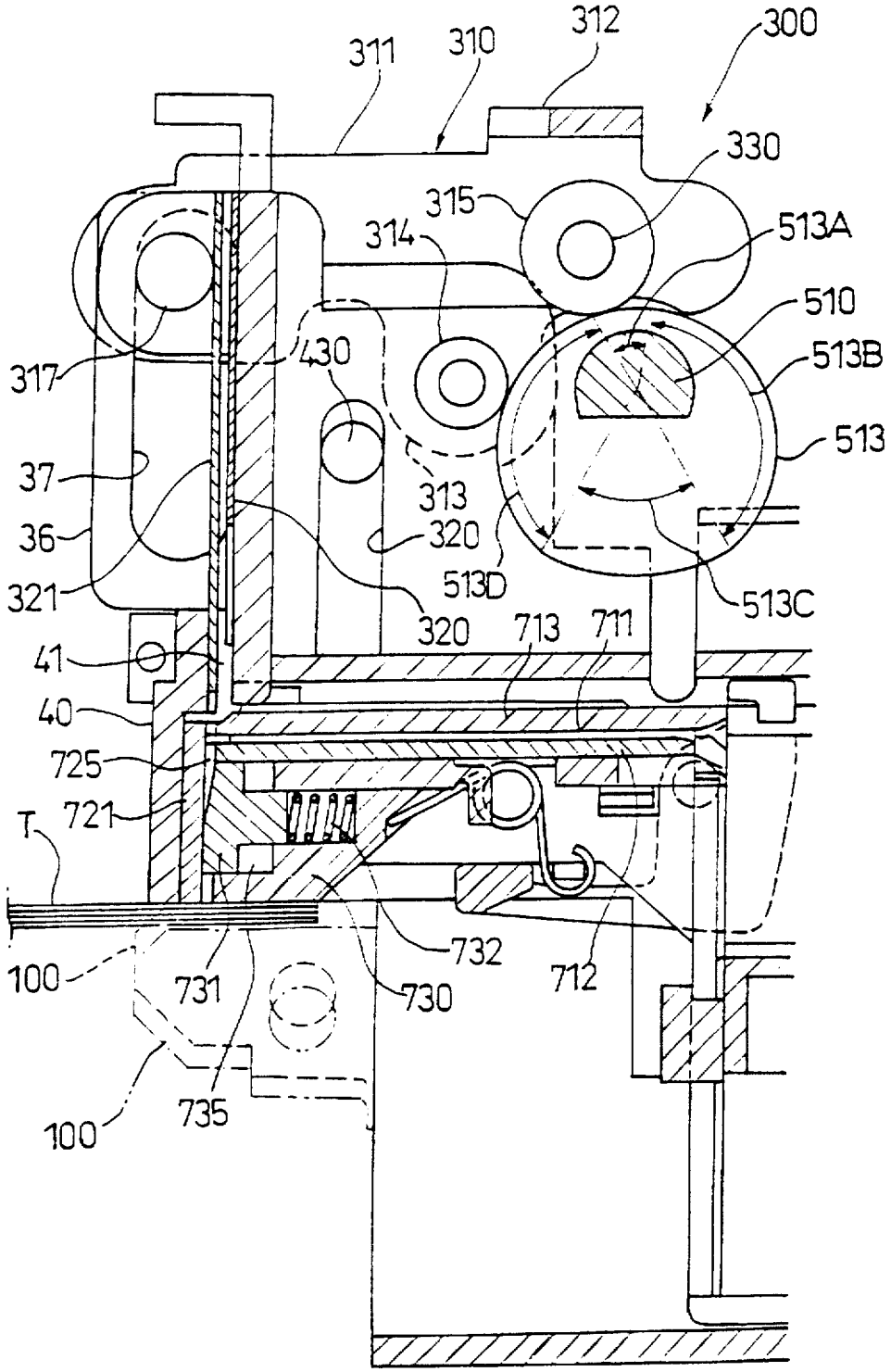
FIG. 28 is a descriptive drawing showing the driving mechanism and a driving position.
Figure 58:
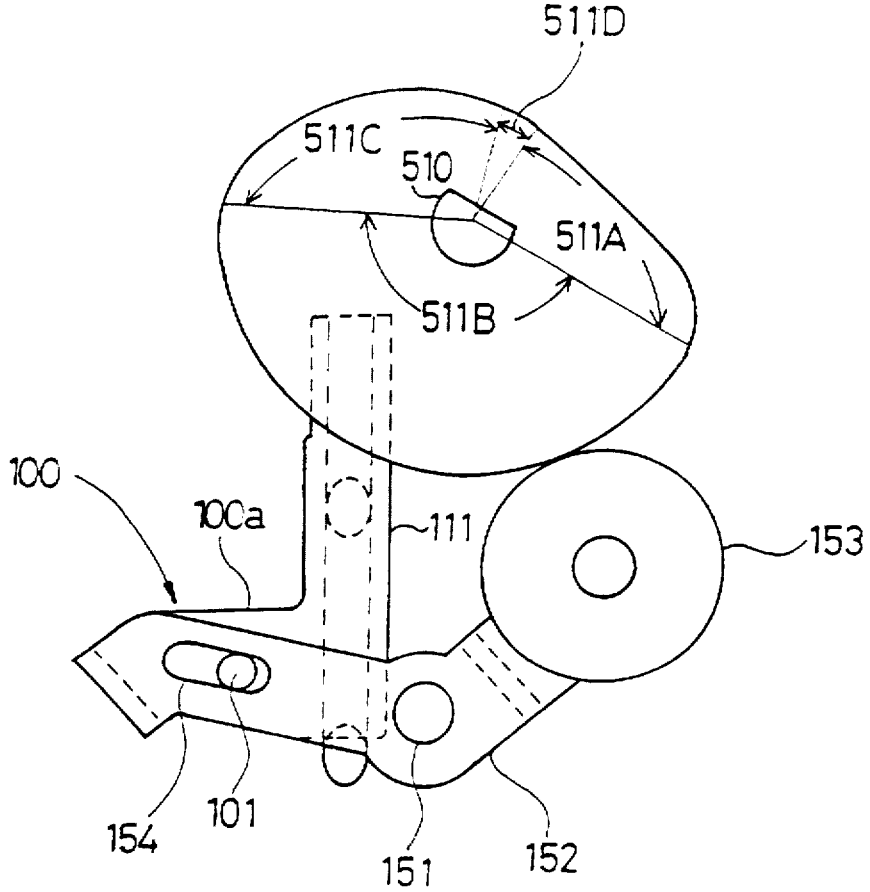
FIG. 58 is a descriptive drawing of a table link when the table has reached a top dead point.
Figure 59:
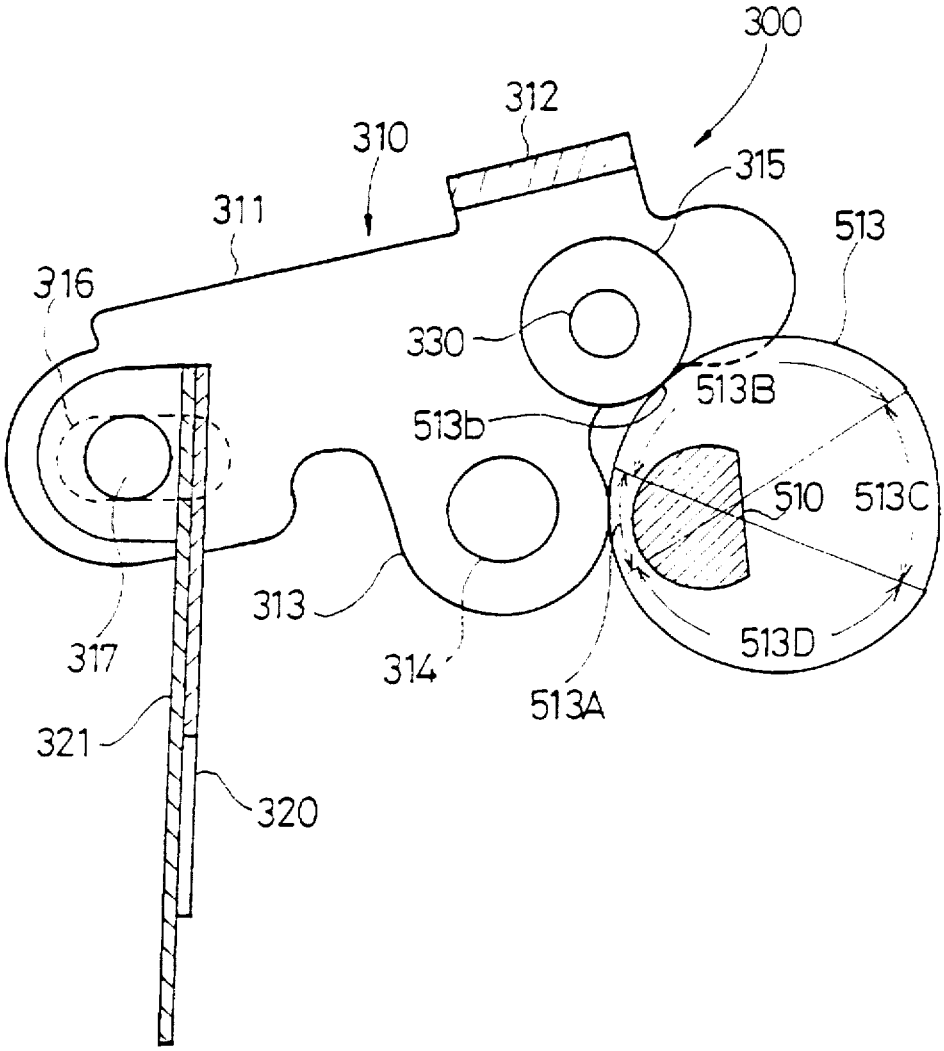
FIG. 59 is a descriptive drawing of the driving link and a driving cam when a driver has moved slightly downward.
Figure 60:
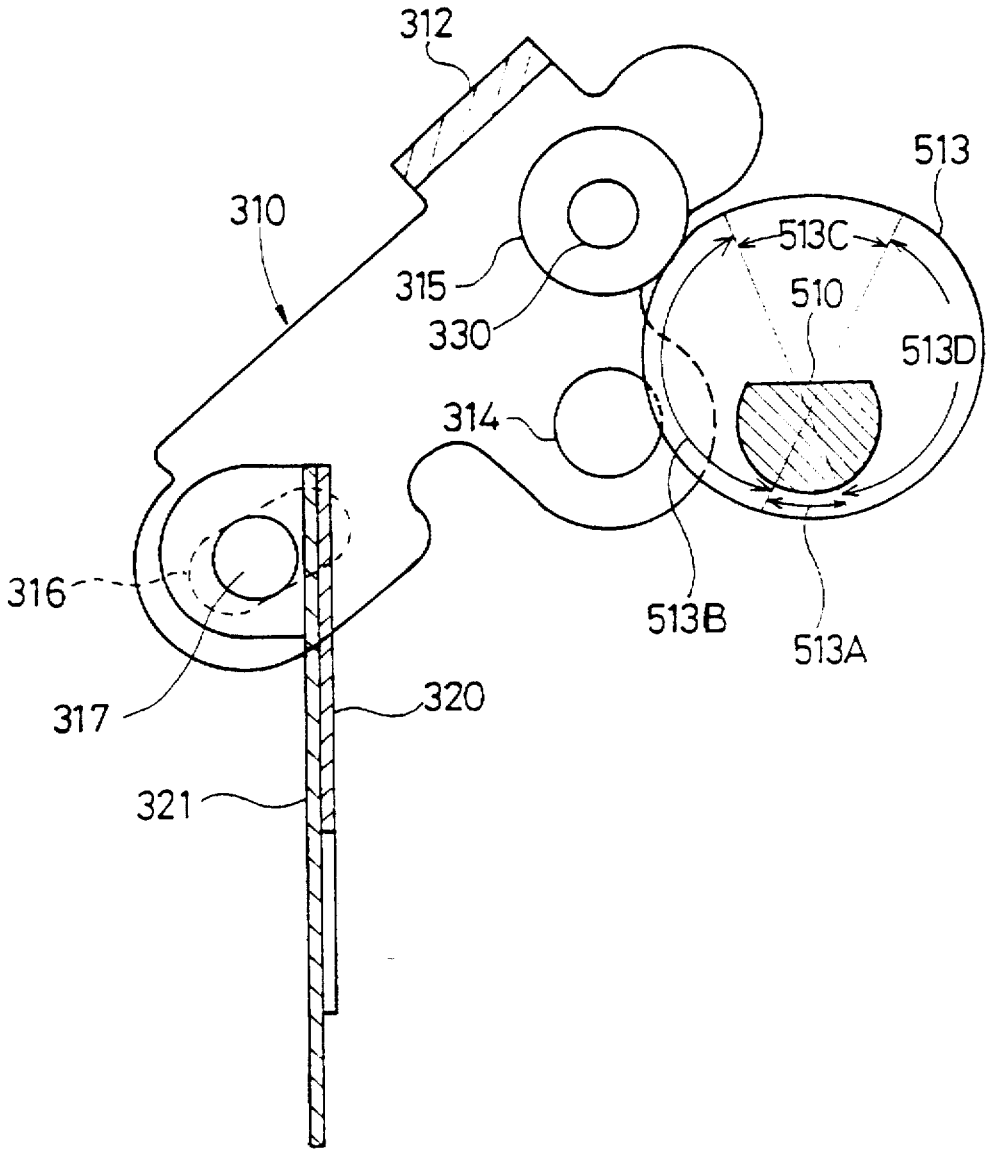
FIG. 60 is a descriptive drawing of the driving link and the driving cam when a staple has been driven out.

As shown in FIG. 58, when the roller 153 begins to come in contact with the circumferential surface of the large-radius portion 511B of the table can 511, in other words, when the cam-driving shaft 510 is rotated in a substantially 90-degree arc, the table 100 moves upward to a position (a top dead point) of the lower surface 720A of the driving-out portion 720, and then holds the sheets T therebetween (see a dashed line in FIG. 28). The clinching operation members 410, 411 also move upward along with the table 100, and the inclined surfaces 410A, 411A of the clinching operation members 410, 411 come in contact with the shaft 430 (see FIG. 61).

In the case where the sheets T are thick, as shown by a chain line in FIG. 28, the table 100 does not move upward to the top dead point, and accordingly the linking member 152 is not pivoted by a predetermined angle. At this time, the table cam 511 presses downward the roller 153, so that the linking shaft 151 moves downward along the long hole 18 against the spring 155. Regardless of the thickness of the sheets T, the table cam 511 can be rotated smoothly by the downward movement of the linking shaft 151.

While the roller 153 is in contact with the circumferential surface of the large-radius portion 511B of the table cam 511, the table 100 remains at the top dead point (a position shown by a chain line in FIG. 28 in the case where the sheets T are thick), and the sheets T remains held.

Figure 29:
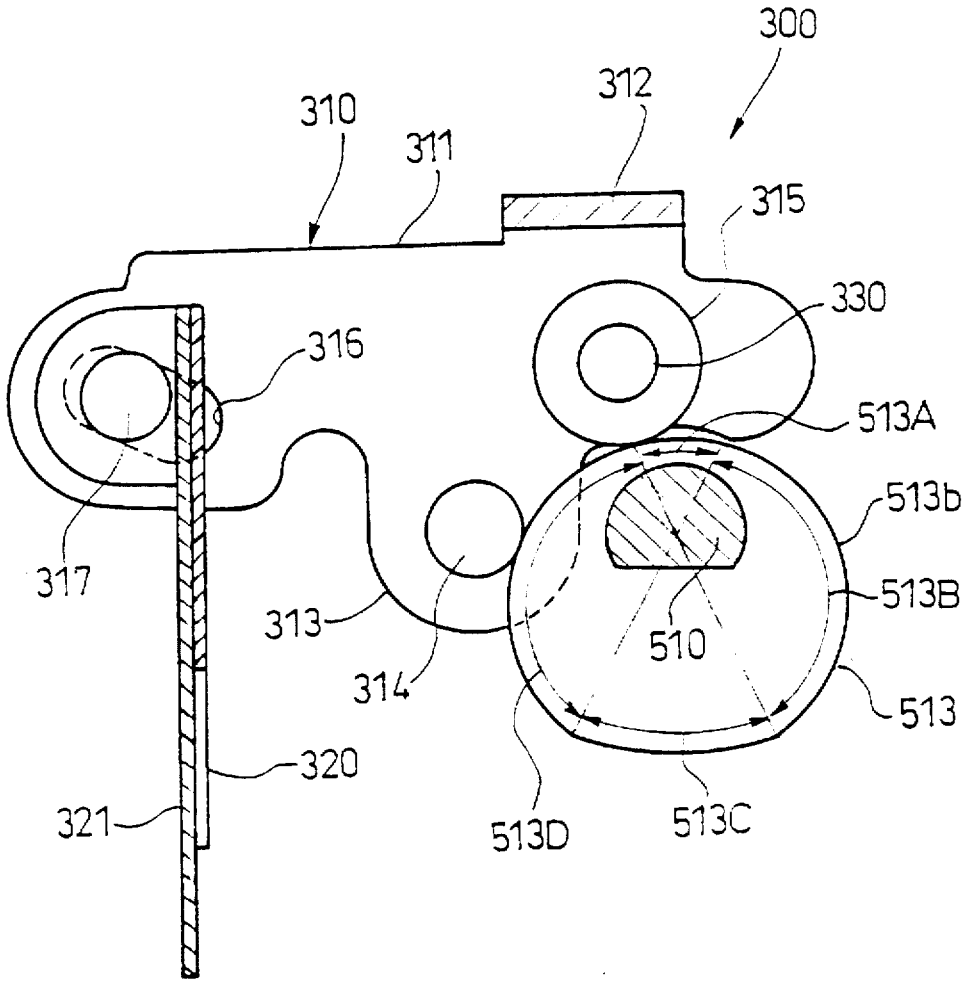
FIG. 29 is a descriptive drawing showing the driving mechanism.

The driving cam 513 is rotated counterclockwise from a position shown in FIG. 29 (an initial position) along with the cam-driving shaft 510, and the roller 315 begins to come in contact with the circumferential surface of the enlarging portion 513B of the driving cam 513 from that of the small-radius portion 513A thereof. The driving link 310 is pivoted counterclockwise (in FIG. 29) on the shaft 314 by the contact of the roller 315 with the circumferential surface of the enlarging portion 513B, and the driving shaft 317 moves downward along the hole 37 of the holding portion 36 of the magazine 30. The forming plate 320 and the driver 321 move downward along with the driving shaft 317.

When the table 100 has reached the top dead point, the roller 315 comes in contact with the position 513*b* of the enlarging portion 513B of the driving cam 513. Additionally, the driving shaft 317, the forming plate 320, and the driver 321 have slightly moved downward as shown in FIG. 48, because the cam-driving shaft 510 has been rotated by an angle of substantially 90-degree.

Figure 70:
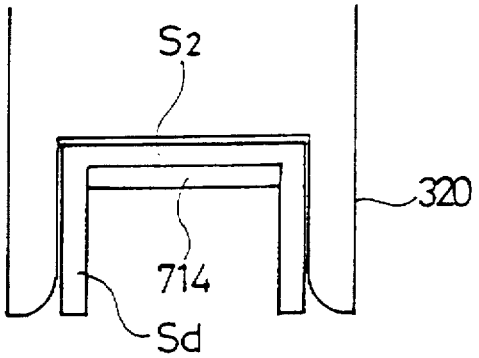
FIG. 70(A) is a descriptive drawing of a staple formed into a U shape.
FIG. 70(B) is a descriptive drawing of the staple which has been driven into and has passed through the sheets.
Figure 70:
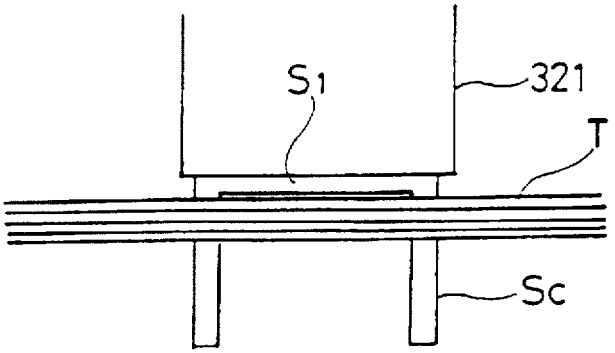

The cam-driving shaft 510 rotates even more, and the roller 315 comes in contact with the circumferential surface of the large-radius portion 513C, as shown in FIG. 49, from that of the enlarging portion 513B of the driving cam 513. Thereafter, the forming plate 320 and the driver 321 move downward even more along with the driving shaft 317 and enter the open space 725, 726 of the driving-out portion 720. As shown in FIG. 70, the forming plate 320 shapes a staple S2 like the letter U, and the driver 321 drives the U-shaped staple S1 from the driving outlet 725B of the driving-out portion 720 into the sheets T.

Figure 71:
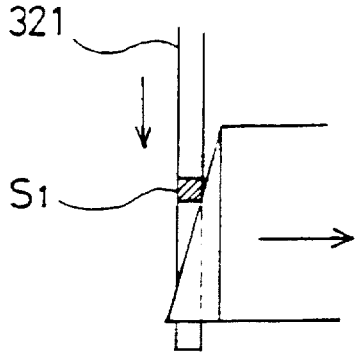
FIG. 71 is a descriptive drawing showing a retreating state of a pusher.

At this time, as shown in FIG. 71, the staple S1 is moved downward along the inclined surface 733 of the pusher 731 when the staple S1 is pushed downward by the driver 321. Thereby, the pusher 731 retreats into a hole 735 of the holding member 730 against the force of the spring 732.

When the staple S1 is driven from the driving outlet 725B into the sheets T, the staple S1 is held between the table 100 and the driving-out portion 720. Accordingly, the ends of the staple S1 can strike onto a predetermined position of the sheets T.

Figure 61:
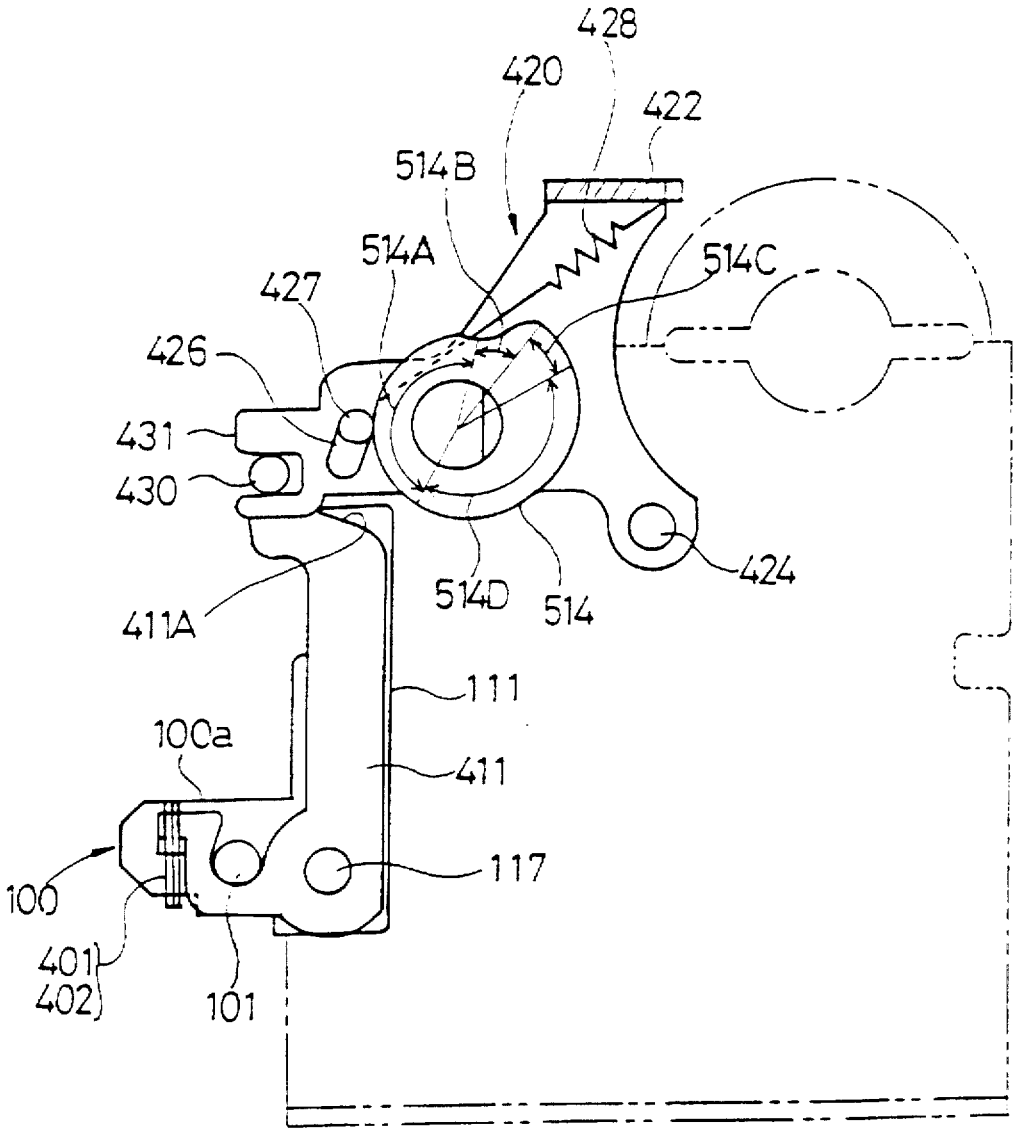
FIG. 61 is a descriptive drawing of the clinching link when a staple has been driven out.
Figure 62:
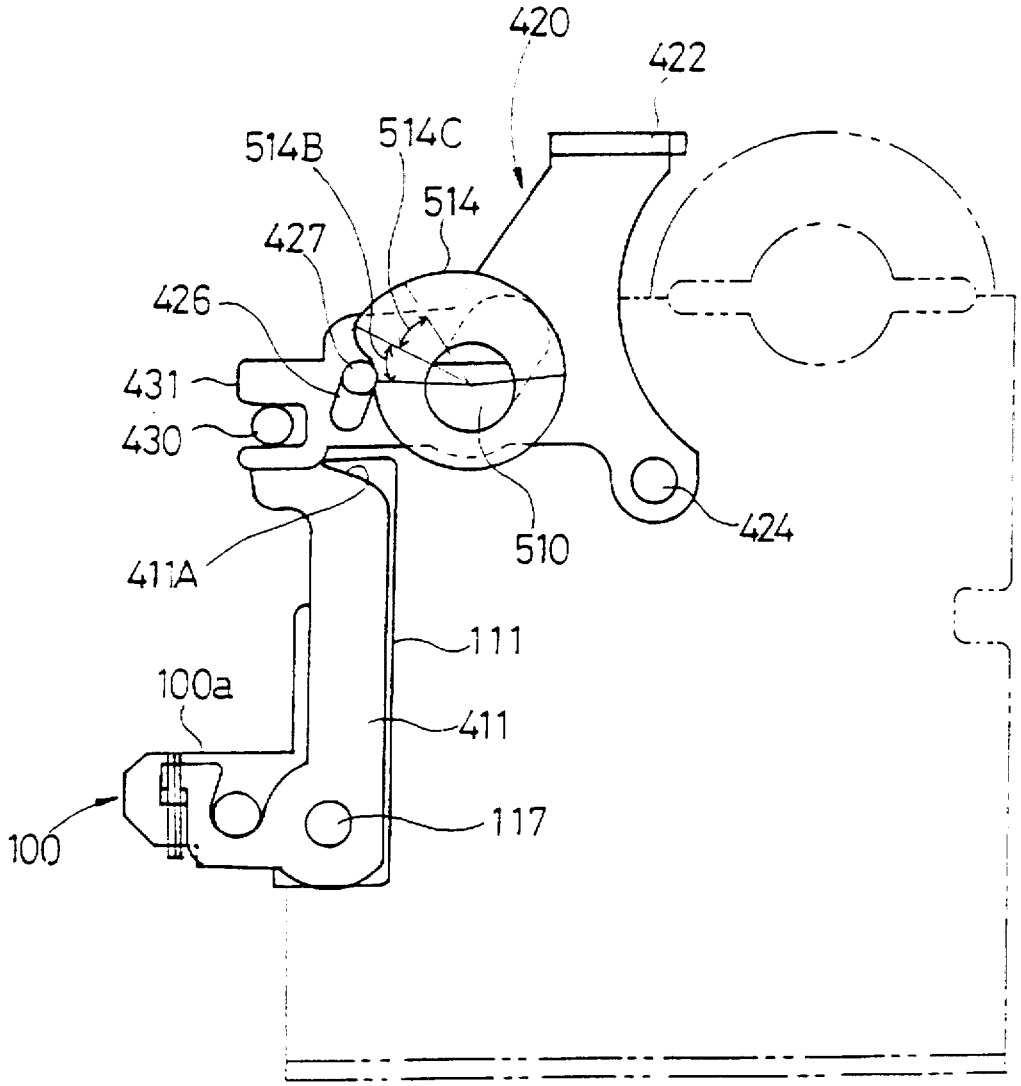
FIG. 62 is a descriptive drawing of a clincher actuating member when a clinching operation starts.

On the other hand, the clinching cam 514 is rotated counterclockwise from a state shown in FIG. 22 (an initial position) along with the driving shaft 510, and the table 100 reaches the top dead point. At this time, as shown in FIG. 61, the shaft 427 is in contact with the circumferential surface of the small-radius portion 514A of the clinching cam 514. Accordingly, the clinching link 420 is at a standstill. When the roller 315 comes in contact with the circumferential surface of the large-radius portion 513C of the driving cam 513 and a staple is driven out of the driving outlet 725B of the driving-out portion 720, as shown in FIG. 62, the shaft 427 begins to come in contact with the difference-in-level portion 514B of the clinching cam 514.

Figure 63:
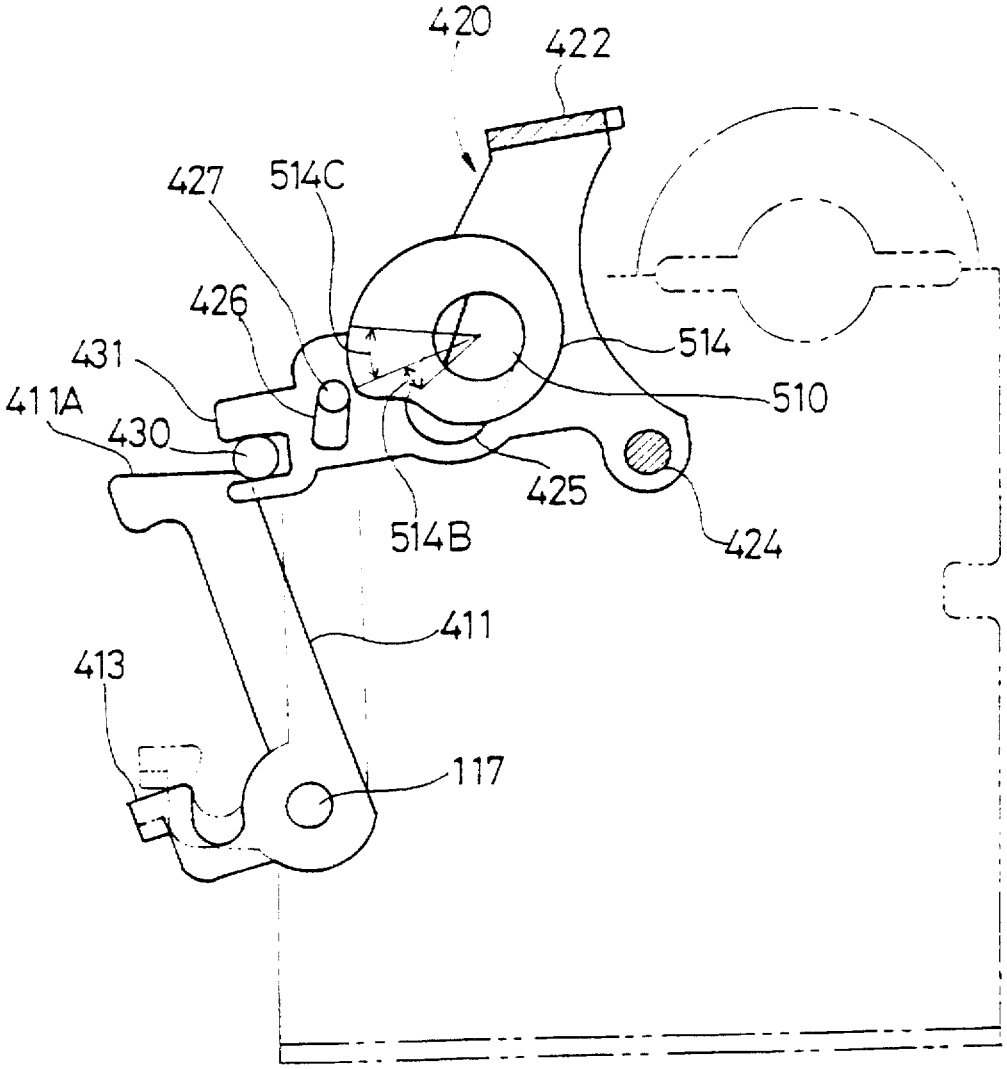
FIG. 63 is a descriptive drawing of the clincher actuating member when the clinching operation is completed.

When the cam-driving shaft 510 rotates counterclockwise even more from this state, the shaft 427 is pressed downward by the difference-in-level portion 514B of the clinching cam 514, and the clinching link 420 is pivoted counterclockwise on the shaft 424. According to the rotation of the clinching link 420, the shaft 430 moves downward along the long hole 32B of the upper side wall 32 of the magazine 30 and then presses downward the inclined surfaces 410A, 411A of the clinching operation members 410, 411. Thereby, as shown in FIG. 63, the clinching operation members 410, 411 are pivoted counterclockwise on the shaft 117 against the twisted coil spring 415.

Figure 64:
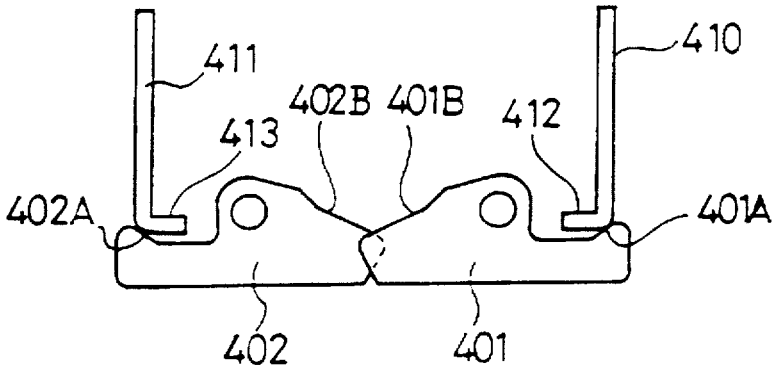
FIG. 64 is descriptive drawing showing a state of a clincher before the clinching operation is carried out.
Figure 65:
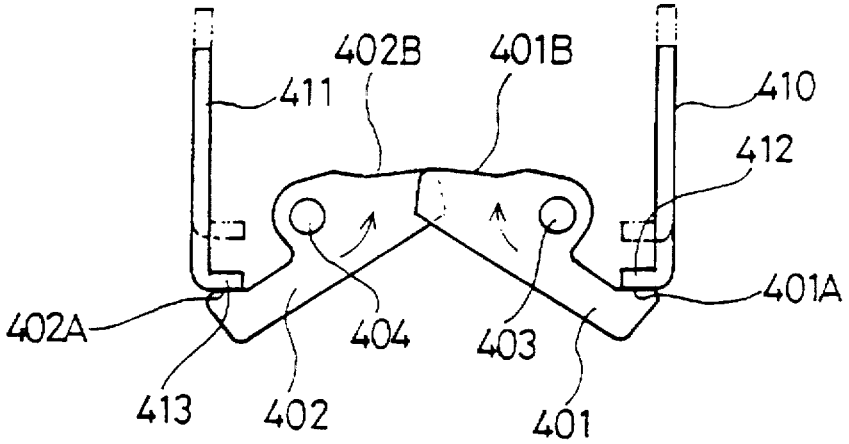
FIG. 65 is a descriptive drawing showing a state of the clincher when the clinching operation is completed.

When the clinching operation members 410, 411 are pivoted, as shown in FIG. 64, the pressing portions 412, 413 of the clinching operation members 410, 411 press down the rear parts 401A, 402A of the clinchers 401, 402. As shown in FIG. 65, the clinchers 401, 402 are pivoted in the direction of an arrow on the shafts 403, 404, and then the end portions Sc of the staple S1 (see FIG. 70) which have passed through the sheets T are flattened and clinched.

This clinching operation is designed to be carried out within a period when the roller 315 is in contact with the circumferential surface of the large-radius portion 513C of the driving cam 513 and within a period when the roller 153 is in contact with the circumferential surface of the large-radius portion 511B of the table cam 511. Hence, the table 100 is at a standstill at the top dead point (a position shown by a chain line in FIG. 28 in the case where the sheets T are thick), and additionally the driver 321 is at a standstill in the backmost position. Accordingly, a clinching operation can be carried out for a certainty.

According to the aforementioned mechanism, the staple S1 is driven into the sheets T and is clinched after the table 100 has been moved upward to hold the sheets T therebetween. In other words, the upward movement of the table 100 and the driving and clinching operations of the staple S1 are carried out at intervals of time. Therefore, the driving force required to move the table 100 upward and drive and clinch the staple S1 has no need to be used simultaneously. As a consequence, even if the driving force of the motor M is small, the purpose can be answered, and therefore a small-sized motor can be used.

Furthermore, the table 100 merely moves upward and downward (i.e., reciprocates), and the stapler body 10 to which the cartridge 700 is attached does not move up and down. Thus, the noise produced by the operation can be abated to a small level.

Besides, a clinching operation is carried out such that the rear parts 401A, 402A of the clinchers 401, 402 are pressed down by the clinching operation members 410, 411. Thus, the lengths of the clinching portions 401B, 402B are designed to be longer than those between the shafts 404, 405 and the rear parts 401A, 402A, respectively, and thereby the distance of pressing down the rear parts 401A, 402A of the clinchers 401, 402 can be made smaller. Moreover, since the clinchers 401, 402 are pivoted by the clinching operation members 410, 411, a motor for driving the clinchers 401, 402 is not required to be mounted in the table 100. As a result, the table 100 can be thinned and lightened.

Figure 66:
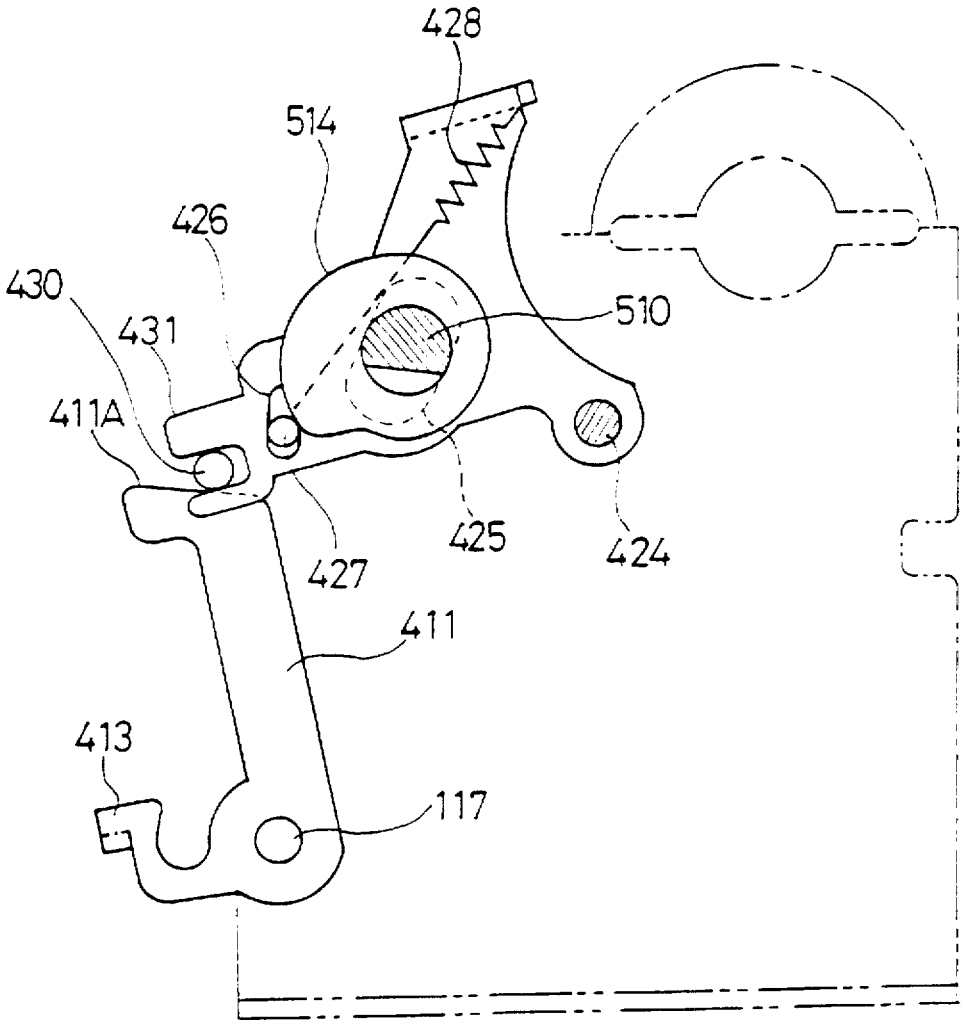
FIG. 66 is a descriptive drawing showing the operation of the clinching mechanism in the situation in which sheets of paper to be fastened together are thick.

In the case where the sheets T are thick, the lengths of the end portions Sc of the staple S1 (see FIG. 70) which have passed through and have projected from the sheets T are short, and accordingly the angles by which the clinchers 401, 402 are pivoted on the shafts 404, 405 become small, in other words, the angle by which the clinching operation members 410, 411 are pivoted on the shaft 117 also becomes small. Additionally, the angle by which the clinching link 420 is pivoted becomes small. Consequently, the clinching cam 514 is brought in a locked state. As shown in FIG. 66, however, the shaft 427 moves downward along the long hole 426 against the force of a spring when the clinching cam 514 is pivoted, and thereby the clinching cam 514 can be pivoted smoothly without being locked.

Figure 67:
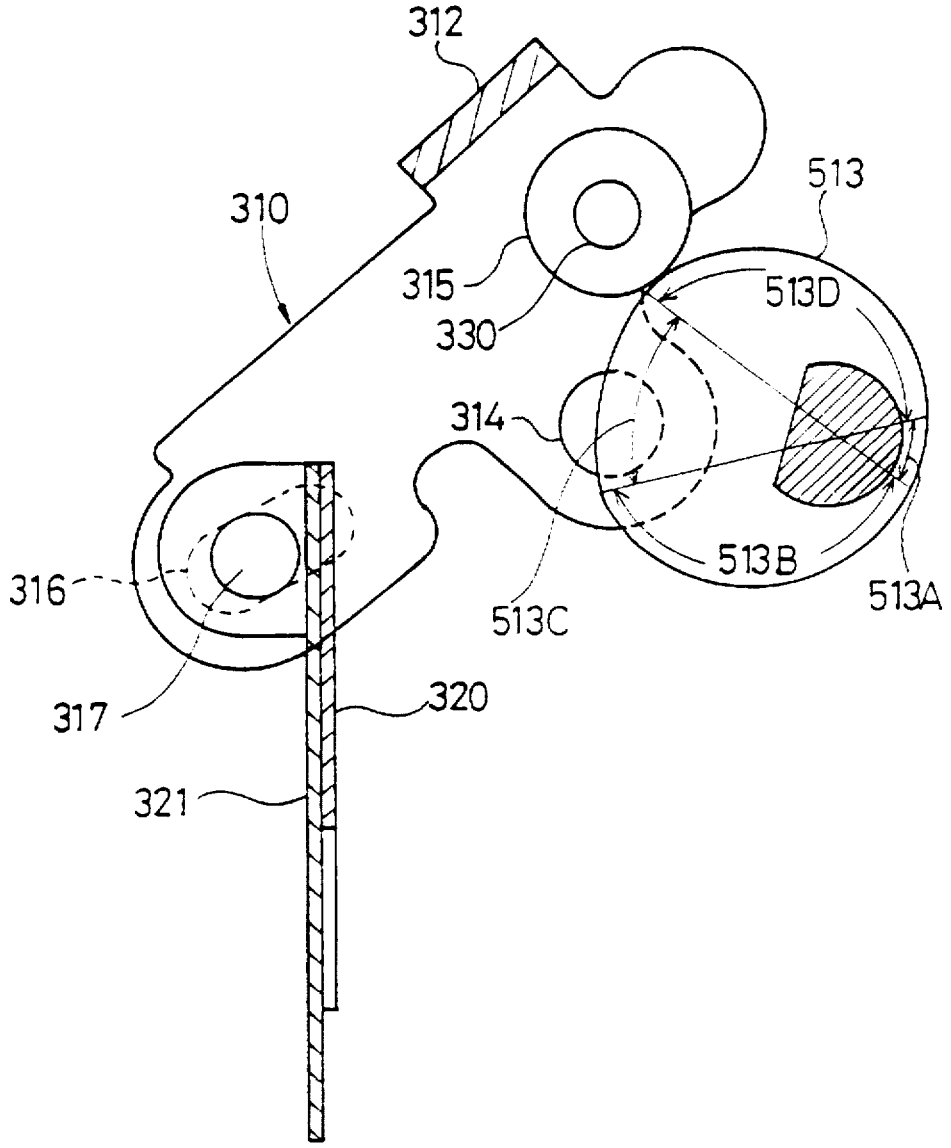
FIG. 67 is a descriptive drawing showing a state in which the driver begins to move upward.
Figure 72:
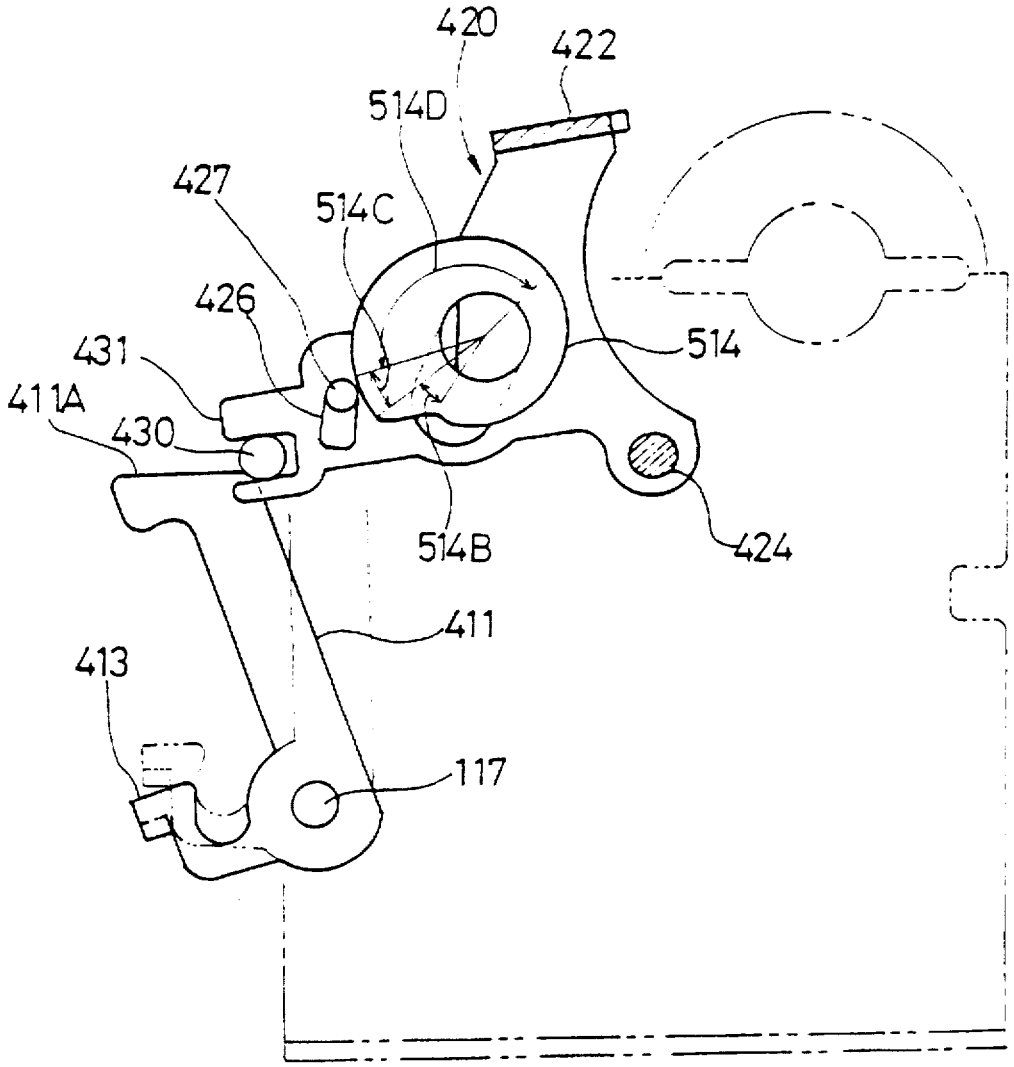
FIG. 72 is a descriptive drawing of the clinching cam after a clinching operation is carried out.

When the cam-driving shaft 510 rotates even more, the roller 315 and the shaft 427 come in contact with the circumferential surface of the reducing portions 513D, 514D of the driving cam 513 and the clinching cam 514, respectively, as shown in FIGS. 67 and 72. Thereby, the driving link 310 and the clinching link 420 are pivoted clockwise, and the clinching operation members 410, 411 are pivoted clockwise and are returned to the erected state by the force of the twisted coil spring 415. Simultaneously, the clinchers 401, 402 are also returned to the original state. Thus, the forming plate 320 and the driver 321 move upward.

According to the upward movement of the driver 321, the pusher 731 is moved forward from the hole 735 of the holding member 730 by the force of the spring 732 so that a leg portion Sd of the U-shaped staple S2 comes in contact with a contact surface 734 of the pusher 731 (see FIG. 30). As a result, the staple S2 is delivered forward, and thereby the sheet-staple S following the staple S2 is delivered forward.

When the forming plate 320 and the driver 321 are moved upward to a given position by the rotation of the cam-driving shaft 510, in other words, when the roller 153 comes in contact with the circumferential surface of the reducing portion 511C, the table 100 begins to descend.

When the table 100 reaches the given position, in other words, when the table 100 completely releases the hold of the sheets T, the sensor plate 602 intercepts the beam of light emitted by the light emitting diode 604A. The light receiving sensor 604B detects the interception and outputs an interception detecting signal. A copying operation of the copying machine is started in response to the interception detecting signal, and therefore the continuous operations from copying to stapling can be carried out rapidly.

When the cam-driving shaft 510 rotates and the roller 153 comes in contact with the small-radius portion 511D of the table cam 511, the table 100 returns to the home position. At this time, the forming plate 320 and driver 321 also return to their original positions.

When the table 100 returns to the home position, the sensor plate 601 intercepts the beam of light emitted by the light emitting diode 603A. The light receiving sensor 603B detects the interception and outputs a position detecting signal. According to the position detecting signal, the control circuit judges that the table 100 has returned to the home position, and a wait for the next stapling operation is provided.

There will now be described the operation of the delivering mechanism 200.

When the table 100 is in an initial position, the delivering cams 512 on the cam-driving shaft 510 is in a condition shown in FIG. 31. When the cam-driving shaft 510 rotates counterclockwise from this condition, namely, when the table 100 begins to move upward, the first difference-in-level portion **512*a* of the delivering cam 512 comes in contact with the projection 202 of the first delivering lever 201**.

When the cam-driving shaft 510 rotates and the table 100 moves upward, the first delivering lever 201 is moved backward (i.e., in the rightward direction in FIG. 68) by the delivering cam 512 against the force of the spring 208, as shown in FIG. 57. By the backward movement of the first delivering lever 201, the hook 203 of the first delivering lever 201 is engaged with the hook **231*a* of the ratchet 231, so that the ratchet 231 rotates clockwise. By the rotation of the ratchet 231, the shaft 233 and the roller 232** are rotated clockwise, and thereby the sheet staple S is delivered forward.

On the other hand, by the backward movement of the first delivering lever 201, the rod portion 206 of the first delivering lever 201 pushes the upper part 211 of the second delivering levers 210, 215 backward. Thereby, the second delivering levers 210, 215 can be pivoted on the shaft 19 clockwise (in FIG. 68).

By the clockwise movement of the second delivering levers 210, 215, the delivering plate body 220 is moved forward so that the step portion **222*d* of the delivering plate 222D is brought into contact with the rear end Sa of the sheet-staple S, which is the uppermost one of the piled sheet-staples in the cartridge 700, and the sheet-staple S is delivered forward. That is, the sheet-staple S is delivered from the cartridge 700 by the delivering plate 222D and is delivered by the roller 232** forward even more.

Thus, since the step portion **222*d* of the delivering plate 222D comes in contact with the rear end Sa of the sheet-staple S and pushes the sheet-staple S, the sheet-staple S can be delivered from the cartridge 700 with certainty. In addition, since the table 100 moves merely upward and downward, a great impact is not made on the cartridge 700**. For this reason, the sheet-staple S is stably delivered.

Figure 68:
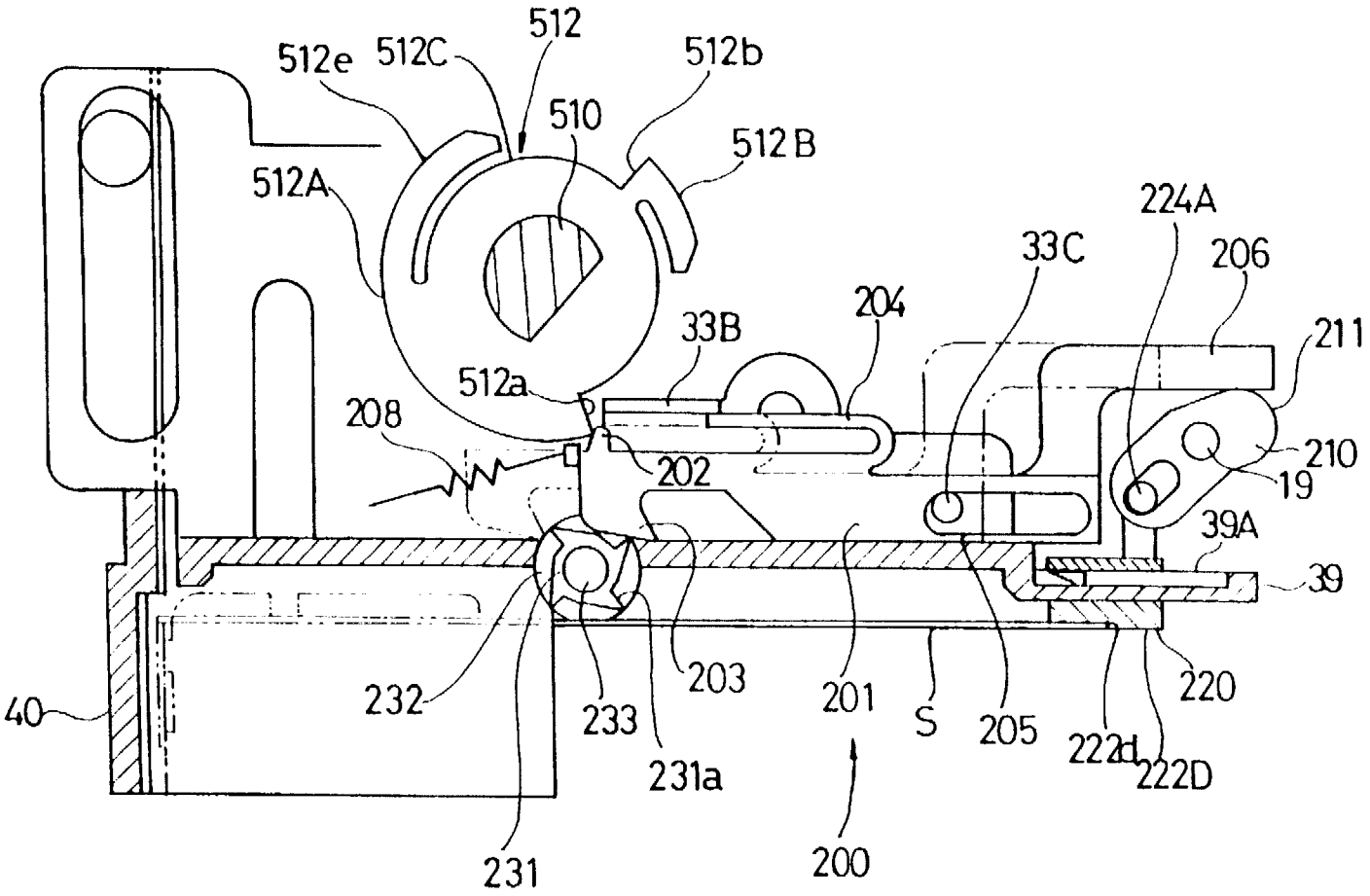
FIG. 68 is a descriptive drawing showing a delivering operation of the sheet-staples.

When the cam-driving shaft 510 rotates even more from the condition shown in FIG. 68, the projection 202 of the first delivering lever 201 disengages from the first difference-in-level portion **512*a* of the delivering cam 512, but the projection 202 comes in contact with the first large-radius portion 512A of the delivering cam 512. Therefore, the first delivering lever 201 keeps the condition shown in FIG. 68. In other words, the first delivering lever 201 is in that condition until the table 100 reaches the top dead point and the staple S1 is driven by the driver 321**.

Further, when the projection 202 of the first delivering lever 201 disengages from the first large-radius portion 512A of the delivering cam 512 because of the rotation of the cam-driving shaft 510, in other words, when the driving operation of the staple is completed, the first delivering lever 201 returns to its original position (shown in FIG. 31) by the spring 208. When the cam-driving shaft 510 rotates even more, the clinching operation of the staple S1 is completed and the table 100 descends from the top dead point. At this time, the second difference-in-level portion **512*b* of the second large-radius portion 512B of the delivering cam 512 comes in contact with the projection 202 of the first delivering lever 201**.

The delivering plate body 220 moves forward in the same way as mentioned above, so that the step portion **222*d* of the delivering plate 222D comes in contact with the rear end Sa of the sheet-staple S and delivers the sheet-staple S forward. When the projection 202 of the first delivering lever 201 disengages from the second large-radius portion 512B of the delivering cam 512 because of the rotation of the cam-driving shaft 510, the first delivering lever 201 returns to its original position (shown in FIG. 31) by the spring 208. After that, the table 100** returns to the home position.

As described above, during the period within which the table 100 moves upward from the home position to the top dead point and returns from the top dead point to the home position, namely, during one stapling operation, the sheet-staple S is delivered twice.

Figure 69:
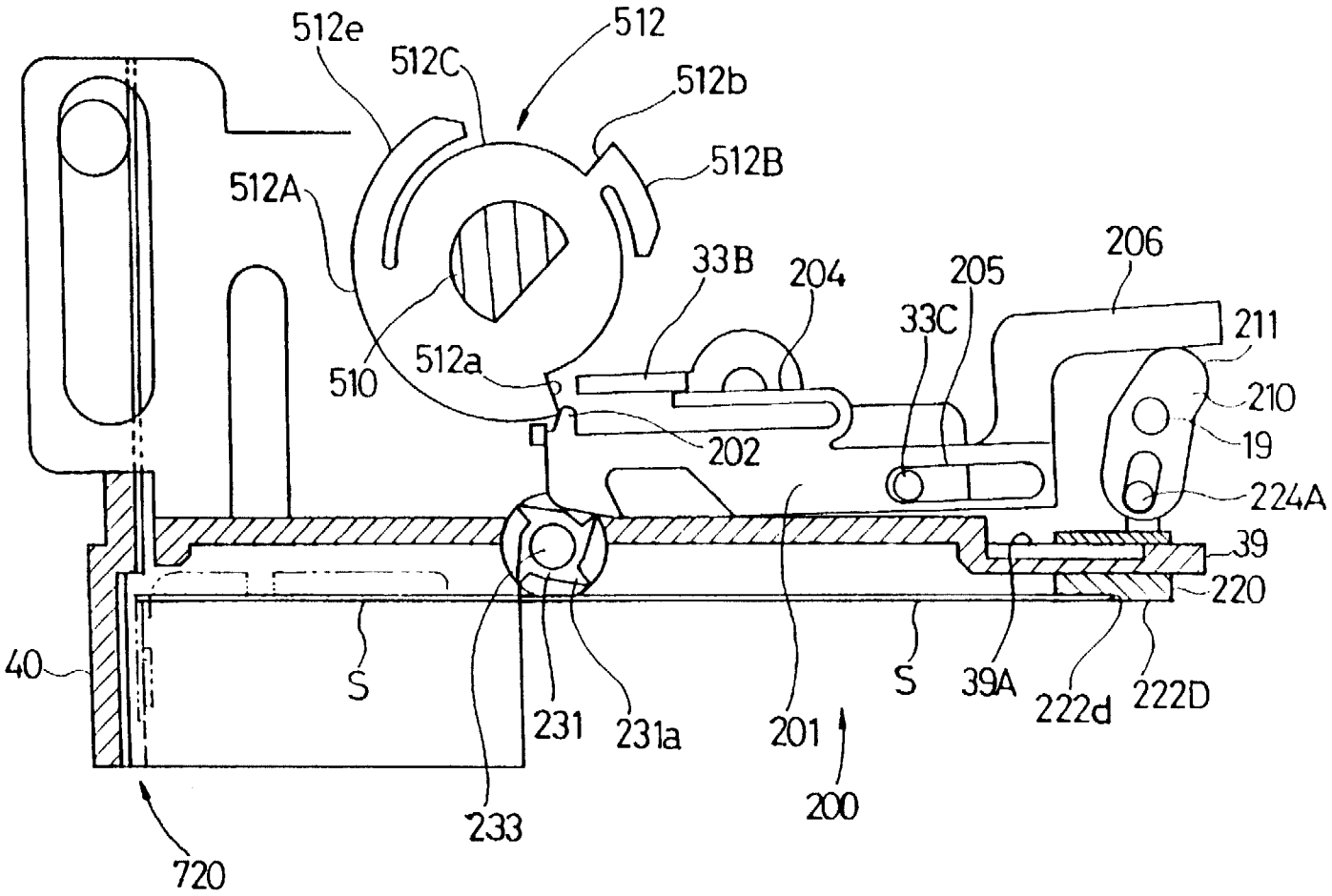
FIG. 69 is a descriptive drawing showing a state in which a second delivering lever is locked.

When the sheet-staples S are contiguously laid between the driving-out portion 720 and the cartridge 700, the delivering plate body 220 is locked within one stroke. For this reason, the second delivering lever 210 is stopped from rotating clockwise. However, as shown in FIG. 69, since the projection 33C is slidably inserted in the long hole 205 so that the rear portion of the first delivering lever 201 can be lifted, the rod portion 206 of the first delivering lever 201 rides on the upper portion 211 of the second delivering levers 210, 215 and thereby the first delivering lever 201 moves backward even more. For this reason, the delivering cam 512 can rotate smoothly.

When the cartridge 700 is first attached to the stapler body 10, since there is no staple S1 in the open space 725 of the driving-out portion 720 (see FIG. 28), the control circuit mounted on the circuit base 610 drives the motor M until the staple S1 is delivered to the open space 725. In other words, the motor M is driven and the sheet staple S is merely delivered without driving a staple until the microswitch detects the staple S1 via the actuator 2.

By this delivering operation, the sheet-staple S which is the uppermost sheet-staple of the piled sheet-staples in the cartridge 700 is delivered to the driving-out portion 720. When the cam-driving shaft 510 rotates one time, the sheet-staple S is delivered twice by the delivering cam 512. Thus, the sheet staples can be effectively delivered.

In a case in which the electric stapler 1 is attached to the copying machine upside down (i.e., the table 100 is disposed with the face upward whereas the driving-out portion 720 is disposed with the face downward), the same operations as above are carried out to drive and clinch the staple and deliver the sheet-staple S. Even if the electric stapler 1 is used upside down, the table 100 moves merely upward and downward, and therefore the driving force for moving the table 100 upward and downward is entirely the same as that of FIG. 3. For this reason, the electric stapler 1 can be used regardless of the type of a copying machine to be used.

Additionally, since the cartridge 700 is attached to the stapler body 10 merely by insertion from the rear portion of the stapler body 10, the cartridge 700 can be easily attached to and detached from the stapler body 10 even if the electric stapler 1 is mounted upside down.

Moreover, the mechanisms 150, 200, 300 and 400 are provided with the cam 511, 512, 513 and 514, respectively, and the members 100, 220, 321, 401, 402 are operated independently of one another. Accordingly, the respective operations, namely, the upward movement of the table 100, the driving and clinching of the staple S1, and the delivery of the sheet-staples S can be certainly carried out at intervals of time among one another. In addition, optimum operations for the members 100, 220, 321, 401 and 402 can be carried out.

In the above-mentioned embodiment, a description was given of the electric stapler 1 provided with the cartridge 700 which contains a pile of sheet staples S. But, the present invention is not limited to this. The present invention is applicable to, for example, an electric stapler in which sheet staples are cylindrically rolled or wires are cut to make a staple with a given length when stapling.

Also, in the above-mentioned embodiment, a description was given of a case in which the electric stapler 1 is mounted in the copy machine. But, the present invention is not limited to this. The electric stapler 1 may be mounted in a printer, a fax machine, or the like.

Embodiment 2

Figure 73:
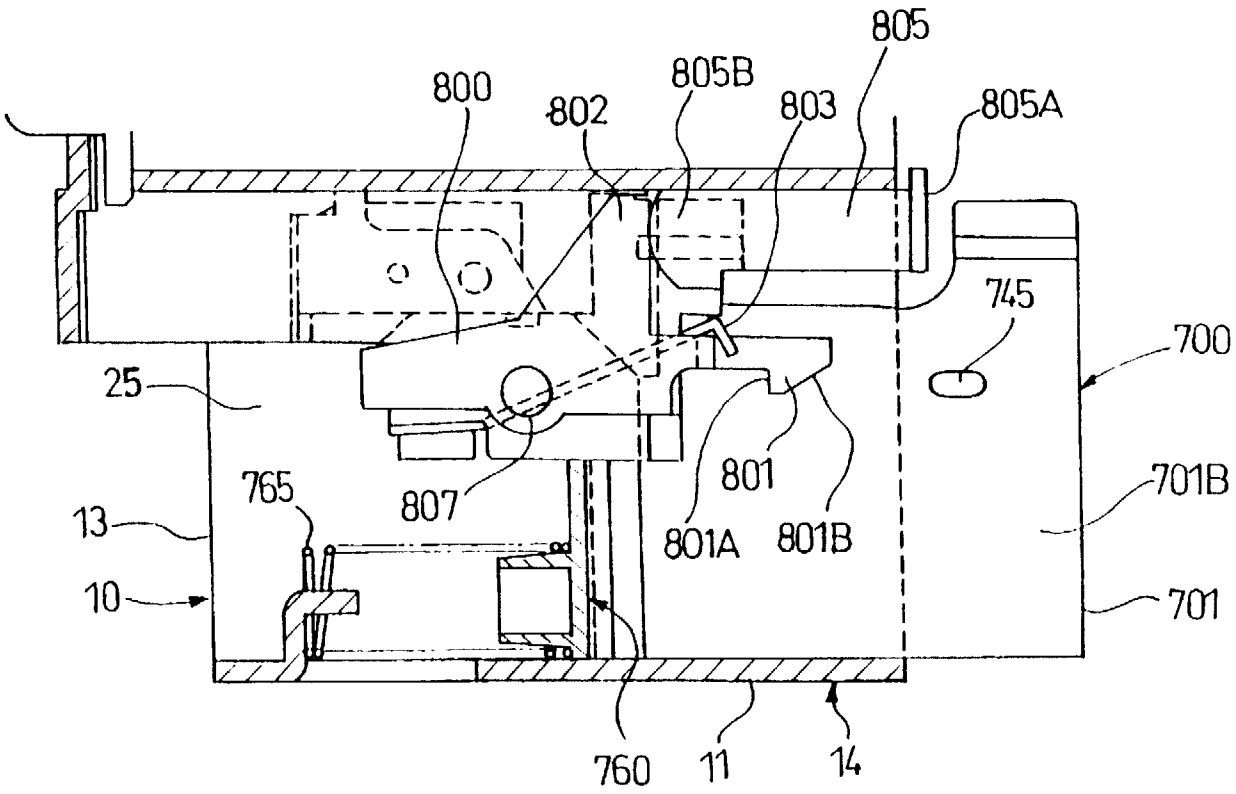
FIG. 73 is a descriptive drawing showing a construction of a second embodiment.
Figure 74:
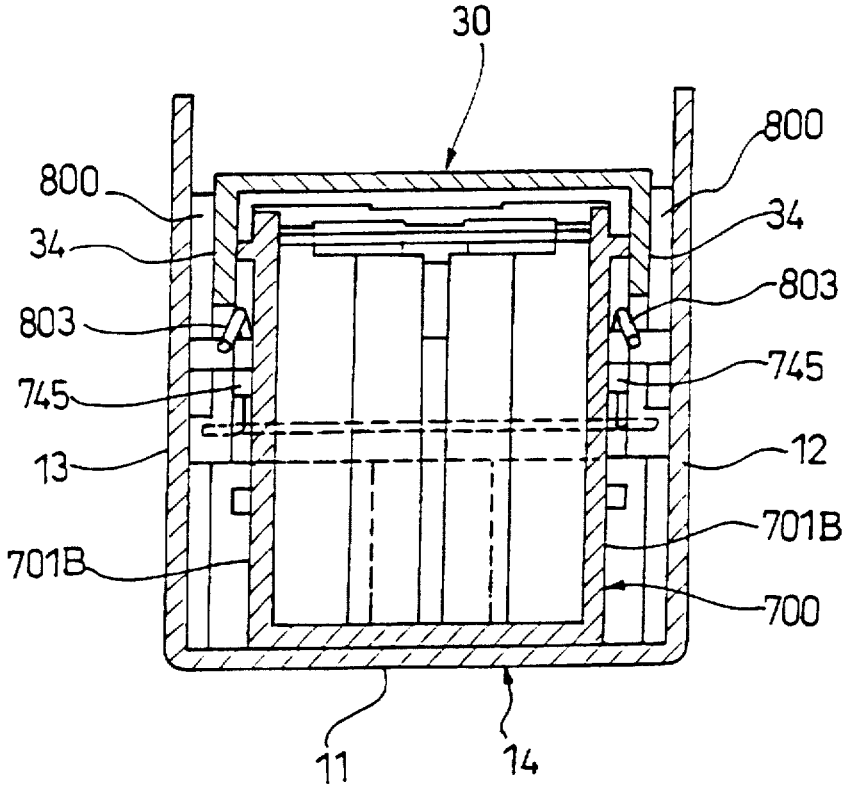
FIG. 74 is a sectional view of FIG. 73.

In FIGS. 73 and 74, reference numeral 745 denotes a hooking portion formed on both side-walls 701B of the cartridge body 701, and reference numeral 800 is a lever mounted outside the lower side-wall 34 of the magazine 30. The lever 800 includes a hook-shaped engagement portion 801 which is engaged with the hooking portion 745 and a projection 802 which projects upward. Moreover, at a rear portion of the engagement portion 801, there is formed an inclined surface 801B which faces downward and is caused to come in contact with the hooking portion 745.

The lever 800 is pivotable on a shaft 807 disposed on the lower side-wall 34 of the magazine 30. The lever is always forced clockwise by a spring 803 and is controlled not to rotate clockwise from a position shown in FIG. 73.

Outside the lower side wall 34 of the magazine 30, a button 805 (a releasing member) is mounted movably backward and forward. An operated portion 805A of the button 805 projects from the stapler body 10. A front end 805B of the button 805 is in contact with the projection 802 of the lever 800.

In order to attach the cartridge 700 to the stapler body 10, the cartridge 700 is inserted into the cartridge chamber 25 from the rear part of the stapler body 10 in the same way as above (see FIG. 73). Thereby, the cartridge body 701 is held by and between the projections 766A of the holding pieces 766 of the cartridge guide 760.

Figure 75:
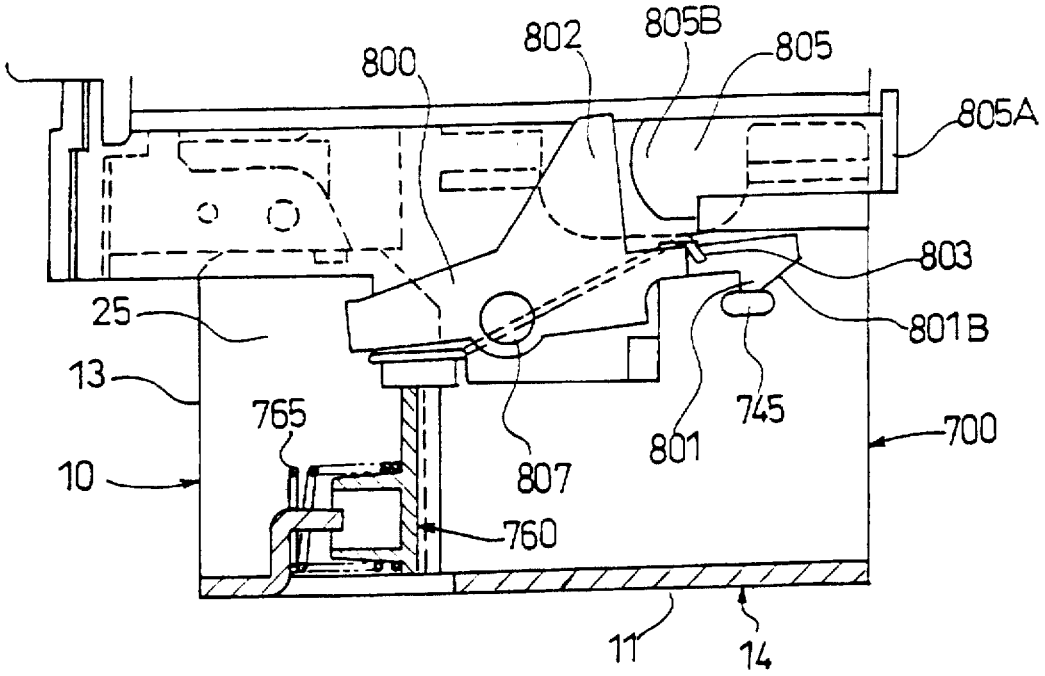
FIG. 75 is a descriptive drawing for explaining how the cartridge is inserted into the insertion position.
Figure 76:
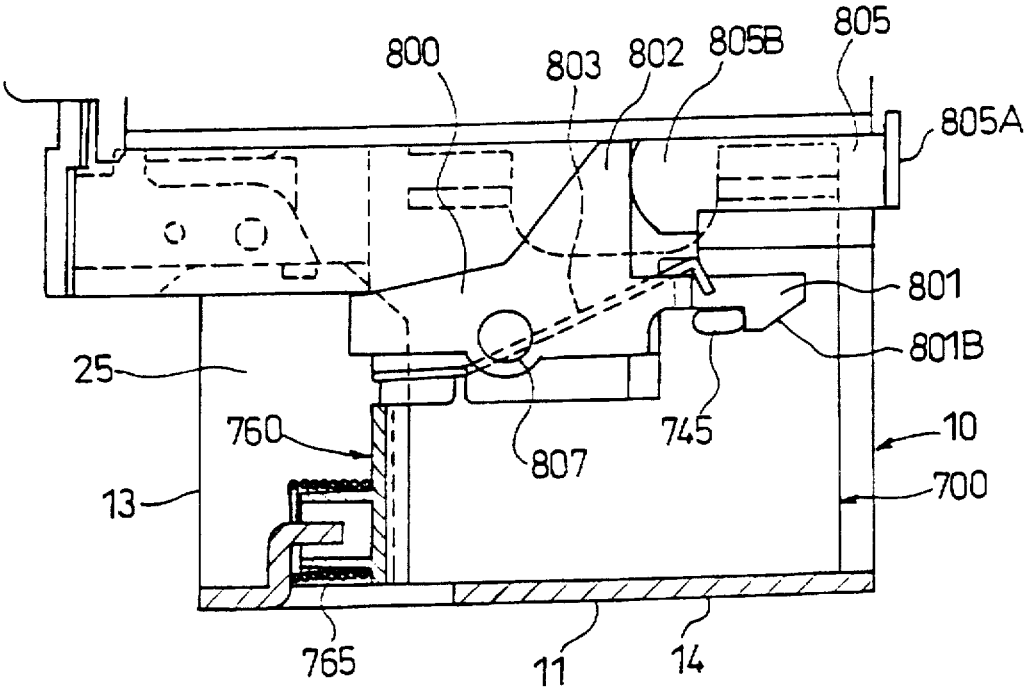
FIG. 76 is a descriptive drawing of the cartridge fixed in the insertion position.

When the cartridge 700 is pushed forward along with the cartridge guide 760 against the force of the spring 765, the hooking portion 745 comes in contact with the inclined surface 801B of the engagement portion 801 of the lever 800, so that the lever 800 is rotated counterclockwise against the force of the spring 803, as shown in FIG. 75. When the cartridge 700 is pushed forward even more and approaches the attachment position, the hooking portion 745 is engaged with the engagement portion 801 of the lever 800, as shown in FIG. 76.

By this engagement, the cartridge 700 is fixed in the attachment position. Even if the cartridge 700 is moved backward by a great impact, the cartridge 700 does not disengage from the hooking portion 745 because the engagement portion 801 of the lever 800 is shaped like a hook. The cartridge 700 remains fixed in the attachment position of the stapler body 10.

As described above, the cartridge 700 is not designed to be fixed in the attachment position by the aid of the force of the spring 765. Accordingly, even if the force of the spring 765 is made small, the cartridge 700 can be fixed in the attachment position. For this reason, the cartridge 700 can be easily attached thereto.

In order to remove the cartridge 700 from the stapler body 10, the operated portion 805A of the button 805 is pushed. In detail, when the operated portion 805A of the button 805 is pushed, the lever 800 is rotated counterclockwise against the force of the spring 803 because the front end 805B of the button 805 is in contact with the projection 802 of the lever 800, as shown in FIG. 76. By this rotation, the engagement surface 801A of the engagement portion 801 of the lever 800 disengages from the hooking portion 745 of the cartridge 700, and the cartridge 700 is pushed backward from the attachment position by the force of the spring 765. As a result, the cartridge 700 is removed from the stapler body 10.

As described above, the cartridge 700 is fixed in the attachment position not by the aid of the force of the spring 803 but by the engagement of the hooking portion 745 with the engagement surface 801A of the engagement portion 801 of lever 800. For this reason, the elastic force of the string 803 can be made small. Accordingly, the cartridge 700 can be easily removed from the stapler body 10 by pushing the operated portion 805A of the button 805 with smaller force.

In the second embodiment, the attachment of the cartridge 700 can be carried out with great ease because all that is required to fix the cartridge 700 in the attachment position is to insert the cartridge 700 into the stapler body 10.

What is claimed is:

1. An electric stapler comprising:

a stapler body having a driving-out portion;

a driver attached to said stapler body, for driving a staple from said driving-out portion while reciprocating;

a table mounted in said stapler body, said table reciprocating in conjunction with a driving mechanism by which said driver is reciprocated, sheets of paper to be fastened together being held between said table and said driving-out portion when said table reciprocates;

clinchers mounted on said table, for clinching ends of the staple which has been driven into the sheets by said driver and has passed through the sheets;

first detecting means for detecting that said table is in a home position; and second detecting means for detecting when said table has returned to a position where the sheets are released from being held therebetween;

wherein after the sheets are held between said table and said driving-out portion, the staple is driven thereinto by said driver and then said clinchers are actuated.

2. An electric stapler according to claim 1, wherein said first and second detecting means are constructed of a single detecting means.

3. An electric stapler comprising:

a stapler body having a driving-out portion:

a driver attached to said stapler body, for driving a staple from said driving-out portion while reciprocating;

a table mounted in said stapler body, said table reciprocating in conjunction with a driving mechanism by which said driver is reciprocated, sheets of paper to be fastened together being held between said table and said driving-out portion when said table reciprocates;

clinchers mounted on said table, for clinching ends of the staple which has been driven into the sheets by said driver and has passed through the sheets;

first detecting means for detecting that said table ins in a home position; and second detecting means for detecting when said table has returned to a position where the sheets are released from being held therebetween;

whereby a stapling operation is performed continuously and swiftly.

4. An electric stapler according to claim 3, wherein said first and second detecting means are constructed of a single detecting means.

* * * * *